US011613413B2

(12) United States Patent
Savenok

(10) Patent No.: US 11,613,413 B2
(45) Date of Patent: Mar. 28, 2023

(54) ADJUSTABLE-COLLAPSIBLE PACKAGING ASSEMBLY AND BODY

(71) Applicant: Pavel Savenok, Wheaton, IL (US)

(72) Inventor: Pavel Savenok, Wheaton, IL (US)

(73) Assignee: Resolute Patents, LLC, Wheaton, IL (US)

( * ) Notice: Subject to any disclaimer, the term of this patent is extended or adjusted under 35 U.S.C. 154(b) by 205 days.

(21) Appl. No.: 17/001,389

(22) Filed: Aug. 24, 2020

(65) Prior Publication Data

US 2020/0385180 A1 Dec. 10, 2020

Related U.S. Application Data

(62) Division of application No. 15/815,406, filed on Nov. 16, 2017, now Pat. No. 10,752,408.

(51) Int. Cl.

| | |
|---|---|
| ***B65D 43/06*** | (2006.01) |
| ***B65D 43/02*** | (2006.01) |
| ***B65D 43/26*** | (2006.01) |
| ***A47G 19/22*** | (2006.01) |

(52) U.S. Cl.

CPC ..... *B65D 43/065* (2013.01); *A47G 19/2272* (2013.01); *B65D 43/02* (2013.01); *B65D 43/0212* (2013.01); *B65D 43/26* (2013.01); *B65D 2543/00046* (2013.01); *B65D 2543/00092* (2013.01); *B65D 2543/00296* (2013.01); *B65D 2543/00351* (2013.01); *B65D 2543/00537* (2013.01); *B65D 2543/00638* (2013.01); *B65D 2543/00685* (2013.01); *B65D 2543/00731* (2013.01)

(58) Field of Classification Search

CPC ..... A47G 19/2272; B65D 43/02; B65D 43/0212; B65D 43/26; B65D 2543/00046; B65D 2543/00092; B65D 2543/00296; B65D 2543/00537; B65D 2543/00685

See application file for complete search history.

(56) References Cited

U.S. PATENT DOCUMENTS

| | | | | |
|---|---|---|---|---|
| 3,244,308 A * | 4/1966 | Esposito, Jr. | ..... | B65D 39/04 215/354 |
| 4,074,827 A | 2/1978 | Labe, III | | |
| 4,180,179 A | 12/1979 | Hoenig et al. | | |
| 5,253,781 A * | 10/1993 | Van Melle | ..... | A47G 19/2272 220/713 |

(Continued)

*Primary Examiner* — James N Smalley

(74) *Attorney, Agent, or Firm* — Christopher J. Scott

(57) ABSTRACT

A package assembly enables a user to adjust package assembly volume and includes a first (static or dynamic) package body and a second dynamic package body. The first package body has an upper body rim. Each dynamic package body provides a dynamic lid volume and has a rim-receiving groove, a lid wall, and at least one resilient portion. The rim-receiving groove is removably attachable to the upper body rim for defining a dynamic package assembly volume with the package body when in a closed configuration with the first package body. The resilient portion extends intermediate the lid wall and the rim-receiving groove and is resiliently actuable intermediate (a) a relaxed configuration for defining a maximum package assembly volume when in the closed configuration and (b) an actuated configuration defining a minimum package assembly volume in the closed configuration.

19 Claims, 32 Drawing Sheets

(56) References Cited

U.S. PATENT DOCUMENTS

| | | | | |
|---|---|---|---|---|
| 5,588,552 | A | 12/1996 | Johnson | |
| 5,897,019 | A | 4/1999 | Stropkay | |
| 7,357,272 | B2 | 4/2008 | Maxwell | |
| 9,238,529 | B1 | 1/2016 | Newman et al. | |
| 2003/0089713 | A1 | 5/2003 | Belt et al. | |
| 2005/0023183 | A1 | 2/2005 | Banik et al. | |
| 2006/0180028 | A1 | 8/2006 | Burchard | |
| 2008/0011762 | A1 | 1/2008 | Boone | |
| 2010/0140267 | A1* | 6/2010 | Sellari | B26D 3/08 220/839 |
| 2011/0068105 | A1 | 3/2011 | Pohlman et al. | |

* cited by examiner

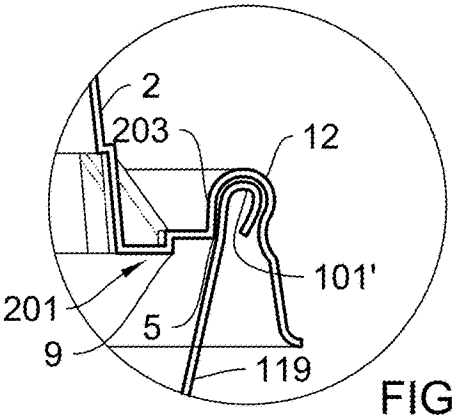
FIG. 20D
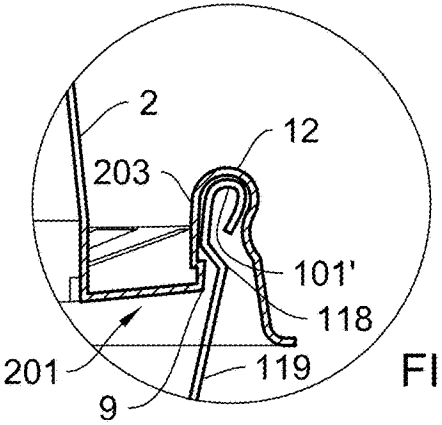
FIG. 21D
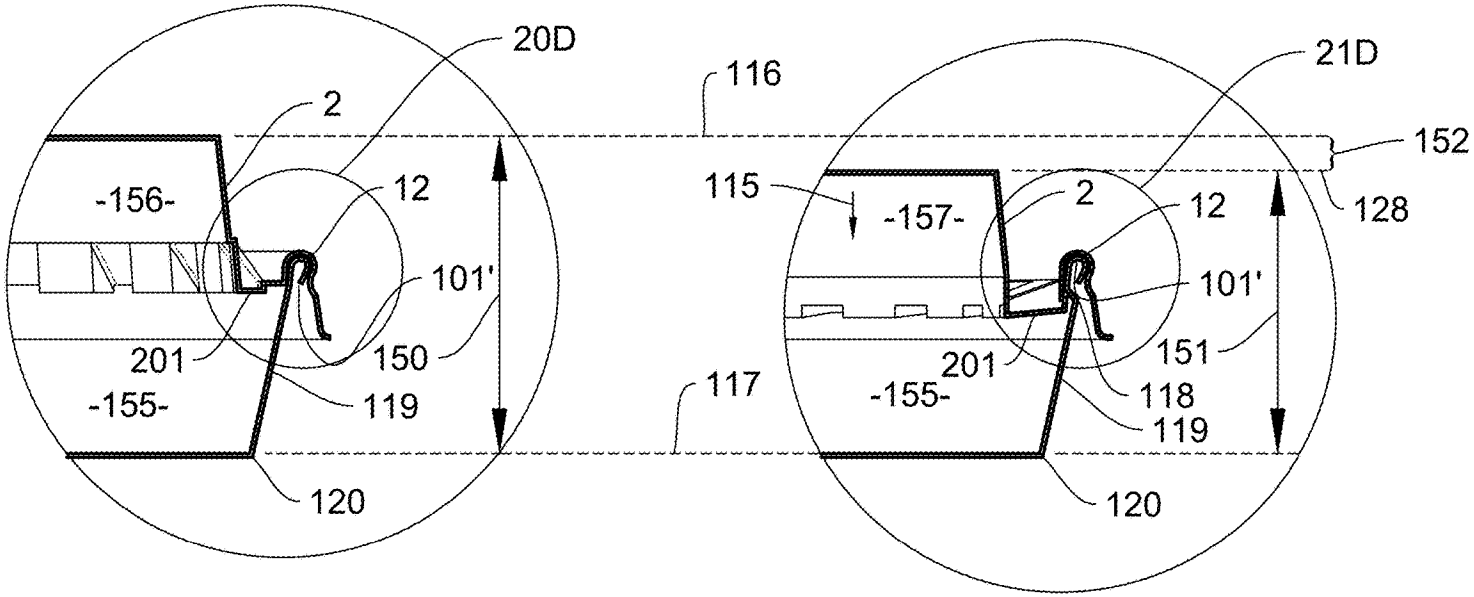
FIG. 20C
FIG. 21C

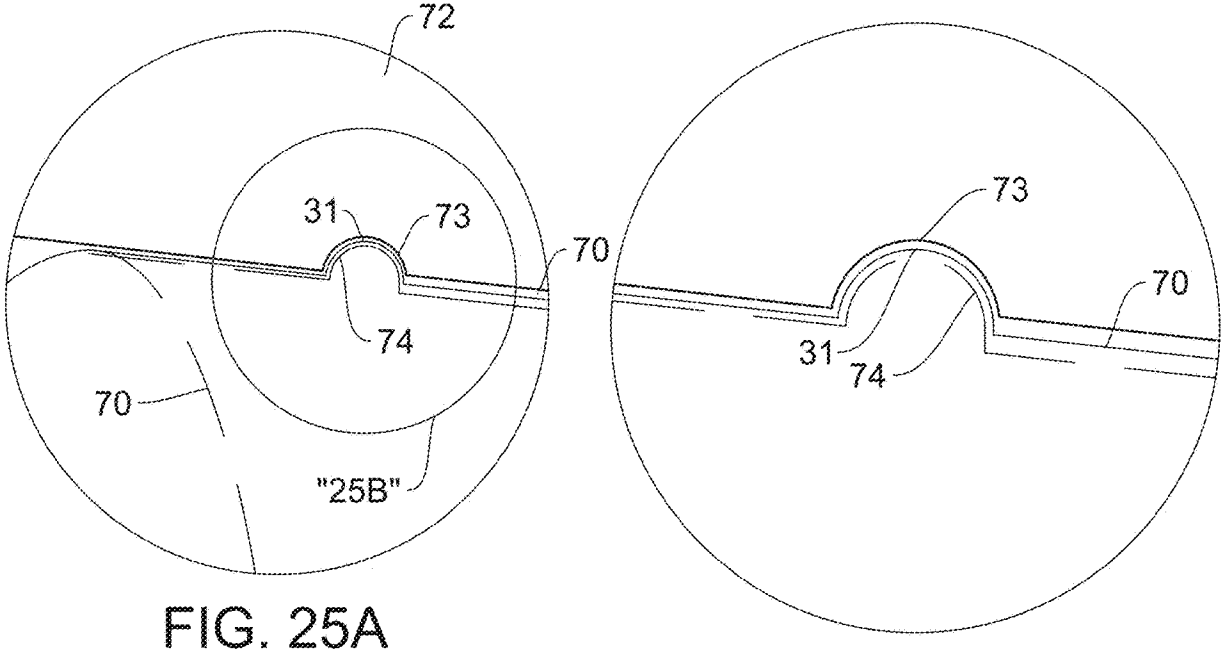
FIG. 25A
FIG. 25B
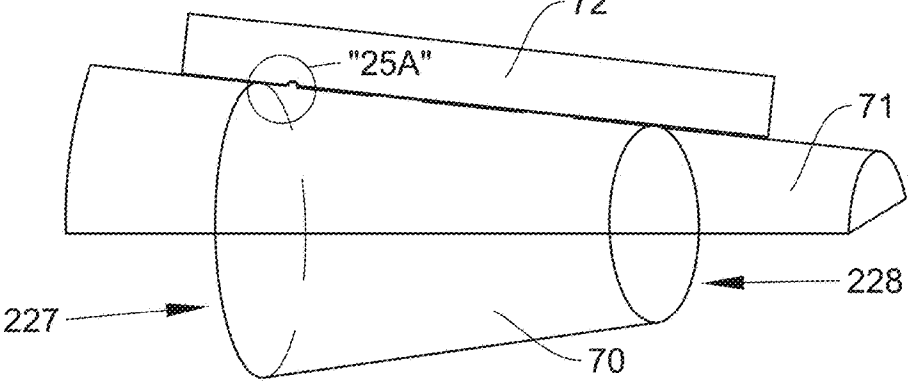
FIG. 25

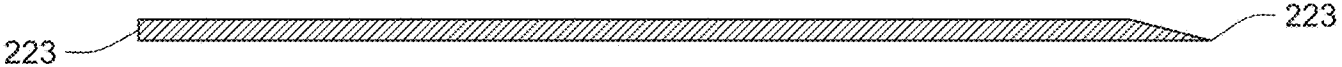
FIG. 34
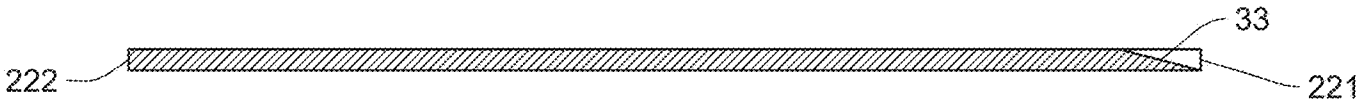
FIG. 33
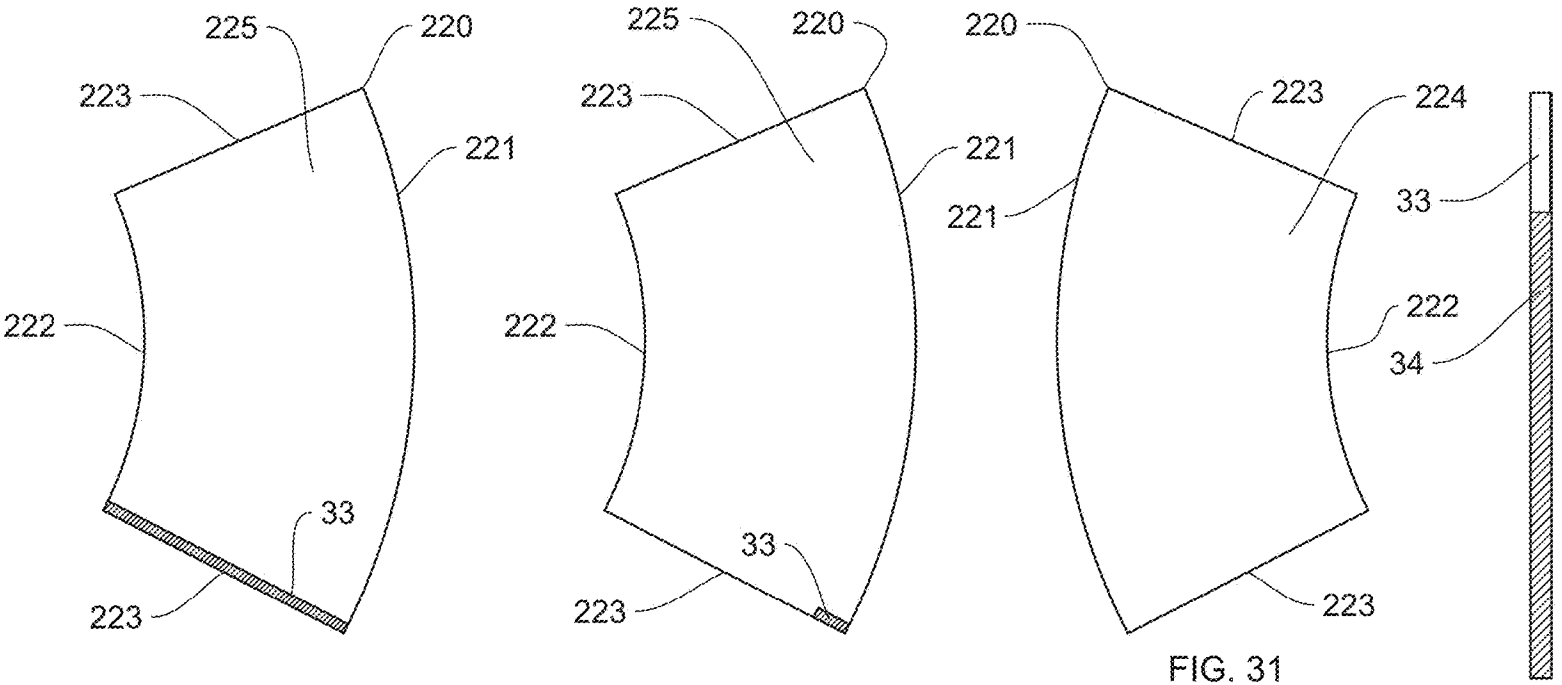
FIG. 29
FIG. 30
FIG. 31
FIG. 32

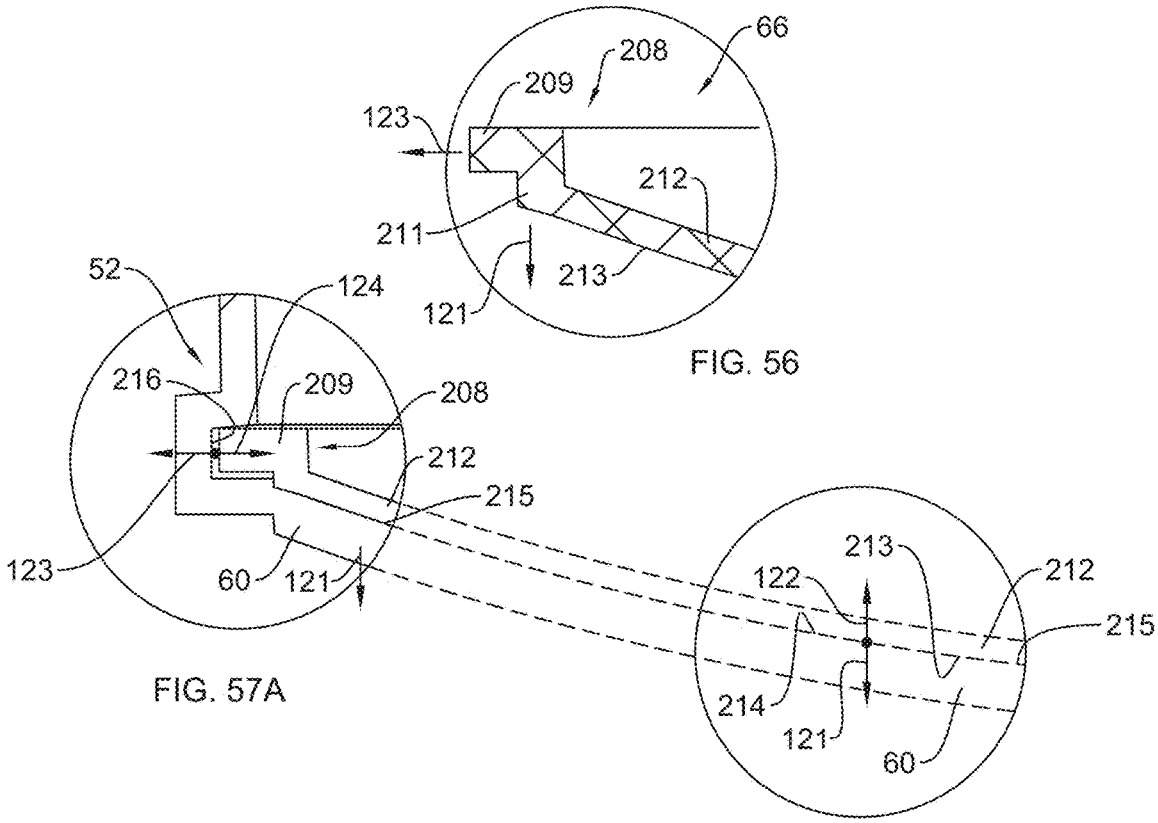
FIG. 56
FIG. 57A
FIG. 57B
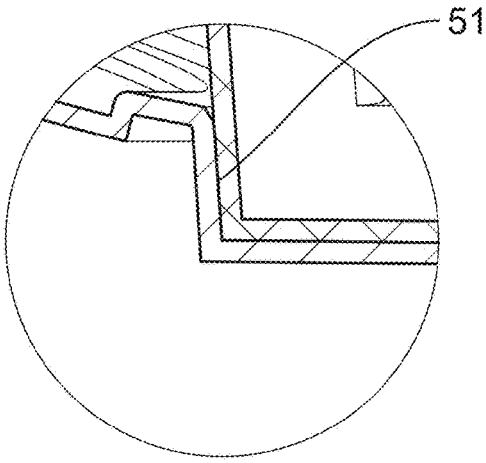
FIG. 54
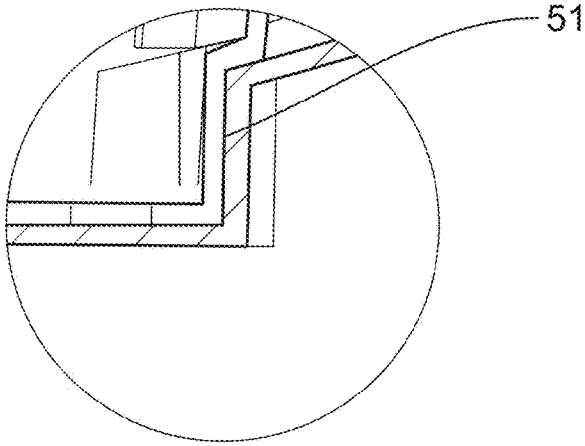
FIG. 55

ADJUSTABLE-COLLAPSIBLE PACKAGING ASSEMBLY AND BODY

PRIOR HISTORY

This application is a divisional patent application claiming the benefit of pending U.S. patent application Ser. No. 15/815,408 filed in the United States Patent and Trademark Office (USPTO) on 16 Nov. 2017, the specifications and drawings of all of which are hereby incorporated by reference thereto.

FIELD OF THE INVENTION

The present invention generally relates to container and lid combinations in the form of packaging assemblies, and more particularly to container-lid combinations primarily directed to packaging assemblies for enabling the user to selectively increase or decrease volumetric space within the container-lid combinations or packaging assemblies while further enhancing the secured relationship of packaging bodies relative to one another.

BRIEF DESCRIPTION OF THE PRIOR ART

U.S. Pat. No. 4,074,827 ('827 Patent), issued to Labe, III, discloses a Multi-Purpose Closure for a Container. The closure includes a base member having a central portion and a peripheral flange and a cover member also having a central portion and a peripheral flange. The cover member is adapted to be releasably secured to the base member such that when secured a cavity is formed between the respective members. The cavity is adapted for holding products, e.g., premiums or advertising material therein.

Alternatively, a game or amusement device can be disposed within the cavity. To that end, in one embodiment of the invention the base member includes at least one recess and at least one ball adapted to fit within the recess to provide a game of skill. Means are provided, such as a cross-cut in the closure to enable a straw to be extended therethrough and into the container with the closure in place. A marginal portion is provided in one embodiment on the flange of the cover member to facilitate the separation of the cover member from the base member.

U.S. Pat. No. 4,180,179 ('179 Patent), issued to Hoenig, et al., discloses a Beaded Snaplock Closure. The '179 Patent describes a closure structure including an outer ring and a separately formed cover each having annular channels which interlock to secure the cover in place on the ring and form a seal between the cover and the ring. The interlock is improved selectively by interlocking beads on radially outer walls of the interlocking channels or by a socket in the radially outer wall of the ring channel and a radially inwardly projecting bead on the radially inner wall of the cover channel, the bead projecting into the socket. The interlocks permit greater tolerances in the manufacture of the end unit, particularly the interlocking channels. This also provides for greater tolerances in the application of the cover after the associated container has been filled.

U.S. Pat. No. 5,588,552 ('552 Patent), issued to Johnson, discloses a Disposable Rolled Rim Cup and Lid Closure. The '552 Patent describes a container and closure. The container has a circular sidewall with a bottom and an open end defining a volume for containing a liquid, the sidewall having (i) a reinforced rim at the open end, (ii) a lid seat integrally formed in the sidewall and offset from the open end, (iii) a comfort zone extending along the sidewall from the bottom to the open end and (iv) a rim tab located on the inside of the container sidewall at the comfort zone adjacent the open end.

The rim tab extends beyond the open end of the container. The closure is a circular substrate having (a) a diameter to seat in the lid seat of the container, (b) a plurality of peripheral tabs extending beyond the diameter of the substrate and (c) a pull tab located near an outer edge of the substrate which when pulled provides an opening through which liquid can pass when the closure is seated in the lid seat of the container. The peripheral tabs are preferably (1) a first tab having a slotted opening to accept the rim tab and (2) two or more talon tabs, each having an opening adapted and located to engage the rim of the container.

U.S. Pat. No. 5,897,019 ('019 Patent), issued to Stopkay, discloses a Frustoconical Beverage Cup and Fitted Lid. The '019 Patent describes a tapered cup having an outwardly rolled lip includes a cup wall having an upper portion that is outwardly flared more than an adjacent lower wall portion. The cup can include a groove below the outwardly rolled lip in the inner face of the cup wall. The cup can be provided with stacking ribs within the cup to aid in stacking of two or more cups. The cup can include a tapered lid with an outwardly flared lip that seats against the inner wall of the cup and that does not extend over the lip of the cup. The lid can include a locking ring below the outwardly flared lip of the lid that is adapted for insertion into the groove in the cup. The lid further includes a fluid port.

U.S. Pat. No. 7,357,272 ('272 Patent), issued to Maxwell, discloses a Ventable Container Assembly. The '272 Patent describes a ventable container including a container bottom having an inner cavity. The container bottom further has a side wall that terminates in a container rim, and a selectively detachable lid. The lid includes a central panel and peripheral sealing lip that surrounds the panel.

The peripheral sealing lip has a generally inverted U-shaped cross-section that defines a lid channel adapted to receive the container rim, the lid channel being further adapted to position the lid at a first position wherein sealed engagement of the container is effectuated and at a first position relative to the container rim wherein an air passage from the inner cavity to the container surroundings is provided.

U.S. Pat. No. 9,238,529 ('529 Patent), issued to Newman et al., discloses a Lid for a Drink Cup. The '529 Patent describes a lid for a drink cup having a cover, and a slider, the slider engaged in sliding motion on the top of a disc of the cover. The disc has an aperture spaced apart from a flap. The slider is able to move to a position covering the aperture so as to prevent liquid from exiting the drink cup and, the slider is also able to move to a position to uncover the aperture to allow liquid to exit the drink cup. When the slider is positioned over the flap, the flap is forced to open slightly to allow air to enter the drink cup for venting action.

US Patent Application Publication No. 2003/0089713 ('713 Publication) authored by Belt, et al. describes a re-closable lid for a drinking cup comprising a base and a cap in mating relationship which can rotate relative to each other. Both the base and cap are provided with an aperture for delivery of liquid therethrough. When the apertures are aligned, liquid may be removed from the cup. When the cap is rotated relative to the base so that the apertures are offset, removal and spillage of liquid will be prevented.

US Patent Application Publication No. 2005/0023183, authored by Banik et al., describes a container for containing articles. The container comprises a first section and a second section. The first section is capable of engaging the second section to form a hermetic seal. The first section has a first cavity that is surrounded by a first peripheral wall and a peripheral edge. The first peripheral wall has a first surface that is angled toward the peripheral edge. The second section has a second peripheral wall that is capable of sliding between the first peripheral wall and the edge to form a hermetic seal.

US Patent Application Publication No. 2006/0180028, authored by Burchard, describes a lid for a beverage container for holding a decoction beverage, preferably a disposable tea container with a base plate and a covering arranged at a distance from the base plate in which case between the base plate and the covering a holding space bounded on the sides by a surrounding side wall is formed. A first opening is provided in the base plate through which a decoction unit holding decoction materials can be guided and a second opening smaller than the first opening being formed in the covering or in the region of the covering through which a section of the decoction unit can be guided, the holding space being of dimensions such as to hold at least part of the decoction unit.

US Patent Application Publication No. 2008/0011762, authored by Boone, describes a splash-proof cup lid that includes plural barriers disposed on the undersurface of the cup lid. The barriers are strategically positioned and uniquely configured to prevent liquid from sloshing through the drink opening when the cup is in an upright or slightly tilted position and is bumped or jarred. The barriers however, do not prevent the liquid from flowing through the drink opening when the cup is tilted to a drinking position.

US Patent Application Publication No. 2011/0068105, authored by Pohlman et al., describes a container including a lid adapted to seal with a base. The lid and base rims each have vertical segments that mate upon sealing the container. The mating segments form a vertical seal zone. The vertical seal zone has a width extending across the rim surfaces. One or more vent channels are disposed on either or both rims. Each vent channel extends partially into the vertical seal zone.

When pressure inside the container reaches a critical level, the lid rises and reduces the width of the seal zone, creating a vent point. Pressurized vapors traveling through the vent channel overcome rim-engaging forces at the vent point and pass through the engaged rims. Once pressure is purged, the lid descends and resumes its sealed arrangement with the base. The rims may respectively include horizontally oriented segments that engage each other to from a horizontal seal zone.

SUMMARY OF THE INVENTION

The primary objective of the present specifications is to a package assembly for adjusting package assembly volume. The package assemblies according to the present invention essentially comprises a first package body, which body may be a static or a dynamic package body. When implemented as a static package body or package box, the package body defines a static internal body volume and comprises a container or first body rim. The packaging assembly may optionally be provided with a first upper body or first lower body or first side body with complementary dynamic packaging body attachable thereto, it being noted that both packaging bodies may be optionally dynamic.

The package assemblies further essentially comprises a second or dynamic package body, which second, dynamic package body is actuable for providing a dynamic internal body volume and comprises attachment means exemplified by a rim-receiving groove, a second body wall, and at least one resilient portion. The rim-receiving groove receives the body rim of the first package body for defining a dynamic internal package assembly volume with the dynamic package body when the rim-receiving groove receives the body rim. The at least one resilient portion extends intermediate the body wall and the rim-receiving groove and is resiliently actuable intermediate (a) a relaxed configuration for defining a maximum internal package assembly volume when assembled with the first package body and (b) an actuated configuration defining a minimum internal package assembly volume when assembled with the first package body.

The packaging assembly may optionally be provided with a static upper body or static lower body or side body with complementary dynamic packaging body attachable thereto, or alternatively both packaging bodies may be optionally dynamic. In this regard, the present invention contemplates the provision of a package assembly for adjusting package assembly volume having a first package body with a body rim, and a second package body with a rim-receiving groove.

A select package body, as selected from the group consisting of the first and second package bodies, is actuable for providing a dynamic body volume and further comprises a body wall and at least one resilient portion. The rim-receiving groove receives the body rim, and the select package body thereby defines a dynamic package assembly volume when the rim-receiving groove receives the body rim. The at least one resilient portion extends intermediate the body wall and the rim-receiving groove and is resiliently actuable intermediate (a) a relaxed configuration for defining a maximum package assembly volume when in a closed configuration and (b) an actuated configuration defining a minimum package assembly volume when in the closed configuration.

A secondary objective of the present specifications is the provision of a number liquid lid-container combinations for maximizing lid-to-container retention or to prevent lids from becoming inadvertently removed from containers once outfitted thereupon. To achieve this basic objective, the present invention generally provides container lids having a rim-receiving groove, a lid wall, and a resilient portion extending intermediate the rim-receiving groove and the lid wall.

The resilient portion is resiliently actuable intermediate an unlocked configuration and a locked configuration, and further preferably comprises at least one indentation-engaging portion. The rim-receiving groove receives the upper container rim, and the at least one indentation-engaging portion engages the at least one indentation when in the locked configuration. Together, the rim-receiving groove and the at least one indentation-engaging portion lock the container lid to the upper container rim of a liquid container when in the locked configuration for maximizing lid-to-container retention.

The container lids according to the present invention are stackable in a series of identical container lids. The series of identical container lids have a relatively reduced stacked height when in the unlocked configuration as compared to the locked configuration and further have a reduced lid-to-lid contact surface area when in the locked configuration for reducing lid-to-lid adhesion. The user may thus select either the unlocked or locked configurations when packaging container lids according to the present invention depending on the requirements of the user.

The container lids according to the present invention are further usable in combination with a particularly manufactured liquid container according to the present invention.

The liquid container preferably comprises or includes an upper container rim and a container wall extending downwardly from the upper container rim. The container wall comprises a seam and at least one indentation at the inner container surface. The seam extends orthogonally relative to the container rim, and the at least one indentation extends outwardly at the inner container surface of the container wall.

The at least one indentation comprises a primary indentation, the primary indentation preferably traverses the seam in parallel relation to the container rim. The primary indentation traverses the seam at the inner container surface such that the seam at the inner container surface bisects the primary indentation in substantially equal half portions. The container wall may further preferably comprise a series of secondary indentations that extend outwardly in inferior adjacency to the upper container rim at the inner surface of the container wall in parallel relation to the container rim and in coplanar relation with the primary indentation.

The rim-receiving groove of the container lids preferably comprises an outer groove wall and an inner groove wall. The wall-to-groove resilient portion is preferably L-shaped and connected to the inner groove wall at a first pivot point. The L-shaped resilient portion comprises a base portion and an upright portion that pivot between the unlocked and locked positions. The base portion extends inwardly from the inner groove wall and the upright portion extends substantially parallel to the inner groove wall when in the unlocked configuration. When in the locked configuration, the base portion is coplanar with the inner groove wall and the upright portion extends inwardly relative to the inner groove wall.

The lid wall may preferably comprise a lid indentation. The lid indentation extends inwardly in superior adjacency to the wall-to-groove resilient portion. The lid indentation is connected to the upright portion at a second pivot point, and provides a resilient structural relief for enhancing movement between the locked and unlocked configuration. The outer groove wall of the rim-receiving groove preferably comprises a groove wall indentation. The groove wall indentation extends inwardly in inferior adjacency to the upper container rim for enhancing fitted engagement therewith.

The container lid is preferably provided as an ensemble and comprises a lower lid construction and an upper lid construction. The upper lid construction is seatable atop the lower lid construction and is movable relative thereto. The lower lid construction comprises a lower lid outlet and the upper lid construction comprises an outlet-covering indentation and an upper lid outlet. The outlet-covering indentation is positionable over the lower lid outlet for selectively preventing liquid egress therefrom.

The lower lid outlet is formed in a lower lid indentation and surrounded in spaced relation by a raised ridge. The outlet-covering indentation is smaller in dimension than the lower lid indentation such that an air pocket extends between the lower lid indentation and the outlet-covering indentation when the outlet-covering indentation covers the lower lid outlet. The air pocket further prevents liquid egress from the lower lid outlet.

The upper lid construction comprises an edge-located step-down formation received in an edge-receiving groove formed in the lower lid construction. The step-down formation enhances seated engagement between the upper and lower lid constructions. The upper lid construction is peripherally sized so as to form an air space radially and outwardly adjacent the step-down formation when received in the edge-receiving groove. The air space reduces friction between the upper and lower lid constructions.

The present invention further contemplates a method of manufacturing a liquid container comprising the steps of providing a cup fan, the cup fan having a top edge, a bottom edge, and opposed side edges, and forming a container sidewall from the cup fan. The container sidewall has an open top end, an open bottom end, an inner cup surface, and outer cup surface, and a longitudinal seam extending from the open top end to the open bottom end at an overlap site of the opposed side edges.

First and second press elements are positioned adjacent the outer and inner cup surfaces, preferably at the seam site. Each of the first and second press elements have a non-planar press surface, which surfaces are matable. The outer and inner cup surfaces are pressed via or between the first and second press elements for forming at least one non-planar singular formation at the inner and outer cup surfaces traversing the seam site. The first press element may preferably comprises a female indentation and the second press element may preferably comprise a male protuberance. The male protuberance is matable with the female indentation for forming an outwardly extending indentation at the inner cup surface.

The cup fan preferably comprises a first side and a second side. The second side may preferably be processed before forming the container sidewall to remove material therefrom adjacent a first of the opposed side edges thereby forming at least one material-removed edge section. The material-removed edge section preferably extends obliquely relative to the first side for reducing a seam thickness at the inner cup surface. The material-removed edge section may extend an entire length of the first of the opposed side edges or may be formed adjacent the top edge.

BRIEF DESCRIPTION OF THE DRAWINGS

Other features and objectives of the subject invention will become more evident from a consideration of the following brief descriptions of patent drawings.

FIG. 20C is a fragmentary cross-sectional view as fragmented and sectioned from FIG. 20A to show the relative height of the dynamic package body in the pre-compressed, un-engaged, unlocked configuration in a closed position with the generic packaging box as juxtaposed against FIG. 21C for ease of comparison therewith.

FIG. 21C is a fragmentary cross-sectional view as fragmented and sectioned from FIG. 21A to show the relative height of the dynamic package body in the compressed, engaged, locked configuration in a closed position with the generic packaging box as juxtaposed against FIG. 20C for ease of comparison therewith.

FIG. 20D is an enlarged fragmentary section view as enlarged and sectioned from FIG. 20C to show in greater detail the removable attachment site of the dynamic package body to the packaging box.

FIG. 21D is an enlarged fragmentary section view as enlarged and sectioned from FIG. 21C to show in greater detail the removable attachment site of the dynamic package body to the packaging box.

FIG. 25 is a second sequential diagrammatic depiction of the process for forming a seamed container sidewall showing the heated press element with female indentation feature and the cone mold with male protuberance in engagement with the paper cone element for forming the indentation formation on the seamed container sidewall.

FIG. 25A is a first enlarged, fragmentary sectional view as sectioned from FIG. 25 to show in greater detail the structures associated with the process otherwise illustrated in FIG. 25.

FIG. 25B is a second further enlarged, fragmentary sectional view as sectioned from FIG. 5A to show in still greater detail the structures associated with the process otherwise illustrated in FIG. 25A.

FIG. 29 is a plan view of a cup fan or template depicted in flat or two-dimensional geometry with material removed from a non-coated side along the entire edge-seam site prior to processing.

FIG. 30 is a plan view of a cup fan or template depicted in flat or two-dimensional geometry with material removed from a non-coated side along a portion of the edge-seam site prior to processing.

FIG. 31 is a plan view of coated side of a cup fan or template depicted in flat or two-dimensional geometry prior to processing.

FIG. 32 is a side edge view of the cup fan or template depicted in flat or two-dimensional geometry otherwise depicted in FIG. 30.

FIG. 33 is a top edge view of the cup fan or template depicted in flat or two-dimensional geometry otherwise depicted in FIG. 30.

FIG. 34 is a top edge view of the cup fan or template depicted in flat or two-dimensional geometry otherwise depicted in FIG. 29.

FIG. 54 is an enlarged, fragmentary sectional view as enlarged and sectioned from FIG. 52 to show in greater clarity the structures associated therewith.

FIG. 55 is an enlarged, fragmentary sectional view as enlarged and sectioned from FIG. 52 to show in greater clarity the structures associated therewith.

FIG. 56 is a fragmentary, enlarged sectional view of an edge portion of an upper lid construction according to the present invention to show in greater detail the edge portion.

FIG. 57A is a fragmentary, enlarged sectional view of an edge portion of an upper lid construction engaged with an edge-receiving groove of a lower lid construction according to the present invention.

FIG. 57B is a fragmentary, enlarged sectional view of an interface between an upper lid construction and a lower lid construction according to the present invention.

DETAILED DESCRIPTION OF THE PREFERRED EMBODIMENTS

Figure 1A:
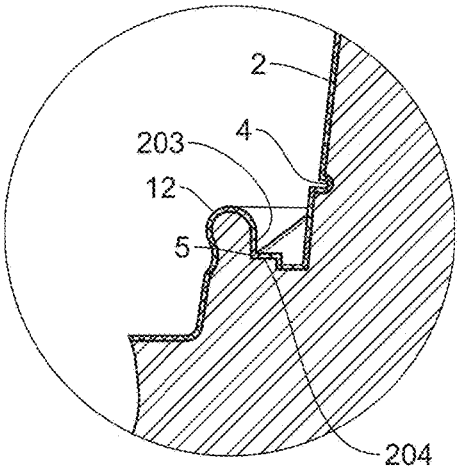
FIG. 1A is an enlarged, fragmentary sectional view as sectioned from FIG. 1 to show in greater detail a locking mechanism of the upper lid thermoform in an originally thermoformed state.
Figure 1:
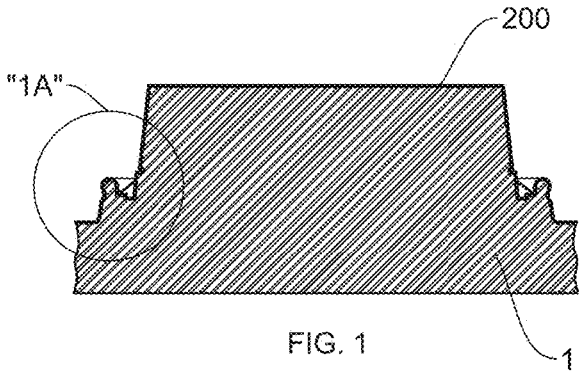
FIG. 1 is a first sequential longitudinal cross-sectional depiction of a generic lid thermoform process according to the present invention depicting a lower mold and an upper thermoformed lid construction embracing the lower mold having mold-based cavities.

Referring now to the drawings with more specificity, the following specifications generally describe a number of lid-container combinations or container assemblies operable for enhancing lid-to-container retention. These specifications are particularly directed to lid-container combinations that form packaging assemblies having a dynamic lid or packaging body and a static container or packaging body, or combinations of both, which together form a packaging assembly that enables the user to selectively increase or decrease internal volumetric space of the packaging ensemble or assembly as discussed in more detail below particularly in connection with the subject matter illustrated in FIGS. 19-21D.

The present invention further contemplates an optional body-to-body locking mechanism. The adjustable or collapsible feature of the dynamic packing body may simply provide for adjustable packaging assembly volume only, and the body-to-body locking mechanism may retain the packaging assembly in a compressed volumetric state. Further the dynamic packaging body need not be a lid or cap type structure per se, but may also be provided so as to be a lower dynamic packaging body or configured for attachment to the sides of packaging bodies.

The prior art perceives a need for a container or packaging assembly of low-cost construction with unique structural features for both preventing inadvertent lid removal from the lower liquid container while further operating to prevent liquid leakage via the junction site of the lid and seam of the lower liquid container, and enabling the user to selectively increase or decrease internal volumetric space of the packaging ensemble or assembly. To address these shortcomings in the prior art, the present invention basically provides a container or packaging assembly for maximizing lid-to-container retention and/or allowing adjustment of package assembly volume. In other words, the packaging assembly according to these specifications may provide the user with certain means for adjusting the package assembly volume only, with the option of retaining the adjusted volume by means of a body-to-body locking mechanism as described in more detail below.

An exemplary container assembly according to the present invention preferably comprises a liquid container as at 100 or 110 and a container lid as at 200 or 210. Certain methods for forming the liquid container(s) 100 and 110 and container lids 200 and 210 are also contemplated. FIGS. 1-3A together depict a series of sequential steps for forming the container lids 200 and 210 wherein the lids are formed via a thermoform process. A lower mold 1 and an upper thermoformed lid 200 is shown in each of FIGS. 1, 2, and 3 in various states of engagement with the mold 1, which mold 1 comprises mold-based cavities for forming certain features of the container lid 200. FIG. 1A is an enlarged, fragmentary sectional view as sectioned from FIG. 1 to show in greater detail a locking mechanism of the upper lid thermoform in an originally thermoformed state. This is the unlocked or relaxed lid configuration.

Figure 2A:
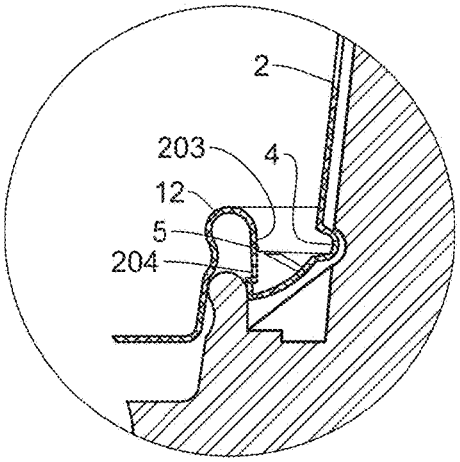
FIG. 2A is an enlarged, fragmentary sectional view as sectioned from FIG. 2 to show in greater detail the upper lid construction being removed from the mold at the mold-based cavity site.
Figure 2:
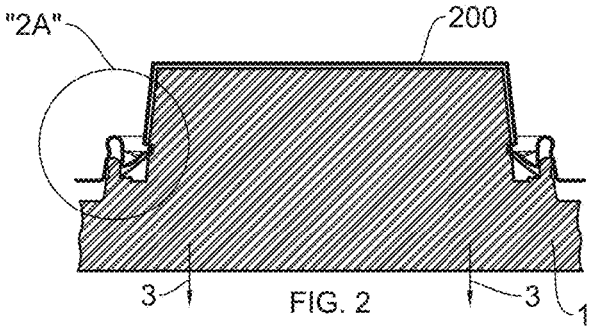
FIG. 2 is a second sequential longitudinal cross-sectional depiction of the lower mold being removed from the upper lid construction.

The reader is directed to points 4 and 5 of the container lid 200 as shown and referenced in FIG. 1A. Point 5 is a pivot point and point 4 is a resilient structural relief. FIG. 2 is a second sequential longitudinal cross-sectional depiction of the lower mold 1 being removed as at arrows 3 from the thermoformed upper container lid 200. Referencing FIG. 2A, the reader will there consider that the resilient locking mechanism of the lid construction 200 has pivoted about pivot point 5 such that a base portion 204 becomes coplanar with an inner groove wall 203 when being reconfigured from the unlocked or relaxed lid configuration into the locked or actuated configuration.

Figure 3A:
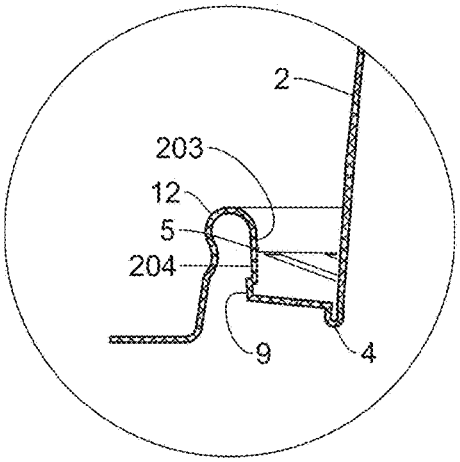
FIG. 3A is an enlarged, fragmental sectional view as sectioned from FIG. 3 to show in greater detail the locking mechanism of the lid construction in an engaged state after the mold is fully removed from lid construction and after the top of the lid construction is pressed from the top.
Figure 3:
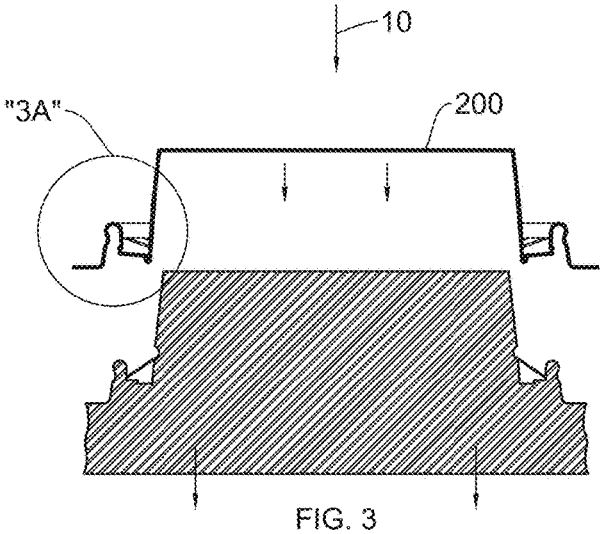
FIG. 3 is a third sequential longitudinal cross-sectional depiction of the lower mold fully removed from the upper thermoformed lid construction; the thermoformed lid construction being depicted in an engaged state.

FIG. 3 is a third sequential longitudinal cross-sectional depiction of the lower mold 1 fully removed from the upper thermoformed container lid or lid construction 200. The thermoformed lid construction 200 is depicted in the locked or actuated state in FIGS. 3 and 3A. The locked or engaged state of the thermoformed lid construction 200 can also be achieved by pressing from the top (as at arrows 10) after the mold 1 is removed from the thermoformed lid construction 200. FIG. 3A shows in greater detail the locking mechanism of the lid construction 200 when in the locked or engaged state after the mold 1 is fully removed from lid construction 200 and after the lid construction 200 is pressed from the top so as to position the lid construction 200 in the locked or actuated configuration.

Figure 4:
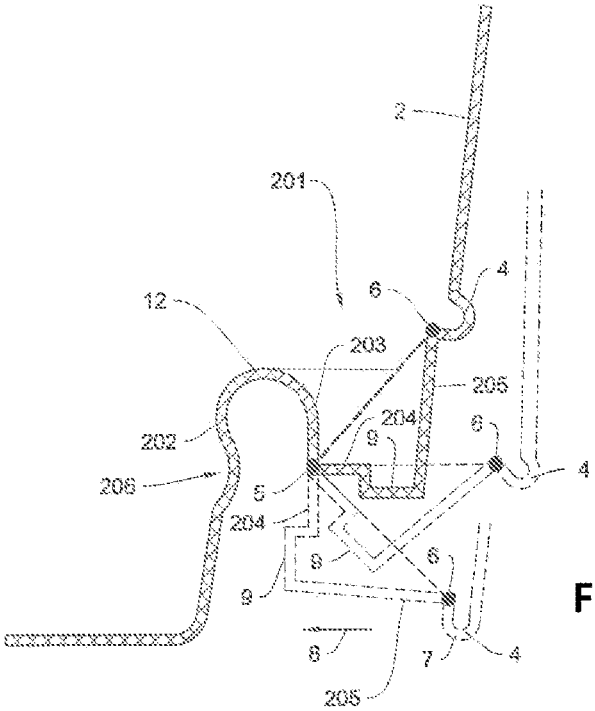
FIG. 4 is a further enlarged, fragmentary sectional view of a first alternative locking mechanism of the lid construction according to the present invention showing a resilient portion/locking mechanism is solid lining at a relaxed, unlocked configuration and showing the resilient portion/locking mechanism in broken lining at an actuated, locked configuration.
Figure 5:
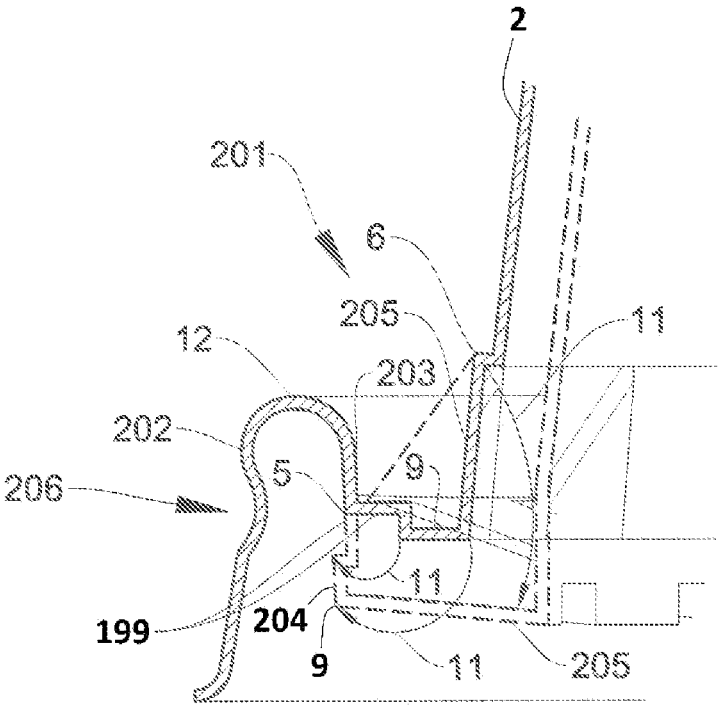
FIG. 5 is a further enlarged, fragmentary sectional view of a second alternative locking mechanism of the lid construction according to the present invention showing the resilient portion/locking mechanism is solid lining at a relaxed, unlocked configuration and showing the resilient portion/locking mechanism in broken lining at an actuated, locked configuration.

FIGS. 4 and 5 are further enlarged, fragmentary sectional views depicting a process of directing the container lid 200 into an actuated or locked configuration from a relaxed or unlocked configuration after the mold 1 has been removed from the upper thermoformed lid construction 200. When removed from the mold, the resistance at point 4 (or any other point to create moving momentum) creates certain rotational momentum as at arrows 11 with pivot point 5. The structure at 6 pivots at least 90 rotational degrees and locks the thermoformed material in constant internal resistance mode as at 7 creating constant pressure power vector radially and outwardly directed as at 8. The depression or indentation-engaging formation 9, easily formed during a generic thermoforming process, becomes an indentation-engaging portion 9 that may press against an inner surface 103 of a container wall 102 when outfitted thereupon as represented by force vector 8.

FIGS. 6-21 attempt to depict various views showing the locking mechanism according to the lid constructions 200 and 210 of the present invention in engagement with a cup wall or liquid container as at 100 or 110. The reader will consider that the lid constructions 200 and 210 according to the present invention are designed for use in combination with a low cost, disposable paper-based liquid container formed from overlapped cup fan 220 having a seam as at 30. It is noted that the seam site of a paper-based cup or liquid container is one of the weakest points of a liquid container, liquid often seeping or leaking from the lidded liquid container when a seamed upper container rim is outfitted with a rim-receiving groove of most state-of-the-art lid constructions.

The containers 100 and 110 according to the present invention thus each preferably comprise an upper container rim 101 and a container wall 102 extending downwardly from the upper container rim 101. The container wall 102 preferably comprises a seam as at 30 and a primary indentation or formation 31 that extends radially outwardly relative to the plane of the container wall 102. The seam 30 extends longitudinally or orthogonally relative to the container rim 101 and the primary indentation or formation 31 extends (radially) outwardly in inferior adjacency to the upper container rim 101 at an inner surface 103 of the container wall 102 with a corresponding protuberance 105 at the outer surface 104 of the container wall 102.

The primary indentation or formation 31 preferably traverses the seam 30 in parallel relation to the container rim 101. Container 100 differs from container 110 by having a single indentation identified as a primary indentation or formation 31 whereas container 110 has both a primary indentation or formation 31 and a series of secondary indentations or formations 37 that extend radially outwardly in inferior adjacency to the upper container rim 101 at the inner surface 103 of the container wall 102 in parallel relation to the container rim 101 and in coplanar relation with the primary indentation 31.

Figure 20:
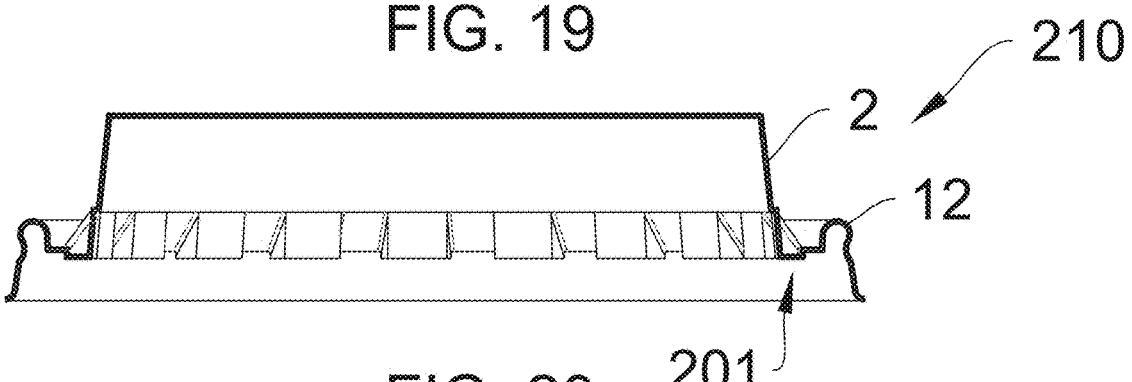
FIG. 20 is a longitudinal cross-sectional view of the first alternative lid construction according to the present invention showing the lid in a pre-compressed, un-engaged, unlocked configuration.
Figure 21:
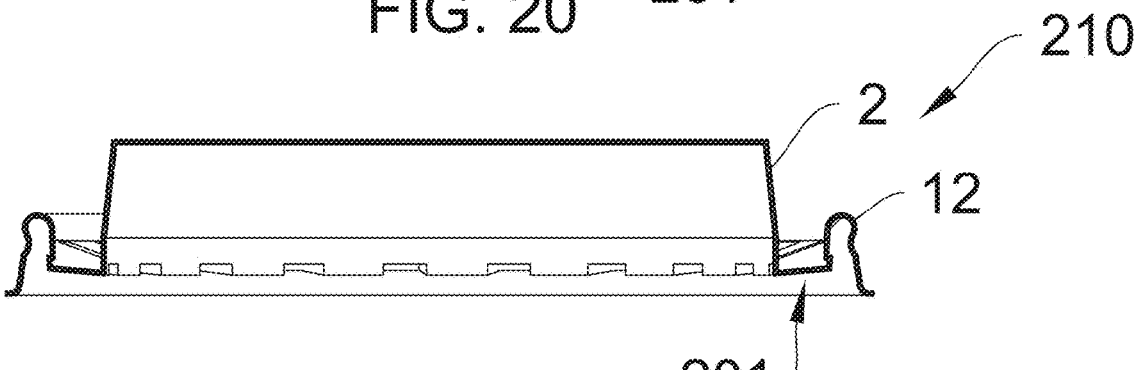
FIG. 21 is a longitudinal cross-sectional view of the first alternative lid construction according to the present invention showing the lid in a compressed, engaged, locked configuration.

The container lids 200 and 210 each preferably comprise a rim-receiving groove formation as at 12, an upright lid wall as at 2, and a wall-to-groove locking mechanism or resilient portion as at 201. The wall-to-groove locking mechanism or resilient portion 201 traverses the structural distance between the lid wall 2 and the rim-receiving groove 12 and is resiliently actuable intermediate a relaxed or unlocked configuration generally depicted in solid lining in FIGS. 4 and 5, and an actuated or locked configuration as generally depicted in broken lining in FIGS. 4 and 5. FIG. 20 depicts container lid 210 in an unlocked configuration and FIG. 21 depicts container lid 210 in a locked configuration. The primary difference between container lid 210 and container lid 200 is that the lid 210 is square in form and lid 200 is circular in form.

Central to the practice of the present invention is the wall-to-groove locking mechanism or resilient portion 201.

The wall-to-groove resilient portion 201 preferably comprises at least one outer indentation-engaging portion as at 9. The rim-receiving groove formation 12 receives the upper container rim 101 of the containers 100 and 110 and the at least one indentation-engaging portion 9 engages or mates with the primary indentation 31 when directed into the actuated or locked configuration. The rim-receiving groove formation 12 and the at least one outer indentation-engaging portion 9 together function to lock or fasten the container lids 200 and 210 to the containers 100 and 110 when in the actuated or locked configuration for cooperatively maximizing lid-to-container retention or preventing inadvertent removal of the lids 200/210 from the containers 100/110. It is to be understood that the rectangular form of container lid 210 is designed for use with a liquid container having a similarly shaped transverse cross-section although such an embodiment has not been specifically illustrated. The shapes of containers 100 and 110 are believed exemplary and not intended to be limiting.

The rim-receiving groove formation 12 of the container lids preferably comprises an outer groove wall as at 202 and an inner groove wall as at 203. The (wall-to-groove) resilient portion 201 preferably comprises an L-shaped portion and is connected to the inner groove wall 203 at a first pivot point 5. The L-shaped portion of resilient portion 201 preferably comprises a base portion as at 204 and an upright portion as at 205, which upright portion 205 extends orthogonally relative to the base portion 204. The base portion 204 extends inwardly from the inner groove wall 203 and the upright portion 205 extends substantially parallel to the inner groove wall 203 when the container lids 200 and 210 are in the relaxed or unlocked configuration. The base portion 204 becomes substantially parallel to the inner groove wall 203 and the upright portion 205 extends inwardly relative to the inner groove wall 203 when directed into the actuated or locked configuration.

Figure 4A:
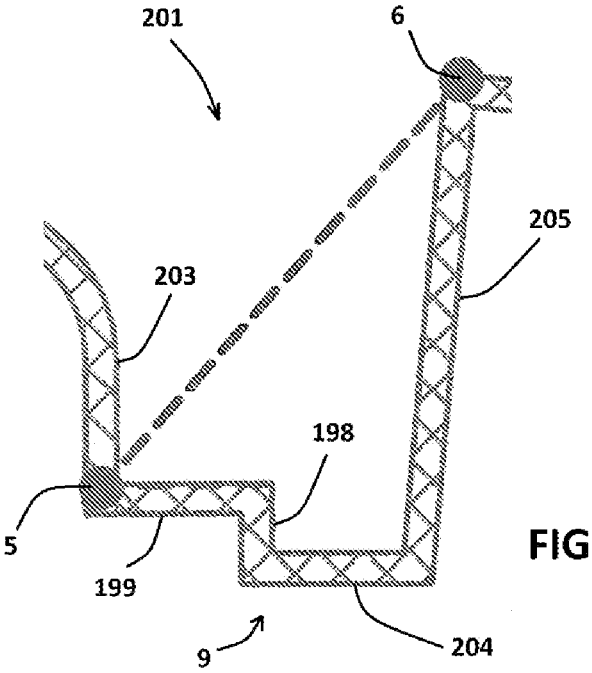
FIG. 4A is an enlarged sectional view as enlarged and sectioned from FIG. 4 to more clearly show the junction between a lid wall and a rim-receiving groove, which junction defines the resilient portion/locking mechanism according to the present invention.
Figure 5A:
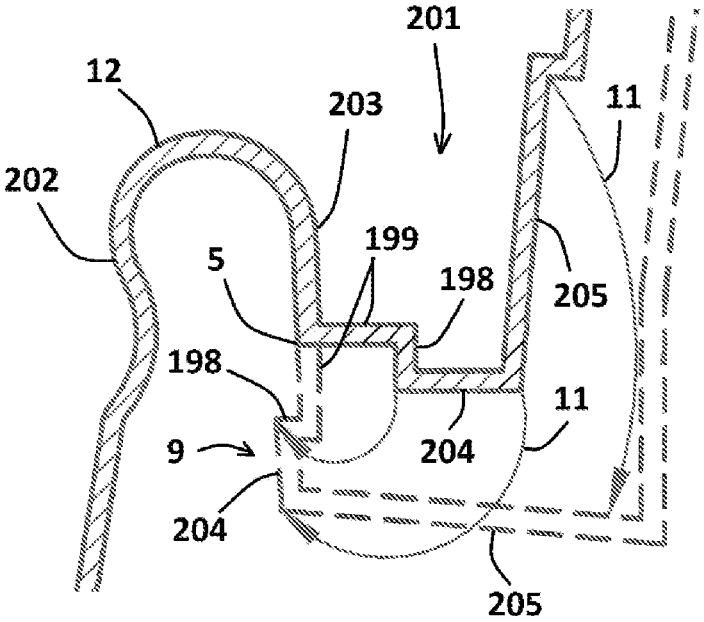
FIG. 5A is an enlarged sectional view as enlarged and sectioned from FIG. 5 to more clearly show the junction between a lid wall and a rim-receiving groove, which junction defines the resilient portion/locking mechanism according to the present invention.
Figure 7:
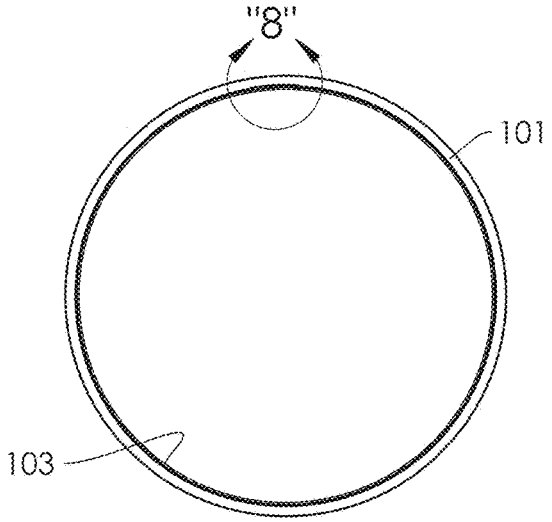
FIG. 7 is a transverse cross-sectional view as sectioned from FIG. 6 through the indentation formation.
Figure 8:
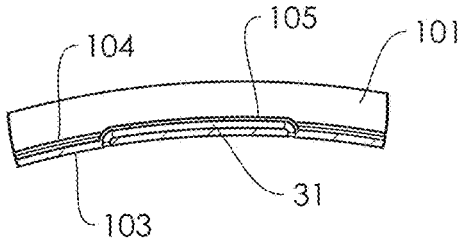
FIG. 8 is an enlarged, fragmentary sectional view as sectioned from FIG. 7 to show in greater detail structure associated with the indentation formation.
Figure 6:
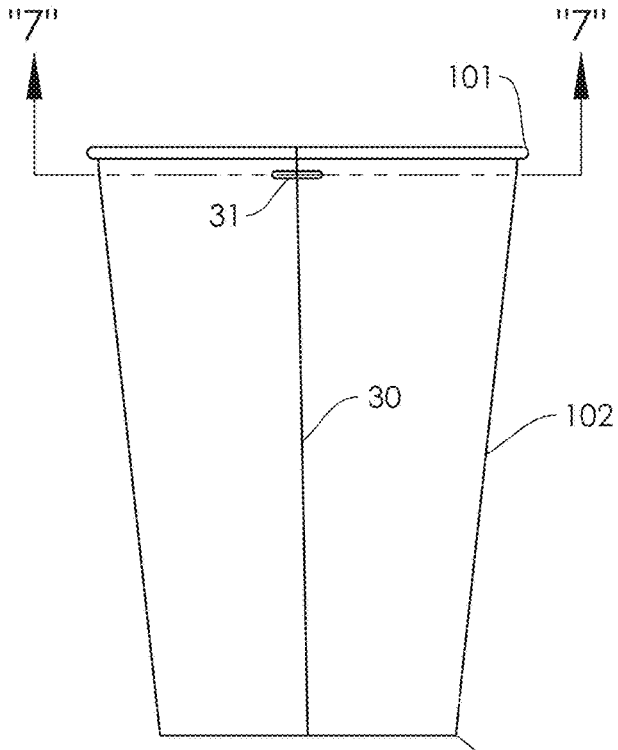
FIG. 6 is a side elevational view of a first seamed liquid container according to the present invention showing a seam and an external protuberance associated with an internal indentation formation which indentation formation traverses the seam.
Figure 9:
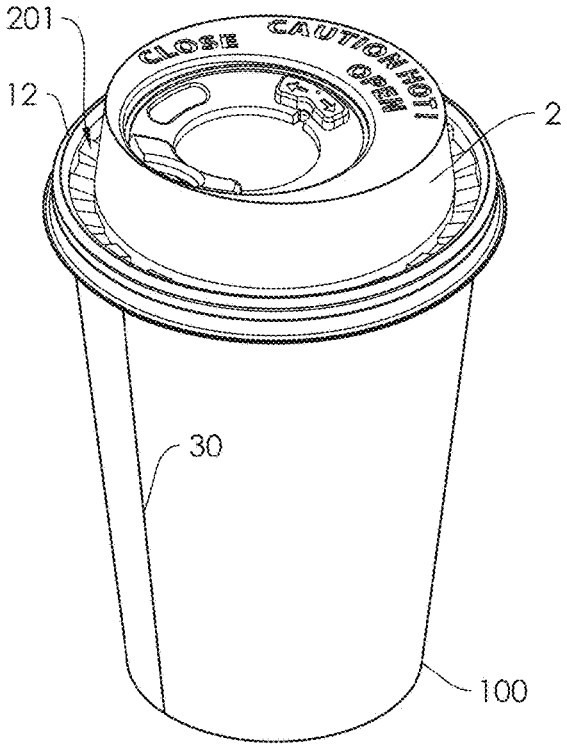
FIG. 9 is a top perspective view of the first seamed liquid container according to the present invention with a reclosable lid construction attached to an upper rim of the first seamed liquid container.
Figure 12:
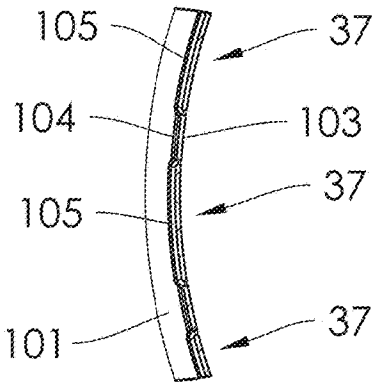
FIG. 12 is an enlarged, fragmentary sectional view as sectioned from FIG. 11 to show in greater detail structures associated with the series of indentation formations.
Figure 11:
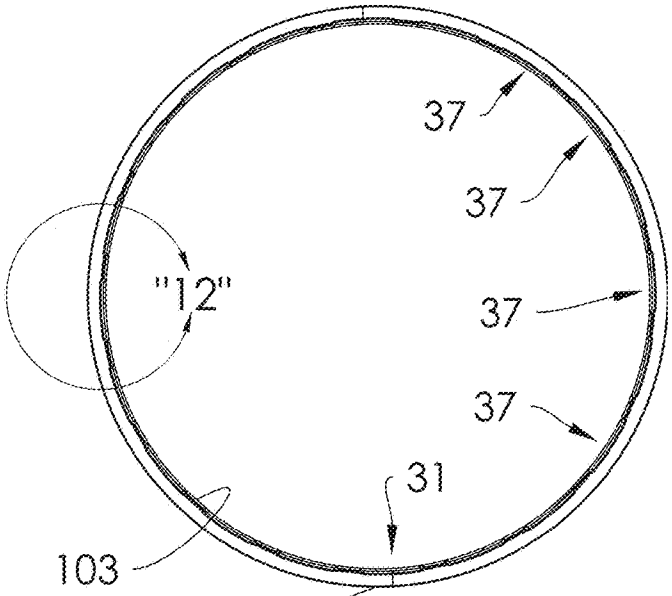
FIG. 11 is a transverse cross-sectional view as sectioned from FIG. 10 through the series of indentation formations.
Figure 10:
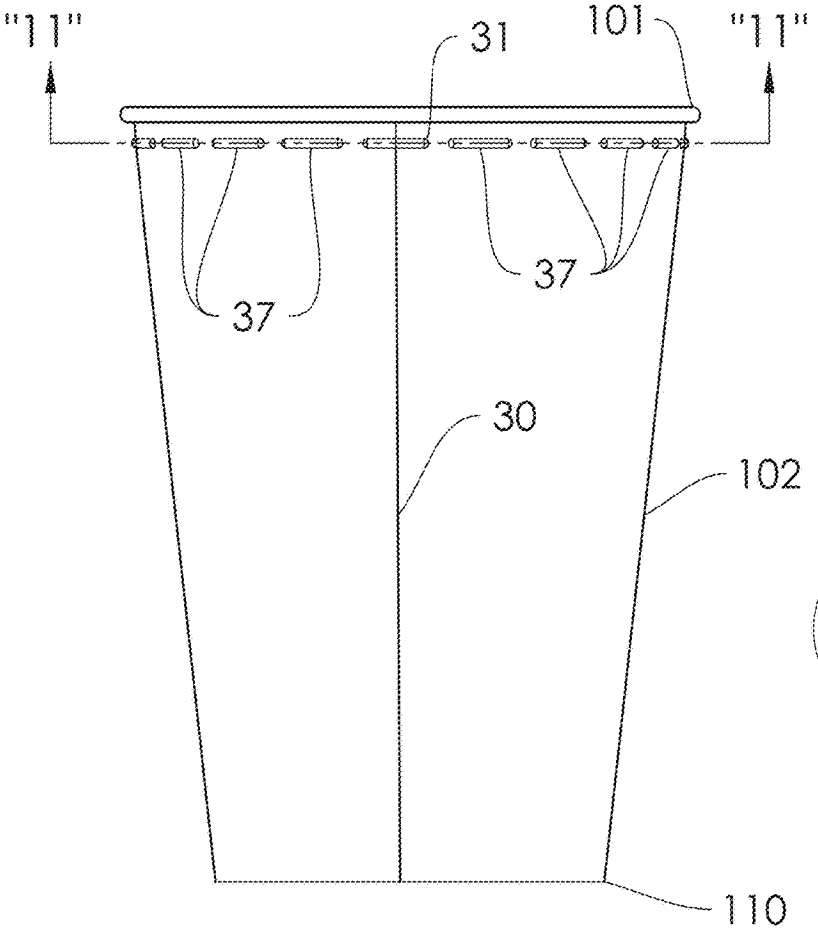
FIG. 10 is an enlarged side elevational vie of a second seamed liquid container according to the present invention showing a seam and a series of indentation formations, which series of indentation formations comprise a primary indentation formation traversing the seam and a series of secondary indentation formations radially extending in coplanar relation with the primary indentation formation.

Comparatively referencing FIGS. 4, 4A, and 5, the reader will there note the outer indentation-engaging portion 9 primarily comprises base portion 204, which base portion 204 is structurally offset in parallel from a span portion 199 by an outer extension section 198. Together the extension section 198, the base portion 204, and the upright portion 205 generally form a J-shape as highlighted in FIGS. 4A and 5A. The J-shape of the resilient portion 201 is connected to the pivot point 5 by way of the span portion 199.

The outer upright extension section 198 orthogonally connects the outer span section 199 to the lower base portion 204, and the lower base portion 204 orthogonally connects the outer upright extension section 198 to the inner upright portion 205. The outer span portion 199 and the lower base portion 204 extend inwardly from the inner groove wall 203; and the outer extension section 198 and the inner upright portion 205 extend substantially parallel to the inner groove wall 203 when the container lids are in a relaxed configuration before being actuated. Force may be directed into the container lids to actuate the container lids such that the outer span portion 199 becomes coplanar with the inner groove wall 203; the lower base portion 204 becomes parallel with the inner groove wall 203; the outer extension section 198 and the inner upright portion 205 extend inwardly relative to the inner groove wall 203 when the container lids are directed into the actuated configuration.

The lid wall 2 may further preferably comprise a lid wall indentation as at 4. The lid wall indentation 4 extends inwardly in superior adjacency to the wall-to-groove locking mechanism or resilient portion 201. The lid wall indentation 4 is connected to the upright portion 205 at a second pivot point 6. The lid wall indentation 4 provides a resilient structural relief for enhancing movement between the locked and unlocked configurations. The outer groove wall 202 further preferably comprises a groove wall indentation as at 206. The groove wall indentation 206 extends inwardly in inferior adjacency to the upper container rim 101 when outfitted thereupon for enhancing fitted engagement therewith.

Figure 18:
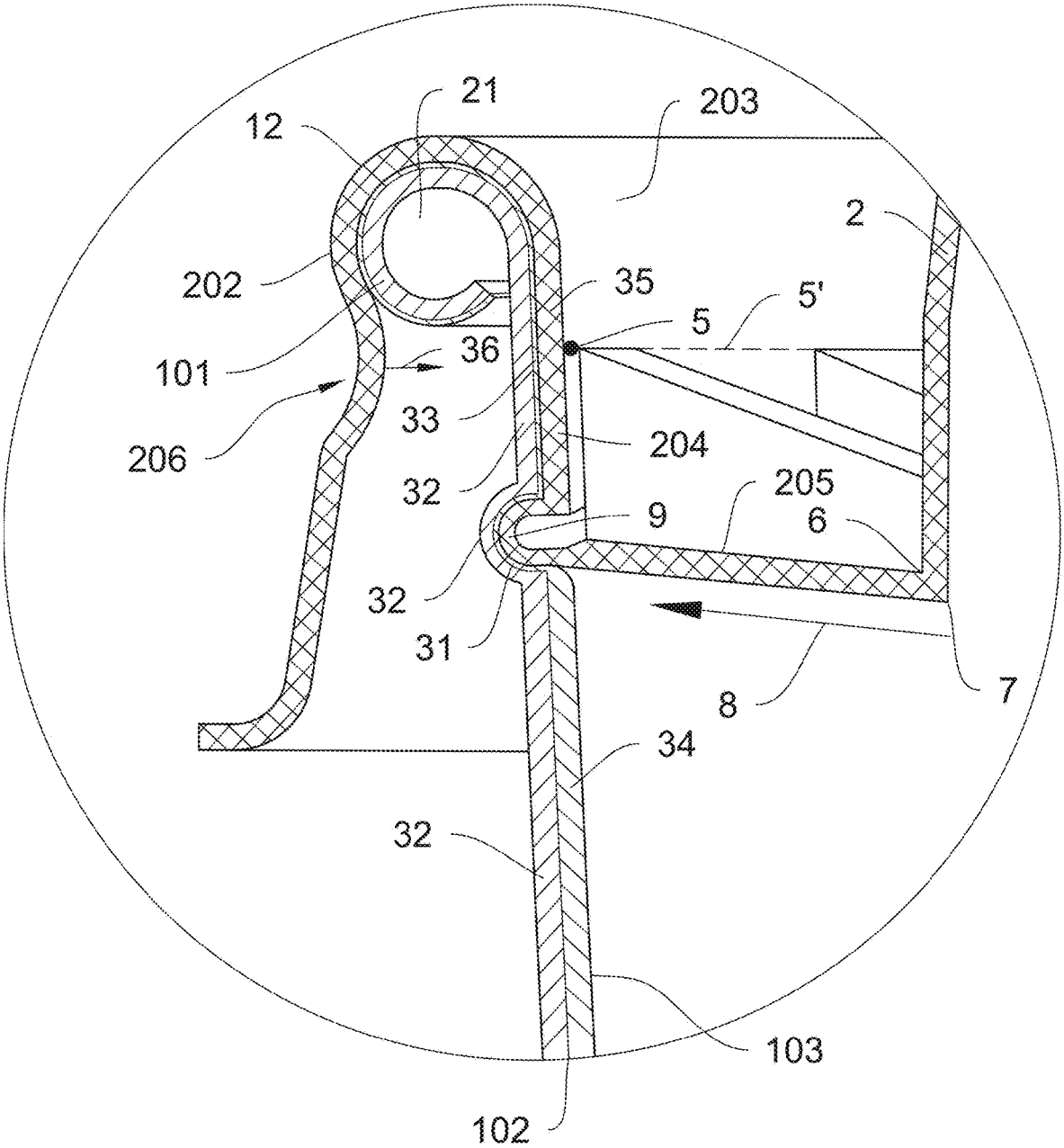
FIG. 18 is an enlarged, fragmentary sectional view as sectioned from FIG. 16 to show greater detail structures associated with the lid-to-container junction at the indentation site.
Figure 19:
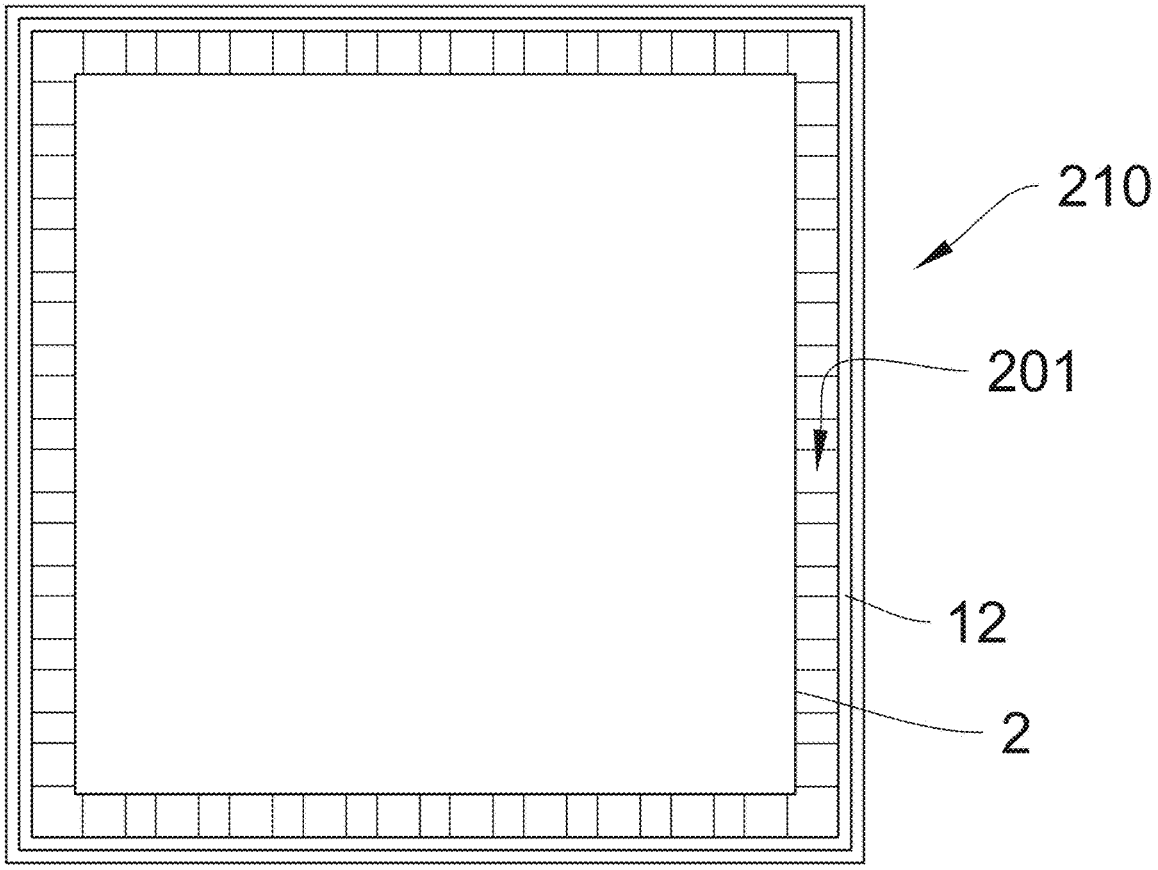
FIG. 19 is a top plan view of a first alternative lid construction according to the present invention showing a rectangular geometrical form for the lid construction outfitted with a locking mechanism according to the present invention.
Figure 36A:
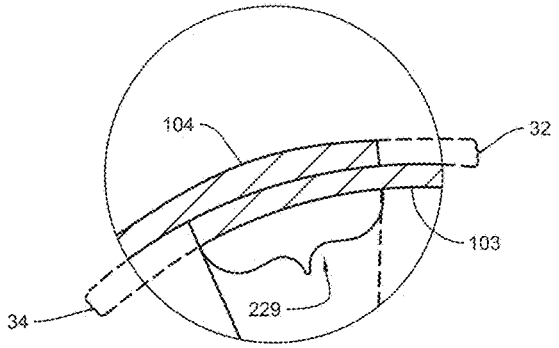
FIG. 36A is an enlarged, fragmentary diagrammatic depiction of the overlap junction creating an inner seam step at inner container surfacing and an outer seam step at outer container surfacing, the inner and outer seam steps having a uniform thickness.
Figure 37A:
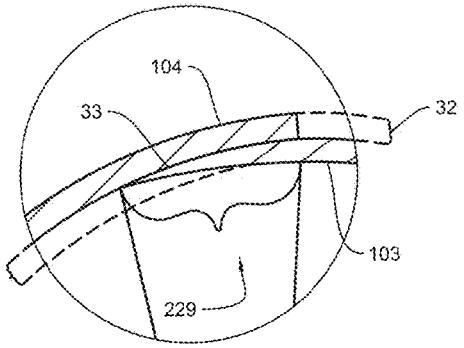
FIG. 37A is an enlarged, fragmentary diagrammatic depiction of the overlap junction creating an inner seam step at inner container surfacing and an outer seam step at outer container surfacing, the inner seam step being reduced in thickness as compared to the thickness of the outer seam step the reduced inner seam step thickness being due to the material-removed edging.
Figure 36:
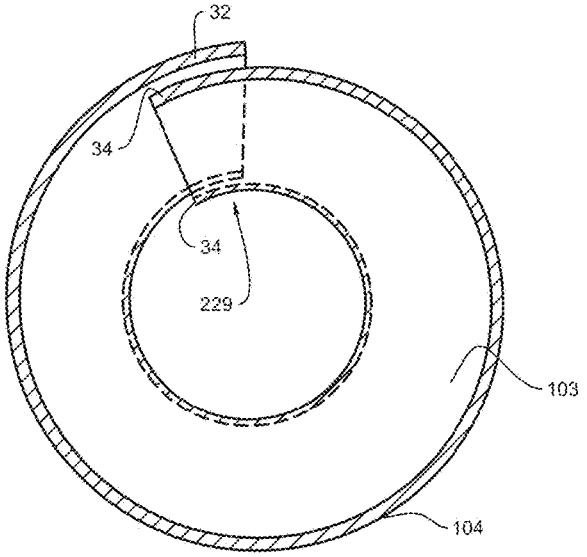
FIG. 36 is a top plan type view of a Prior Art paper cone element without material-removed edging, which edging faces the inner surfacing of the overlap junction site.
Figure 37:
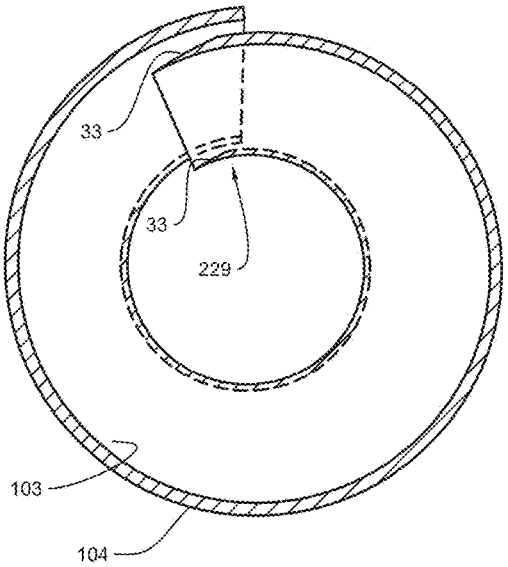
FIG. 37 is a top plan type view of a paper cone element according to the present invention with material-removed edging, which material-removed edging faces the inner surfacing of the overlap junction site.
Figure 35:
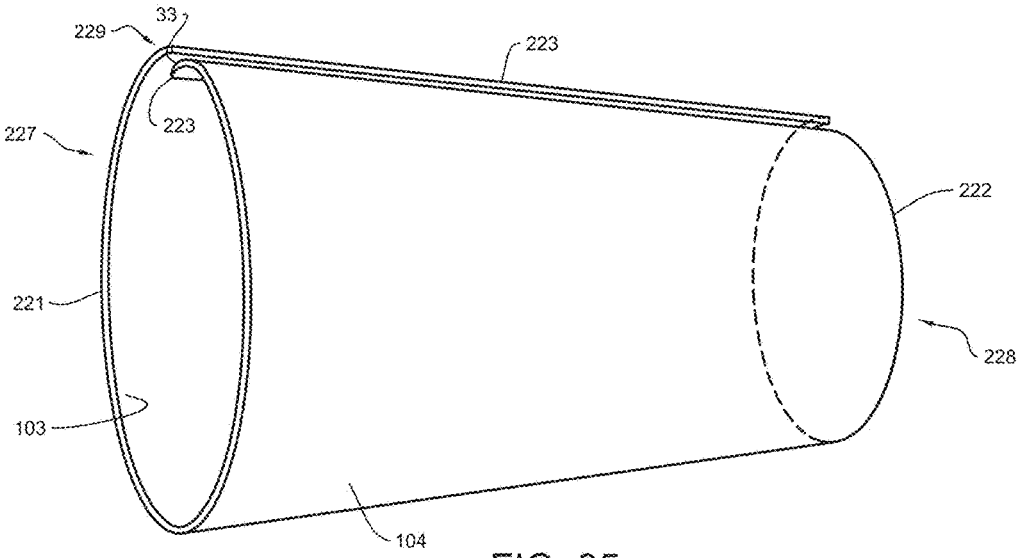
FIG. 35 is a perspective type view of a paper cone element with material-removed edging, which material-removed edging faces the inner surfacing of the overlap junction site.
Figures 38, 39, 40:
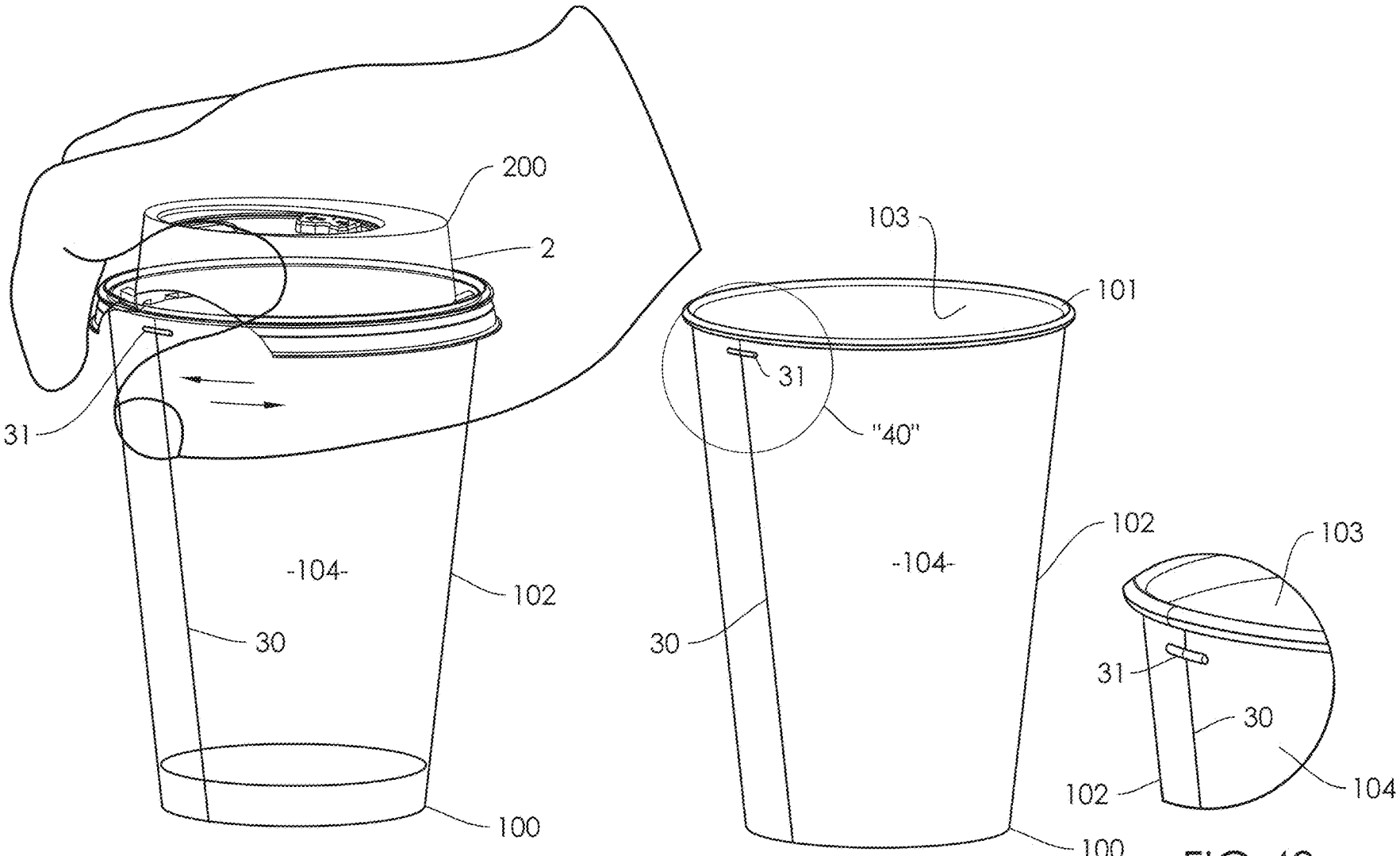
FIG. 38 is a first perspective type diagrammatic depiction of a user's hand rotating a lid construction according to the present invention clockwise or counter-clockwise so that an indentation-engaging portion formed on the lid construction will mate with the primary indentation formed on the container will.
FIG. 39 is a first perspective view of a seamed liquid container with a primary indentation traversing the seam site.
FIG. 40 is an enlarged, fragmentary sectional view as sectioned from FIG. 39 to show in greater detail the structures associated therewith.
Figure 42:
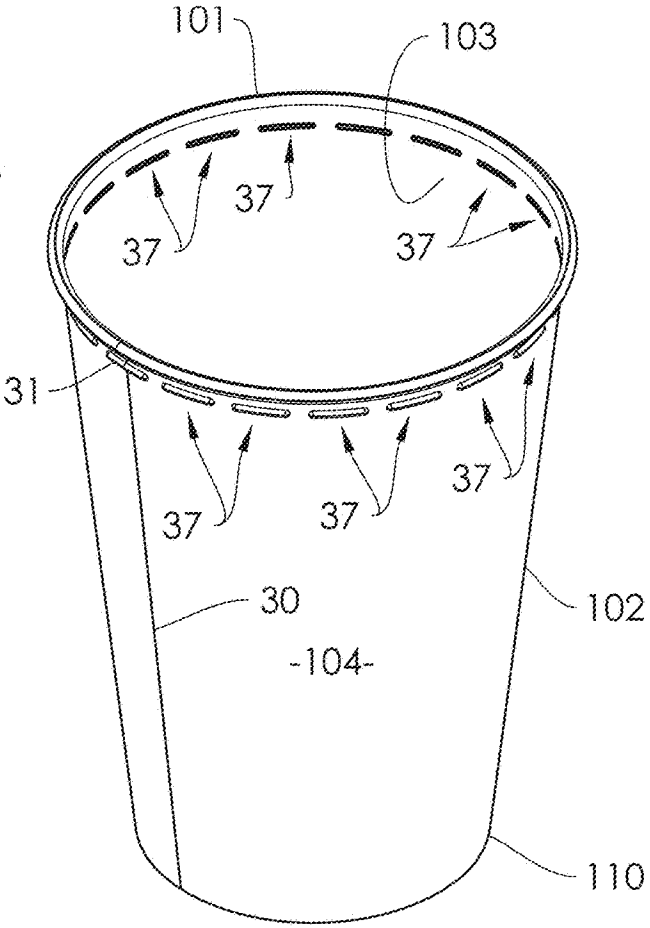
FIG. 42 is a second perspective view of a seamed liquid container with series of circumferentially aligned indentation formations with a primary indentation formation traversing the seam site.
Figure 41:
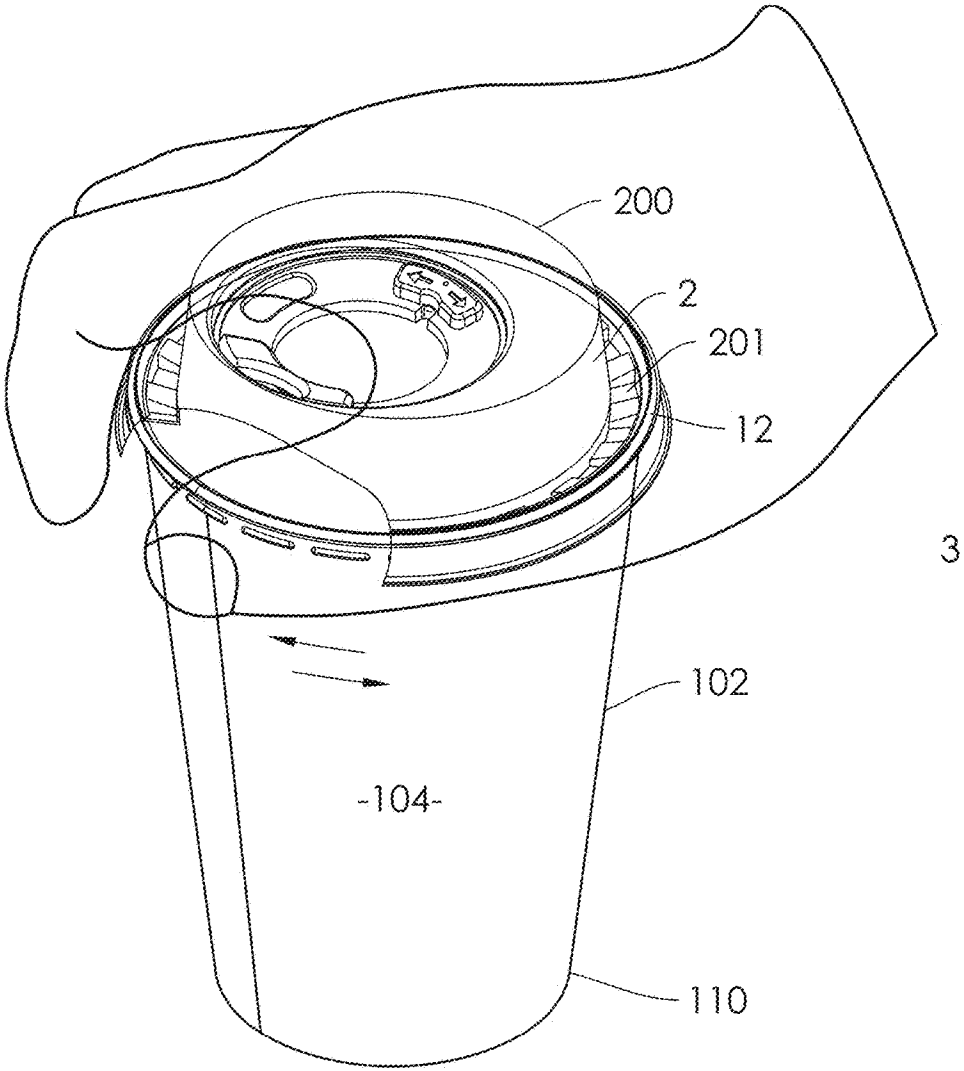
FIG. 41 is a second perspective type diagrammatic depiction of a user's hand rotating a lid construction according to the present invention clockwise or counter-clockwise so that a series of indentation-engaging portions formed on the lid construction will mate with a series of indentation formations formed on the container wall, including a primary indentation formation and a series of secondary indentation formations extending in coplanar relation relative to one another.
Figure 44:
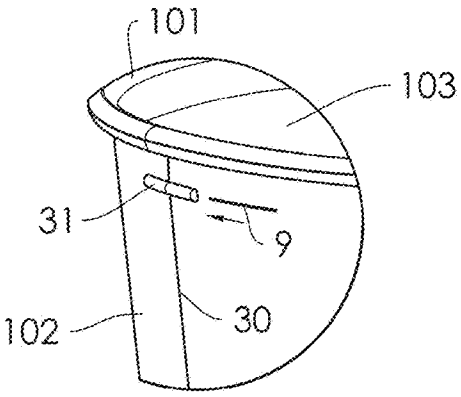
FIG. 44 is an enlarged, fragmentary sectional view showing a seam-traversing primary indention formation and a diagrammatic indentation-engaging formation being directed into positioned receipt within the primary indentation formation.
Figure 43:
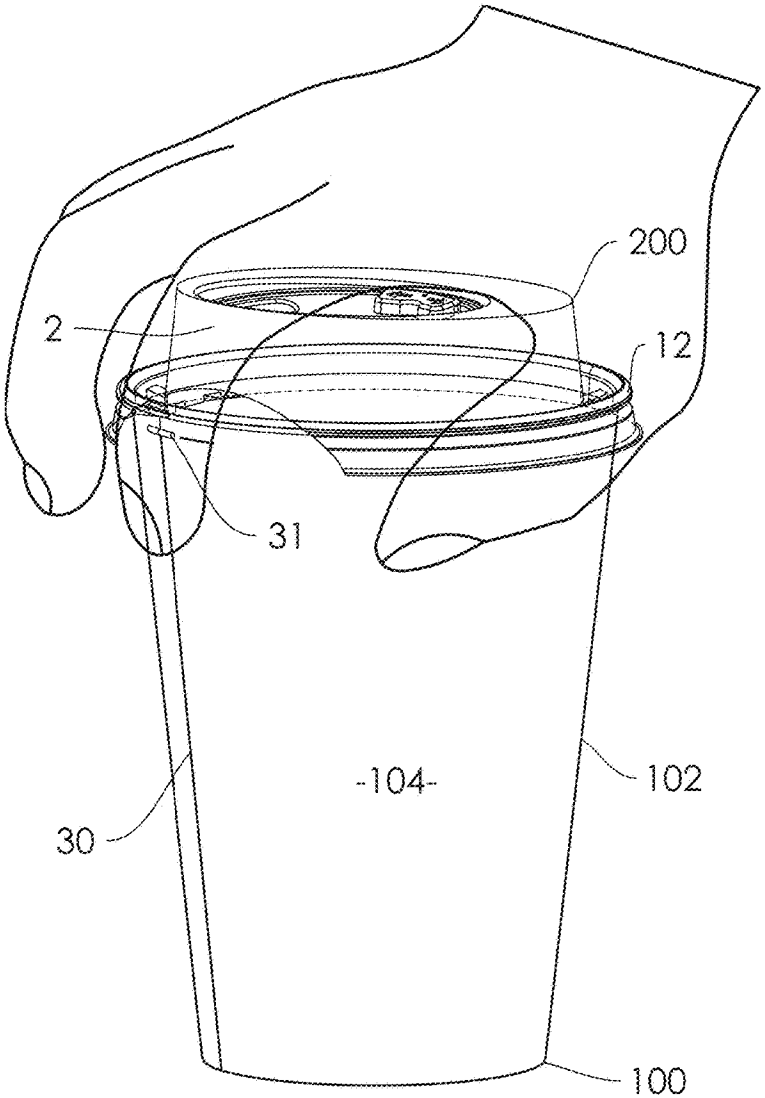
FIG. 43 is a third perspective type diagrammatic depiction of a user's hand rotating a lid construction according to the present invention clockwise so that an indentation-engaging portion formed on the lid construction will mate with the primary indentation formation formed on the container wall.

Referencing FIG. 18, the reader will there note that the upper container rim 101, formed from a lid-engaging ring 21, is coupled to a rim-receiving groove 12 of the lid construction 200. It is important to note that the thickness of the overlapping paper or material construction denoted at 32 at the paper seam above and below the indention formation 31 is the same thickness as the interior layer 34 below the indentation formation 31. The interior paper thickness 33 at and above the indention formation 31 is relatively thinner as compared to the thickness at 34 and 32. See also FIG. 28A where thickness 140 is less than thickness 141. In this regard, the paper thickness has been reduced by either pressing the material or removing material (e.g. shaved/sanded down (from the non-exposed back side to preserve protective layer on of the paper) to limit size of the step in order to create smoother surface at the interior line of the paper seam joint as generally and comparatively depicted in FIG. 36A (depicting an unprocessed material thickness) versus FIG. 37A (depicting a processed material thickness).

The back side 35 as at inner groove wall 203 of the rim-receiving groove 12 of the lid construction 200 tightly or snugly engages surface of the interior layer 33 above the indention formation 31. The same tight or snug engagement occurs at the indention formation 31 at the indentation-engaging portion 9 under constant pressure as at force vector 8. FIG. 18 further depicts in greater detail a pivot point 5, where reference 5' is a plane extending through space and defined by a multitude of pivot points 5 formed circumferentially about the periphery of the lid construction 200. Internal resistance point 7 and moving point 6 are further referenced and depict the lid construction 200 in an engaged configuration. Vector arrow 36 depicts pressure directed radially inwardly at the side of a radial indention 206 formed in the outer groove wall 202 of the rim-receiving groove 12.

Figure 45:
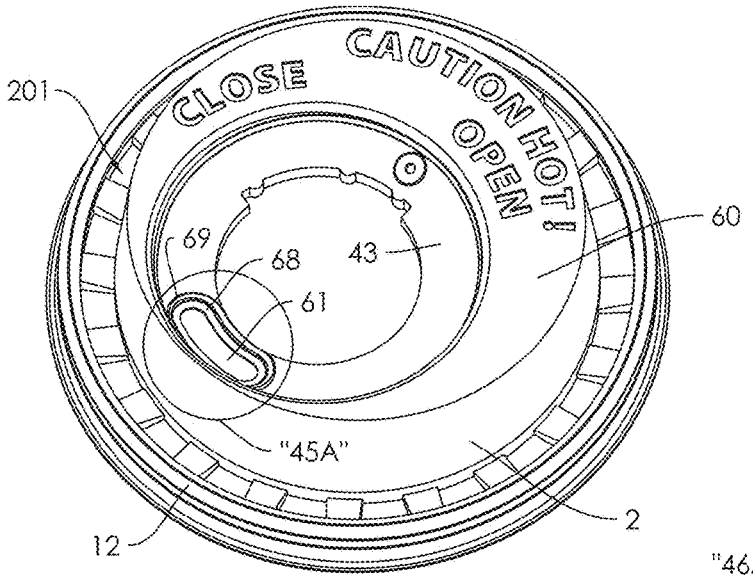
FIG. 45 is a top perspective view of a first alternative lid body or lower lid construction according to the present invention cooperable with the alternative disc body or upper lid construction otherwise depicted in FIG. 46.
Figure 46:
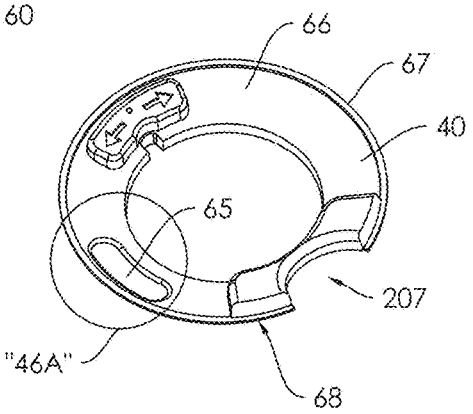
FIG. 46 is a top perspective e of a first alternative disk body or upper lid construction according to the present invention cooperable with the alternative lid body or lower lid construction according to the present invention and otherwise depicted in FIG. 45.
Figure 45A:
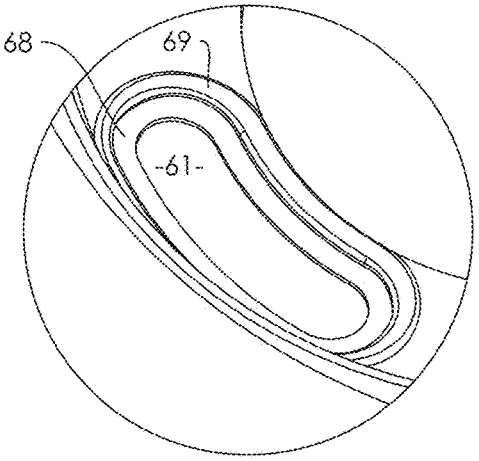
FIG. 45A is an enlarged, fragmentary sectional depiction of a liquid outlet formed in the lower lid construction as enlarged and sectioned from FIG. 45 to depict in greater detail the liquid outlet characterized by being formed in a lower lid indentation and surrounded by a raised ridge.
Figure 46A:
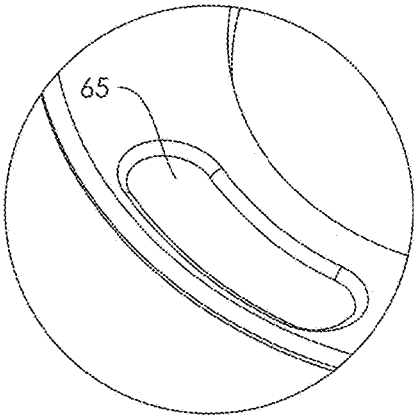
FIG. 46A is an enlarged, fragmentary sectional depiction of an outlet-covering indentation formed in the upper lid construction as enlarged and sectioned from FIG. 46 to depict in greater detail the outlet-covering indentation characterized by having a planar portion greater in area than the liquid outlet for covering the same with a periphery of a reduced dimension relative to the raised ridge so as to form a circumferential air pocket between the raised ridge and the outlet-covering indentation.
Figure 49:
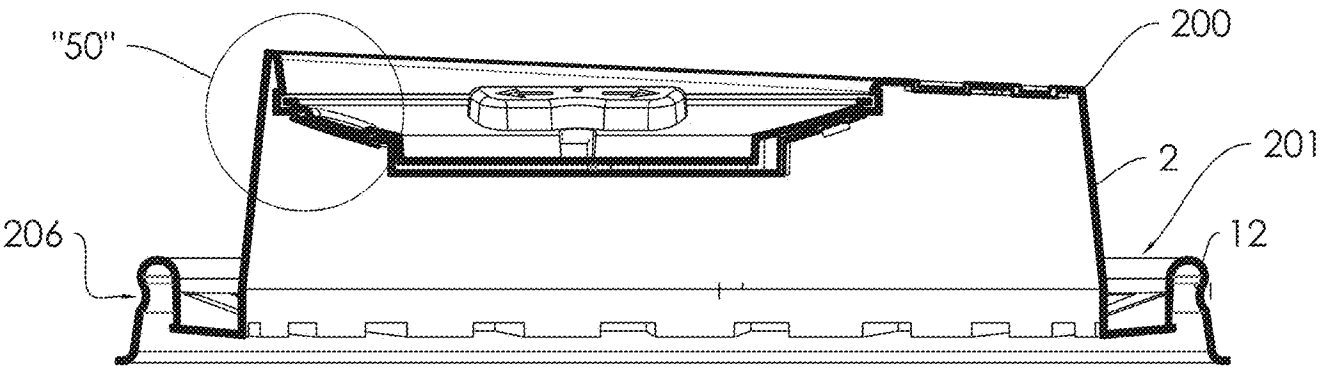
FIG. 49 is a longitudinal cross-sectional view as sectioned from FIG. 48 to show with greater clarity the structural relationship between the first alternative lid body or lower lid construction and disk body or upper lid construction.
Figure 48:
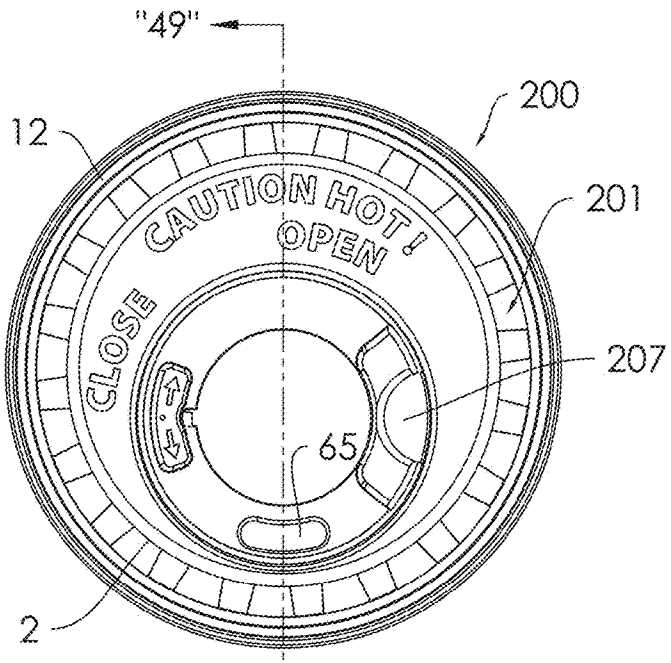
FIG. 48 is a top plan view of the first alternative lid construction according to the present invention comprising the lid body and disk body otherwise depicted in FIGS. 45 and 46 in assembled relation with one another and showing the ensemble in a closed lid configuration.
Figure 47:
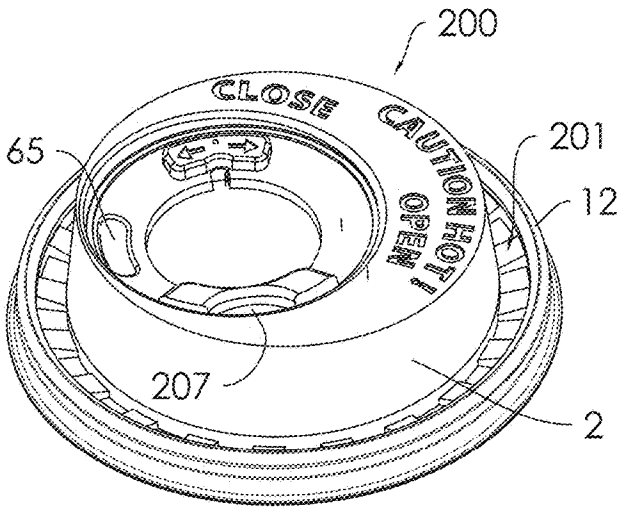
FIG. 47 is a top perspective view of the first alternative lid construction according to the present invention comprising the lid body and disk body otherwise depicted in FIGS. 45 and 46 in assembled relation with one another and showing the ensemble in a closed lid configuration.

Referencing FIGS. 45 and 46, the reader will there consider that the container lid 200 may preferably comprise a lower lid construction 60 and an upper lid construction 66. The upper lid construction 66 is seatable atop or receivable in the lower lid construction 60 and movable or rotatable relative thereto. The lower lid construction 60 preferably comprises a lower lid outlet as at 61 and the upper lid construction 66 preferably comprises an outlet-covering indentation as at 65 and an upper lid outlet as at 207. The outlet-covering indentation 65 is positionable over the lower lid outlet 61 for selectively preventing liquid egress therefrom. The main lid body or lower lid construction 60 thus receives the disk body or upper lid construction 66, which disk body 66 comprises an upper outer edge 67 and a lower outer edge 69. An elliptical part 40 of the disk body 66 and the indention 65 of the disk body 66 fit into the indention at the elliptical depression 43 in the main lid body 60. The elliptical depression 43 receives the elliptical part 40 of the disk body 66.

Figure 50:
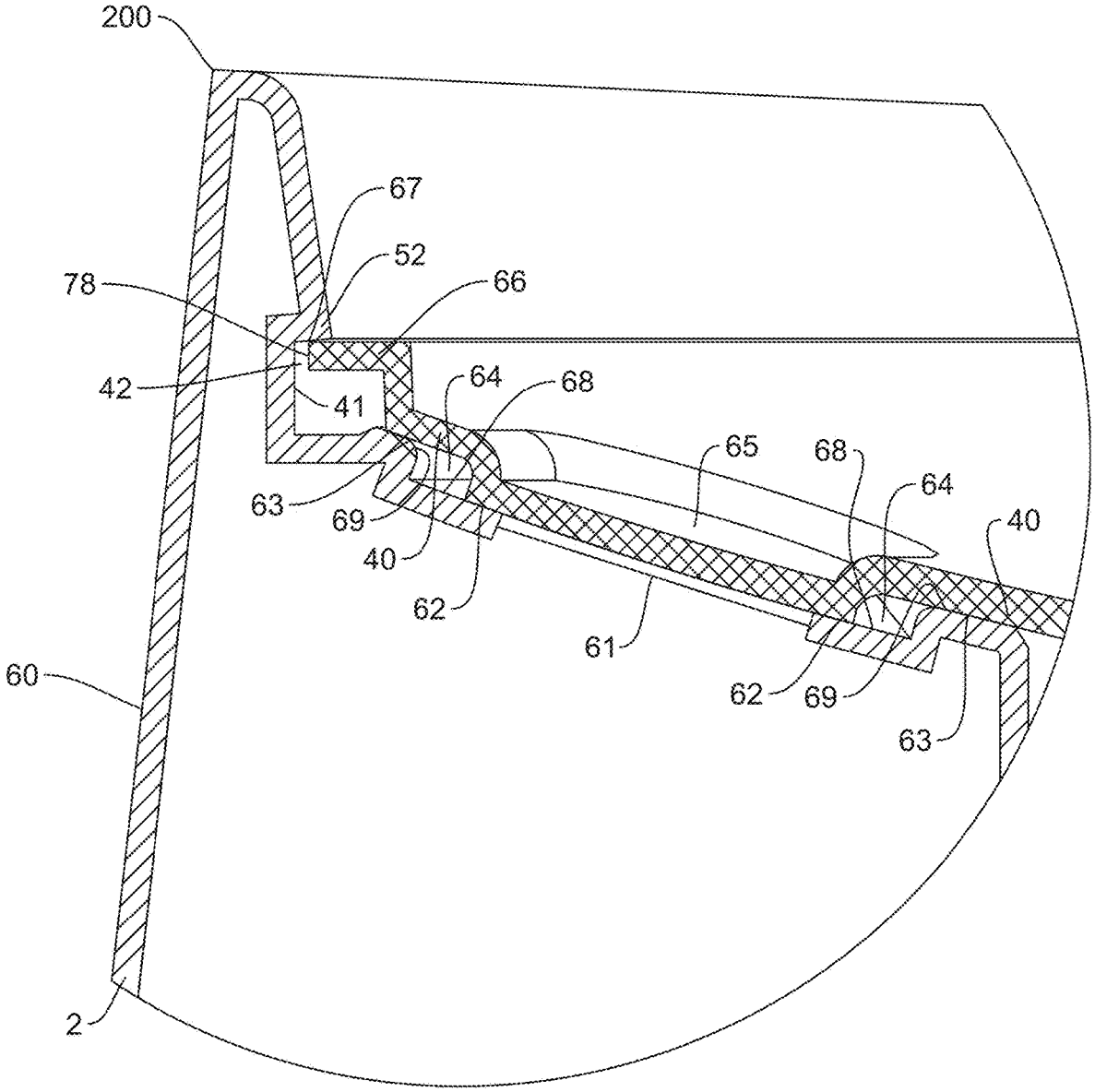
FIG. 50 is an enlarged, fragmentary sectional view as enlarged and sectioned from FIG. 49 to show in greater clarity the structures associated therewith.
Figure 51:
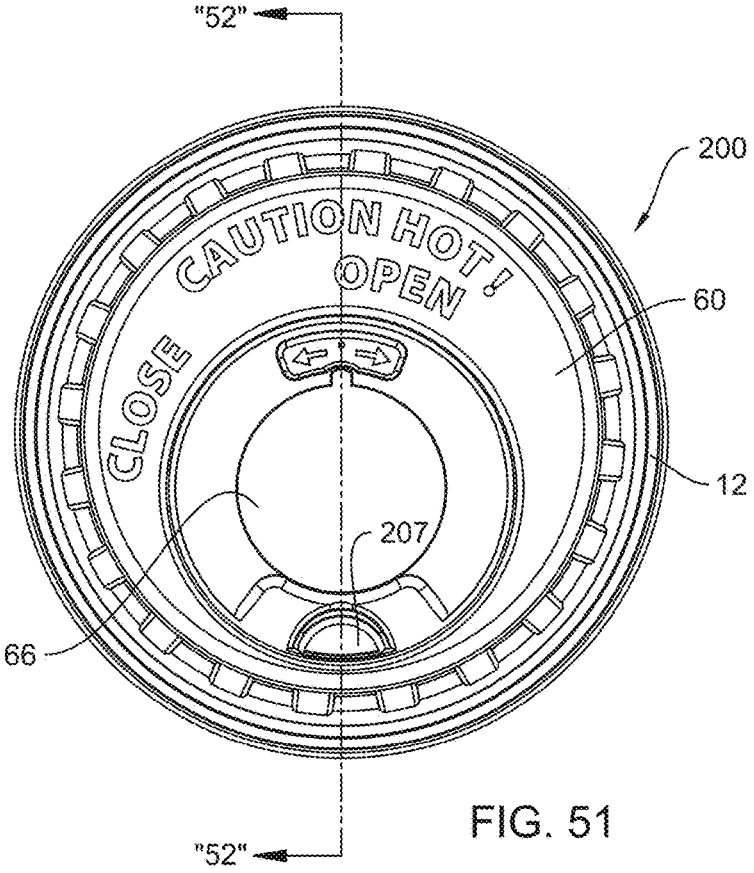
FIG. 51 is a top plan view of the first alternative lid construction according to the present invention showing the ensemble in an open lid configuration.
Figure 52:
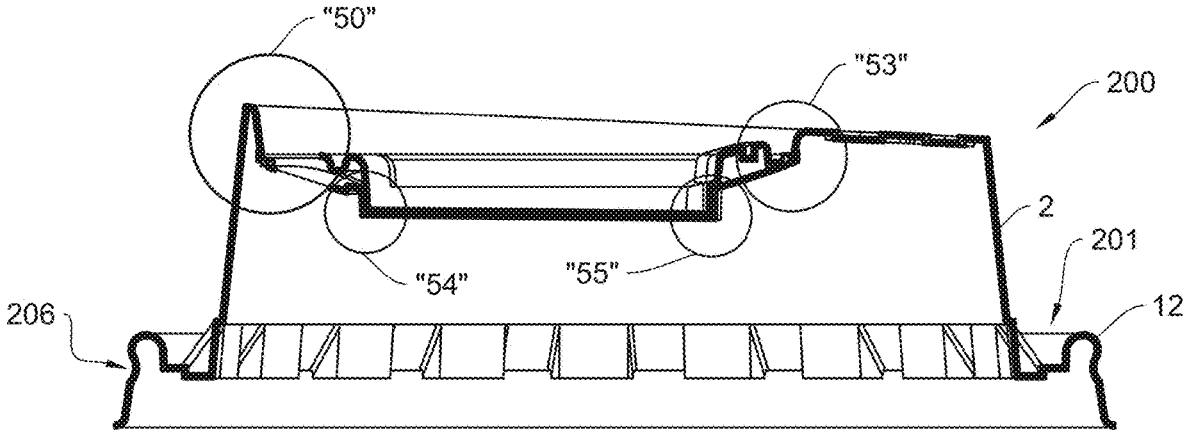
FIG. 52 is a longitudinal cross-sectional view as sectioned from FIG. 51 to show with greater clarity the structural relationship between the first alternative lid body or lower lid construction and disk body or upper lid construction.
Figure 53A:
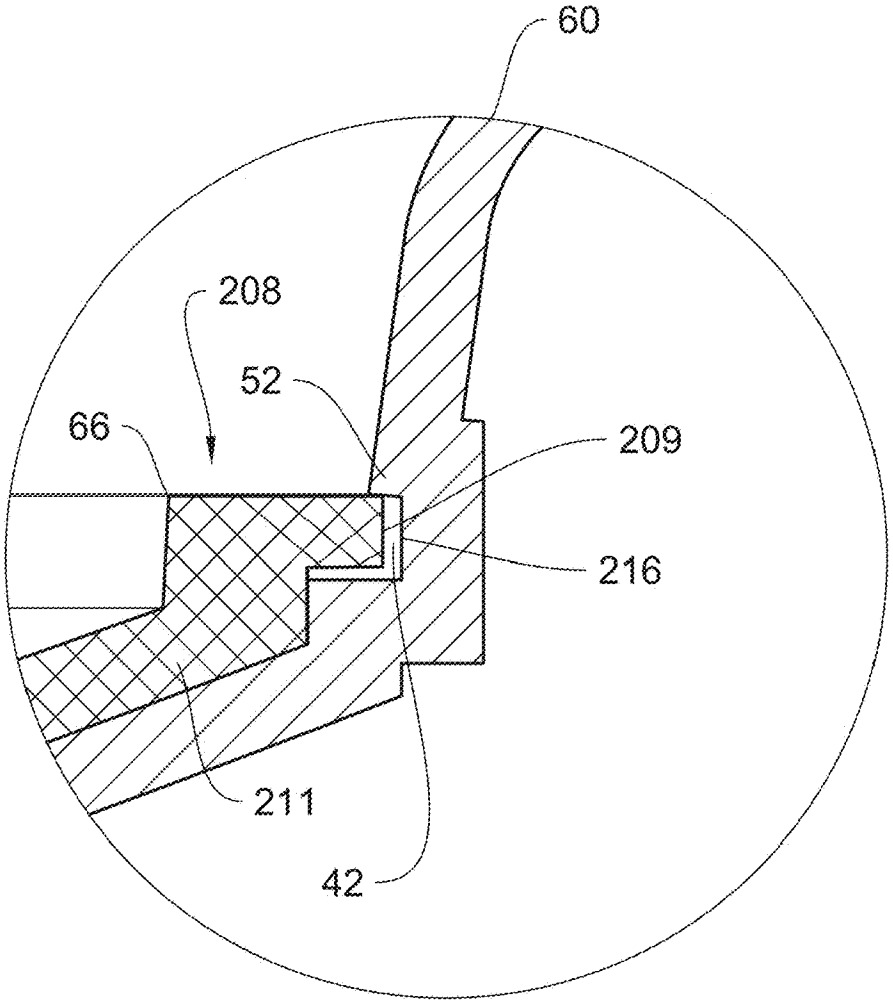
FIG. 53A is a further enlarged, fragmentary sectional view as enlarged and sectioned from FIG. 53 to show in greater clarity the structures associated therewith.
Figure 53:
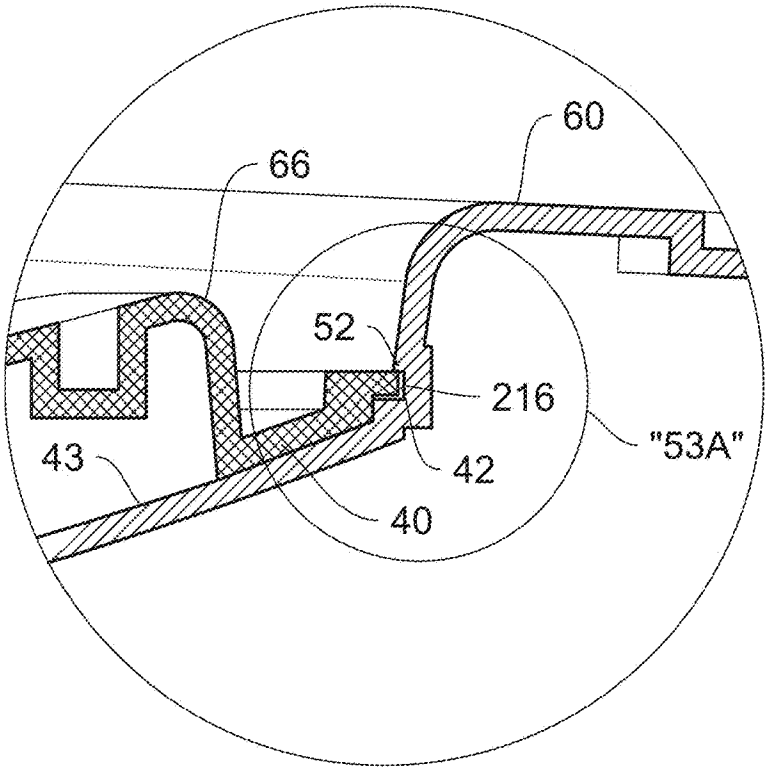
FIG. 53 is an enlarged, fragmentary sectional view as enlarged and sectioned from FIG. 52 to show in greater clarity the structures associated therewith.
Figure 59:
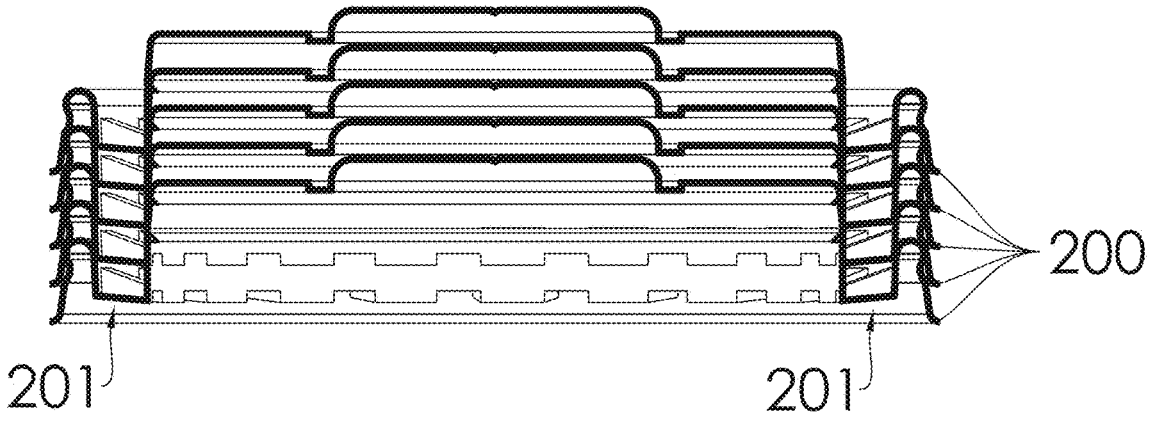
FIG. 59 is a first longitudinal cross-sectional view as sectioned from FIG. 58 to show in greater detail the series of stacked container lids according to the present invention, which container lids are each individually configured into an unlocked configuration for reduction in stacking height.

Referencing FIG. 50, the reader will there consider the certain mechanical details relating to the substantially tight or snug engagement between the disk body or upper lid construction 66 and the undercut edge-receiving groove as at 52. The primary or main opening of the lower lid construction is referenced at 61. A tight or snug fit as at points 62 exists between the indention 65 on the disk body 66 and the indention 68 around the main opening 61 on the depressed part of the main lid body 60. A tight or snug fit as at points 63 is also placed between ridge 69 and structure adjacent indention 65 and the elliptical part of the disk body 66. Tightly fit planes as at 62 and 63 create air pocket(s) as at 64, which air pocket(s) 64 and tight engagements make it more difficult for liquid to egress therethrough.

The upper outer edge 67 of the disk body or upper lid construction 66 tightly fits against the upper side of the circular groove 52 at the same time there is some very small space 42 between outer edge 78 of the disk body 66 and the inner edge 41 of the groove 52. This arrangement limits friction between outer edge 78 of the disk body 66 and the inner edge 41 of the groove 52. The groove 52 functions as guide for the disk body 66 to hold the disk body 66 in place. The liquid seal is achieved mostly through the tight or snug fit between the elliptical part 40 of the disk body and the ridge 69 around the indention 68. Air pocket(s) 64 and indention 65 on the disk body 66 create additional liquid seals.

It will thus be understood that the primary lower lid outlet 61 is preferably formed within a lower lid indentation as at 68 and surrounded in spaced relation by a raised ridge as at 69. The outlet-covering indentation 65 of the upper lid construction 66 is preferably smaller in dimension than the lower lid indentation 68 (and larger in dimension than the lower lid outlet 61) such that a circumferential air pocket 64 extends between the lower lid indentation 68 and the outlet-covering indentation 65 when the outlet-covering indentation 65 covers the lower lid outlet 61. The circumferential air pocket 64, in combination with the tight or snug fit between adjoining structures, prevents liquid egress from the lower lid outlet 61.

Referencing fragmentary, enlarged FIGS. 53, 53A, 56, 57A, and 57B, the reader will there consider a so-called "step down formation" as at 208 of the upper lid construction 66 and associated features. The step down formation 208 is essentially L-shaped in vertically transverse cross-section and has an upper groove-engaging formation 209 extending in a first plane for insertion in edge-receiving groove 52, and a lower-spacing portion as at 211 extending in a second plane orthogonal to the first plane for spacing the lower portion 212 with lower surfacing 213 from the first plane of the groove-engaging formation 209.

The step-down formation 208 effectively creates additional pressure between the lower surfacing 213 and the upper surfacing 214 of the lower lid construction 60 when the upper lid construction 66 is received in the insert-receiving formation 43. A downward force is referenced at 121 with a normal force 122 indicating the enhanced pressure effect at the surfacing interface as at arcuate line 215. At the same time, the step down formation 208 directs radially outwardly directed pressure or forces as at 123 with an opposing normal force 124 from the resilient return of the resiliently actuated upper lid construction 66 into the element-receiving groove 52 for enhancing periodic contact pressure between the upper lid construction 66 and the groove 52 at the edge-to-groove interface as at line 216. Thus, the interface 215 and the edge-to-groove interface 216 simultaneously provide leak proof sealing mechanisms orthogonally relative to one another as opposed to the DIXIE® brand "Smart Top Reclosable Hot Cup Lid".

It will thus be understood that the upper lid construction 66 further preferably comprises an edge-located step-down formation as at 208, which step down formation 208 is received in an edge-receiving groove 52 formed in the lower lid construction 60. The step-down formation 208 enhances seated engagement between the upper and lower lid constructions 66 and 60. The upper lid construction 66 is peripherally sized so as to form an air space 42, L-shaped in transverse cross-section, radially and outwardly adjacent the step-down formation 208 when relaxed and received in the edge-receiving groove 52. The air space 42 reduces friction between the upper and lower lid constructions 66 and 60 when in a relaxed state.

Referring now to FIGS. 20-21C, the reader will there consider a preferred package assembly 300 according to the present invention. For ease of understanding, a modified version of the lid construction 210 is there depicted and referenced at 210' in view of the modification as forming part of the package assembly 300 and as used in combination with a packaging box as at 120. In this regard, lid construction 210' is preferably integrally formed with and pivotally attached to the packaging box 120 so as to provide a clamshell container or package with a living hinge area or mechanism as at 127.

The packaging box 120 portion of the package assembly 300 is basically a first (or lower) package body having a static internal volume as at 155 with a package body rim as at 101'. The packaging box 120 may thus be referred to as a static package body. The actuable lid construction 210' as preferably integrally formed with and pivotally attached to the packaging box 120 via the hinge mechanism 127 provides an adjustable/collapsible packaging assembly 300 whereby the (internal) package assembly volume of the ensemble can be adjusted as necessary by the user by actuating the second (or upper) dynamic package body exemplified by lid construction 210'.

Figure 20A:
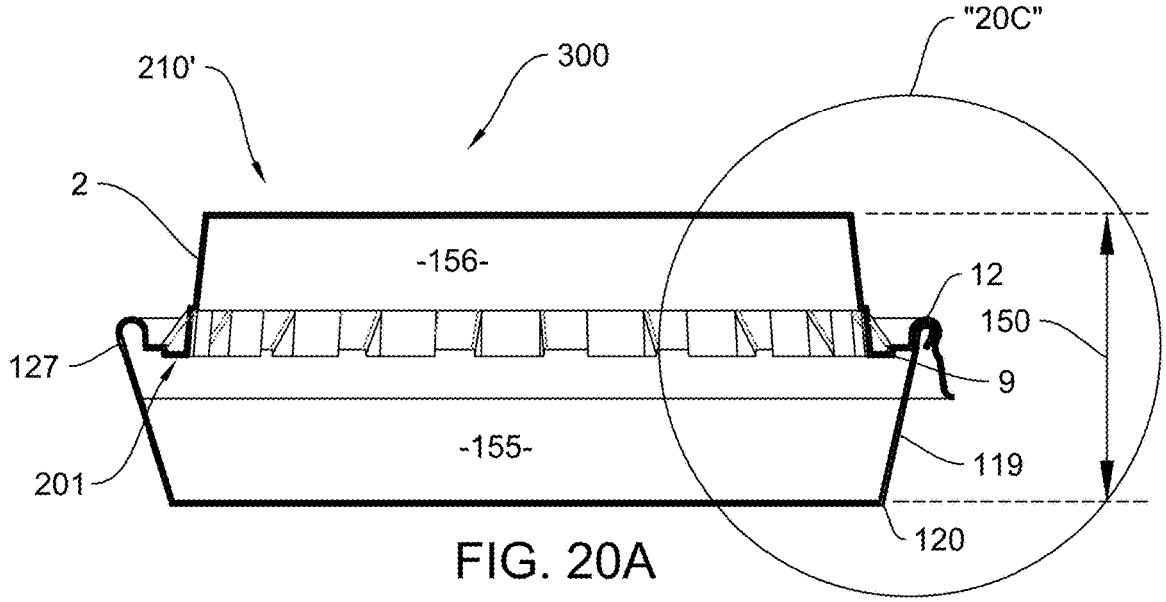
FIG. 20A is a longitudinal cross-sectional view of a preferred packaging assembly according to the present invention incorporating a modified version of the first alternative lid construction otherwise exemplifying a dynamic package body in a pre-compressed, un-engaged, unlocked configuration as assembled with a generic packaging box thereby defining an internal pre-compressed maximized package assembly volume.
Figure 21A:
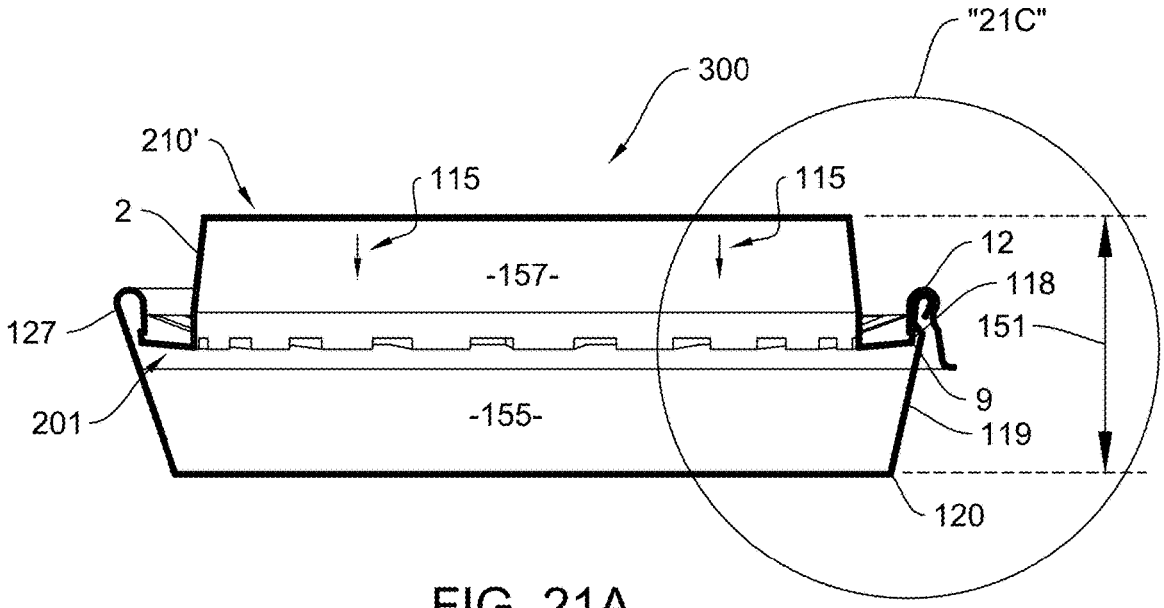
FIG. 21A is a longitudinal cross-sectional view of the preferred packaging assembly according to the present invention showing the dynamic package body in a compressed, engaged, locked configuration as assembled with a generic packaging box thereby defining an internal compressed, minimized package assembly volume.
Figure 20B:
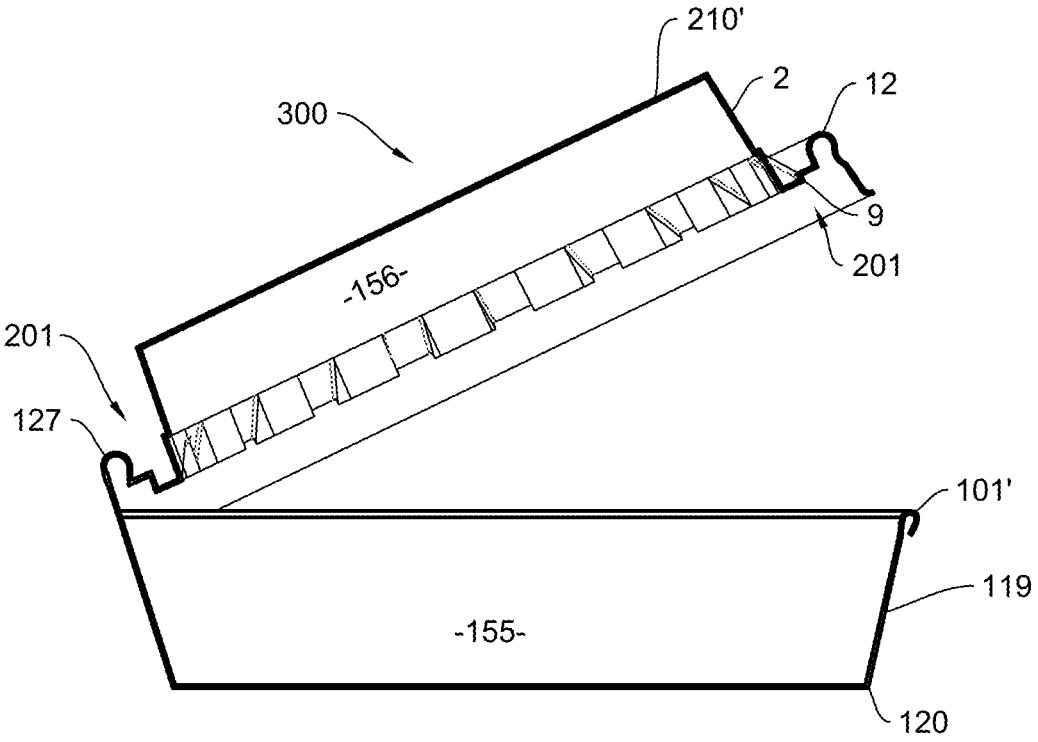
FIG. 20B is a longitudinal cross-sectional view of the preferred packaging assembly according to the present invention showing the dynamic package body in a pre-compressed, un-engaged, unlocked configuration as pivoted to an open configuration relative to the generic packaging box integrally formed therewith.
Figure 21B:
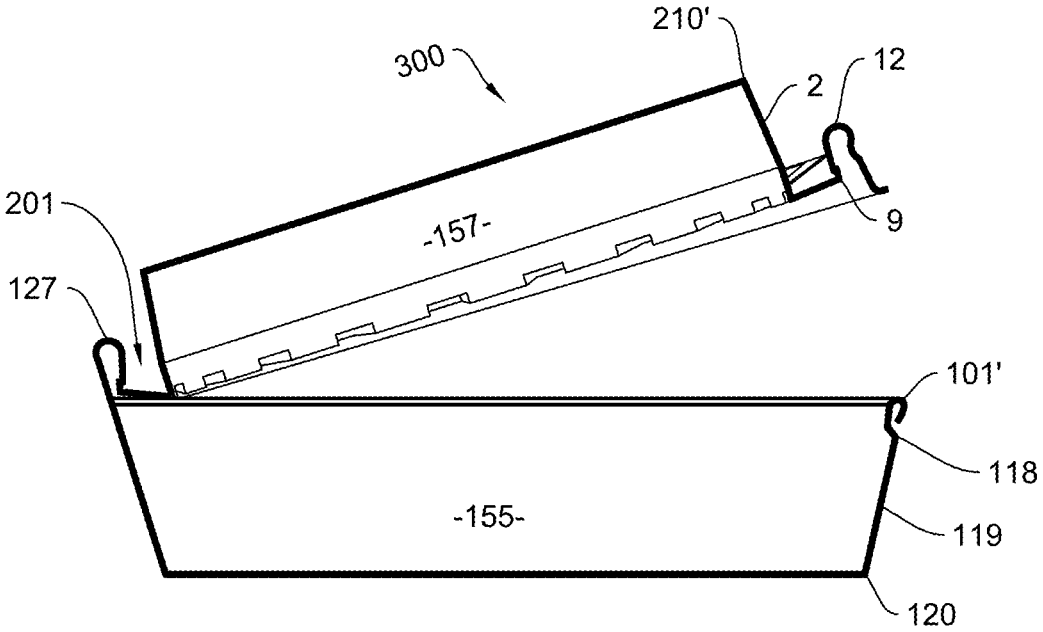
FIG. 21B is a longitudinal cross-sectional view of the preferred packaging assembly according to the present invention showing the dynamic package body in a compressed, engaging, locking configuration as pivoted to an open configuration relative to the generic packaging box integrally formed therewith.
Figure 20E:
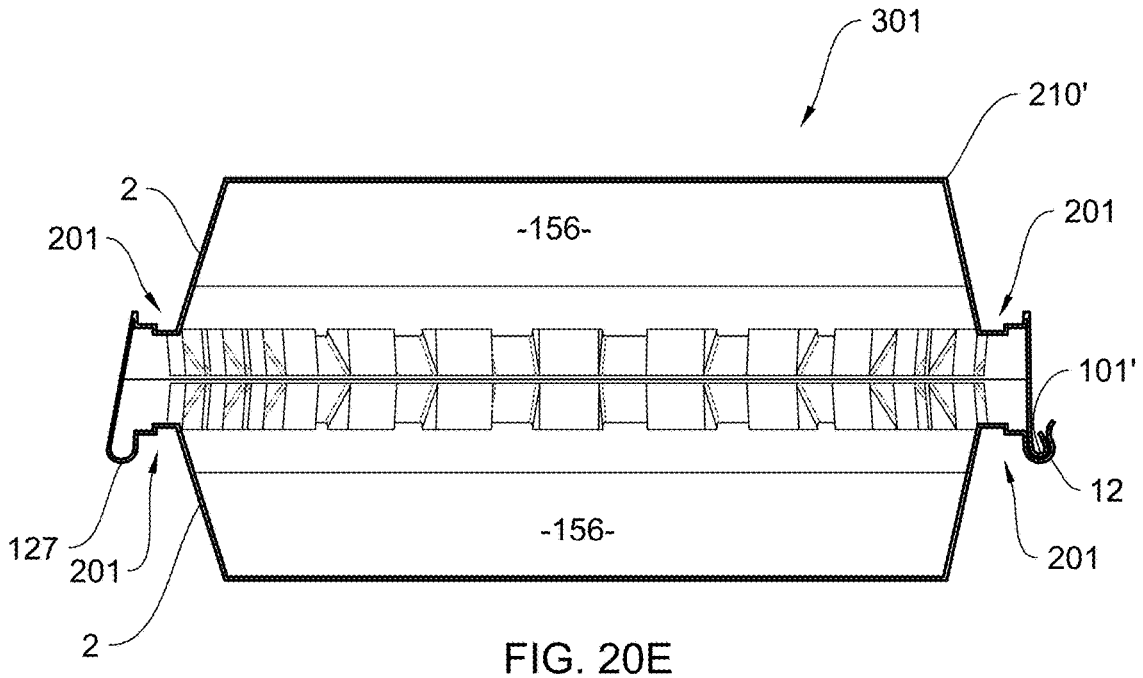
FIG. 20E is a longitudinal cross-sectional view of a first alternative packaging assembly according to the present invention showing upper and lower dynamic package bodies both in a pre-compressed, un-engaged, unlocked configuration for maximizing package assembly volume.
Figure 21E:
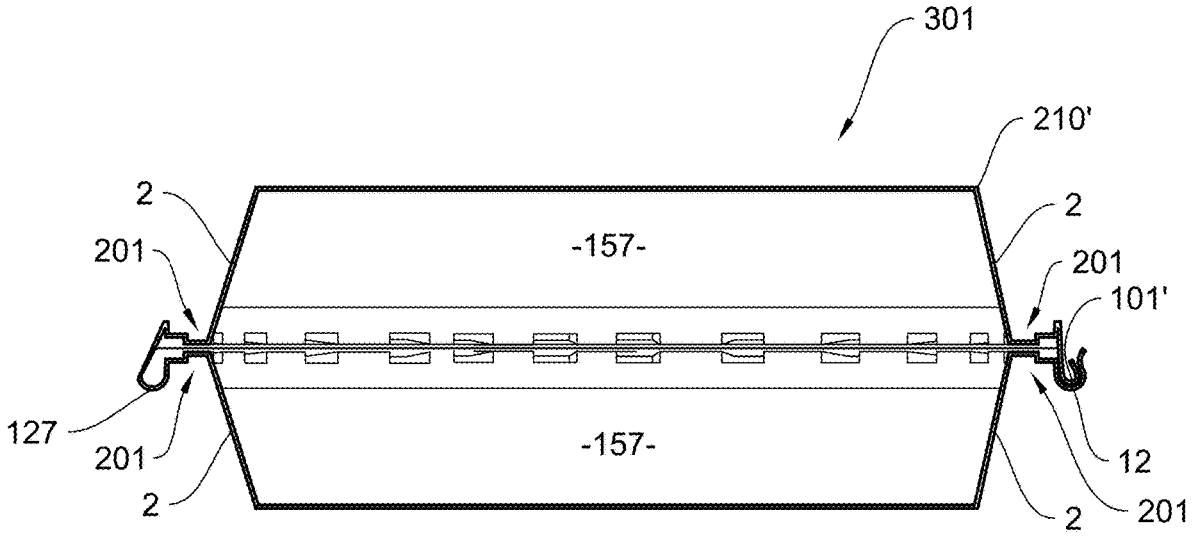
FIG. 21E is a longitudinal cross-sectional view of the first alternative packaging assembly according to the present invention showing the upper and lower dynamic package bodies both in a compressed, engaging, locking configuration for minimizing package assembly volume.
Figures 22, 23:
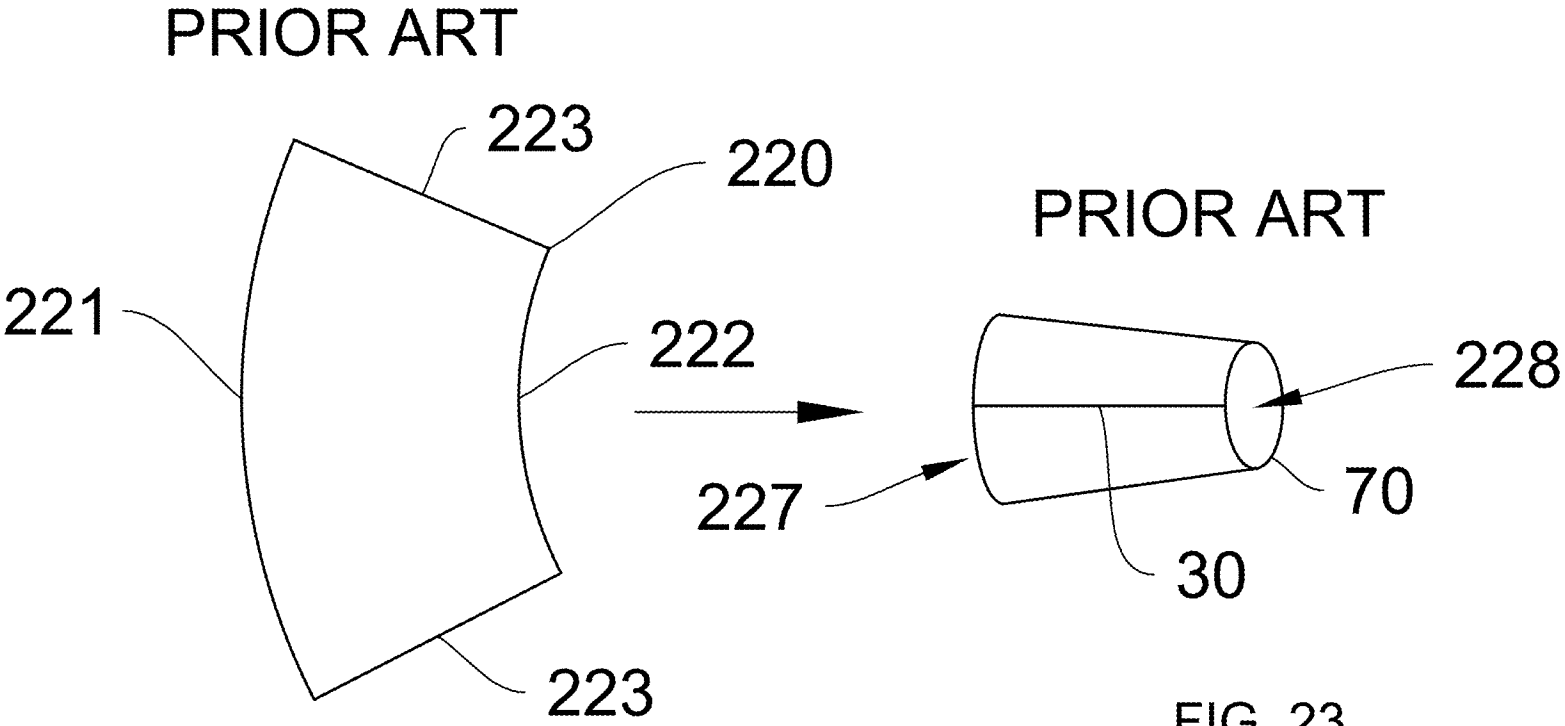
FIG. 22 is a plan depiction of a two-dimensional Prior Art cup fan or template for forming a paper cone element or seamed container sidewall otherwise shown in FIG. 23.
FIG. 23 is a perspective depiction of a three-dimensional Prior Art paper cone element or seamed container sidewall formed from the cup fan or template otherwise shown in FIG. 22.
Figure 24:
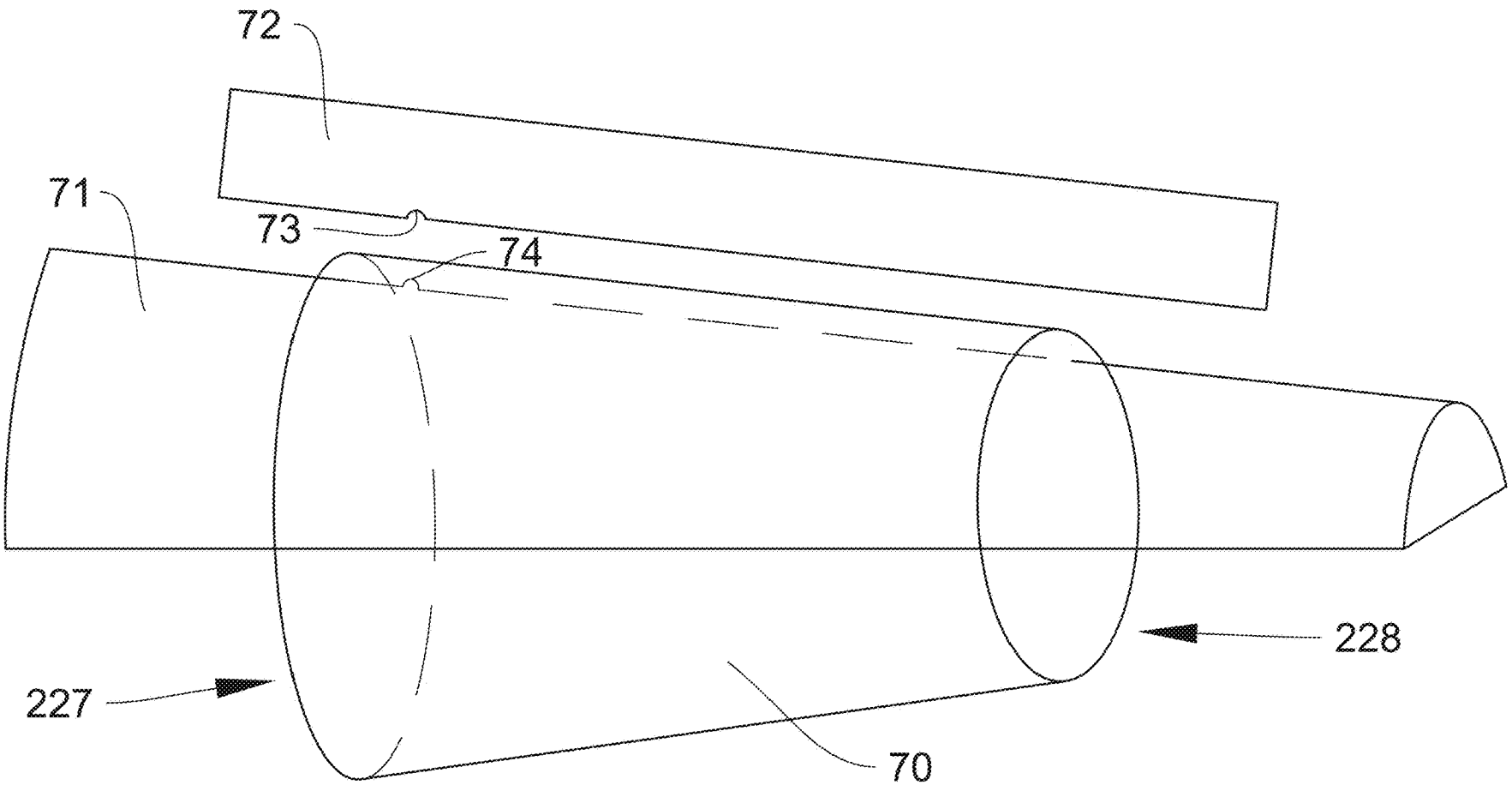
FIG. 24 is a first sequential diagrammatic depiction showing a process for forming a seamed container sidewall showing a heated press element with female indentation feature and a cone mold with male protuberance, the indentation feature and male protuberance being cooperable to form an indentation formation on the seamed container sidewall.
Figure 26A:
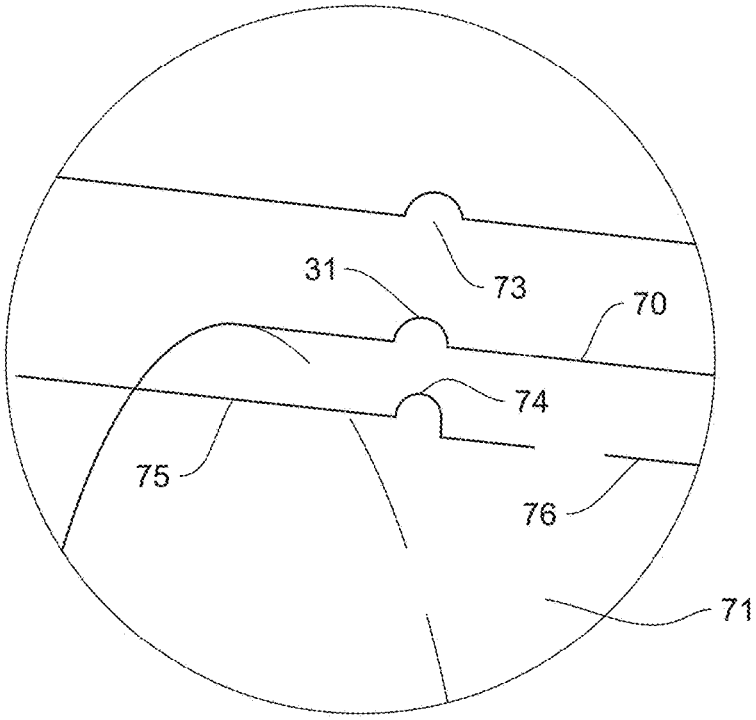
FIG. 26A is an enlarged, fragmentary sectional view as sectioned from FIG. 26 to show in greater detail the structures associated with the process otherwise illustrated in FIG. 26.
Figure 26:
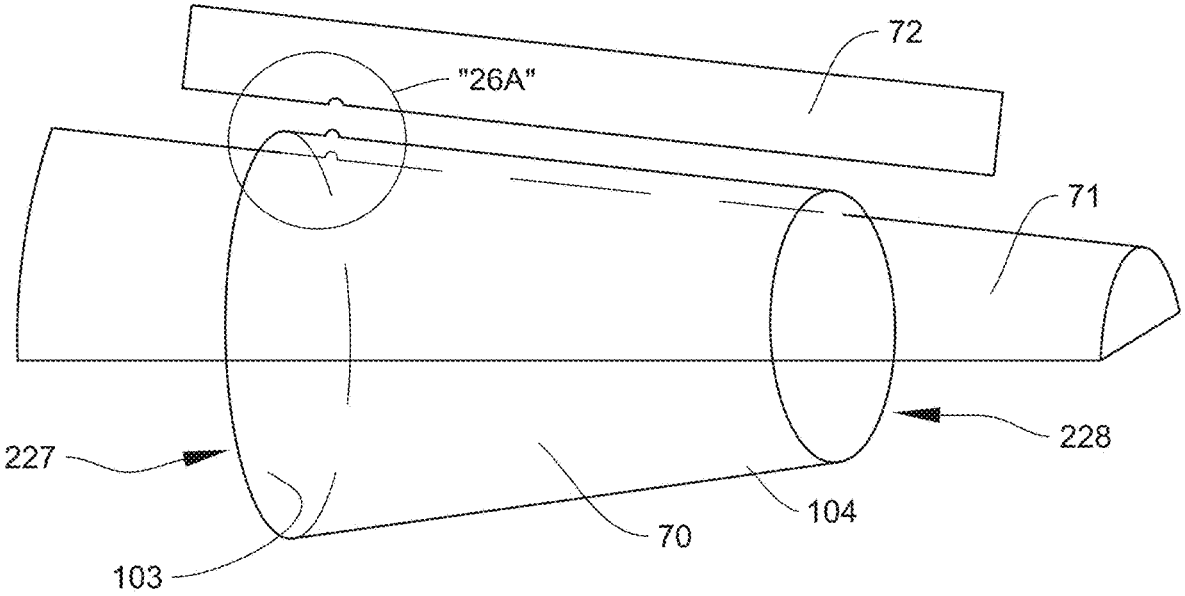
FIG. 26 is a third sequential diagrammatic depiction showing the process for forming a seamed container sidewall showing the heated press element with female indentation feature and cone mold with male protuberance, the indentation feature and male protuberance having cooperated to form the indentation formation on the seamed container sidewall.
Figure 27:
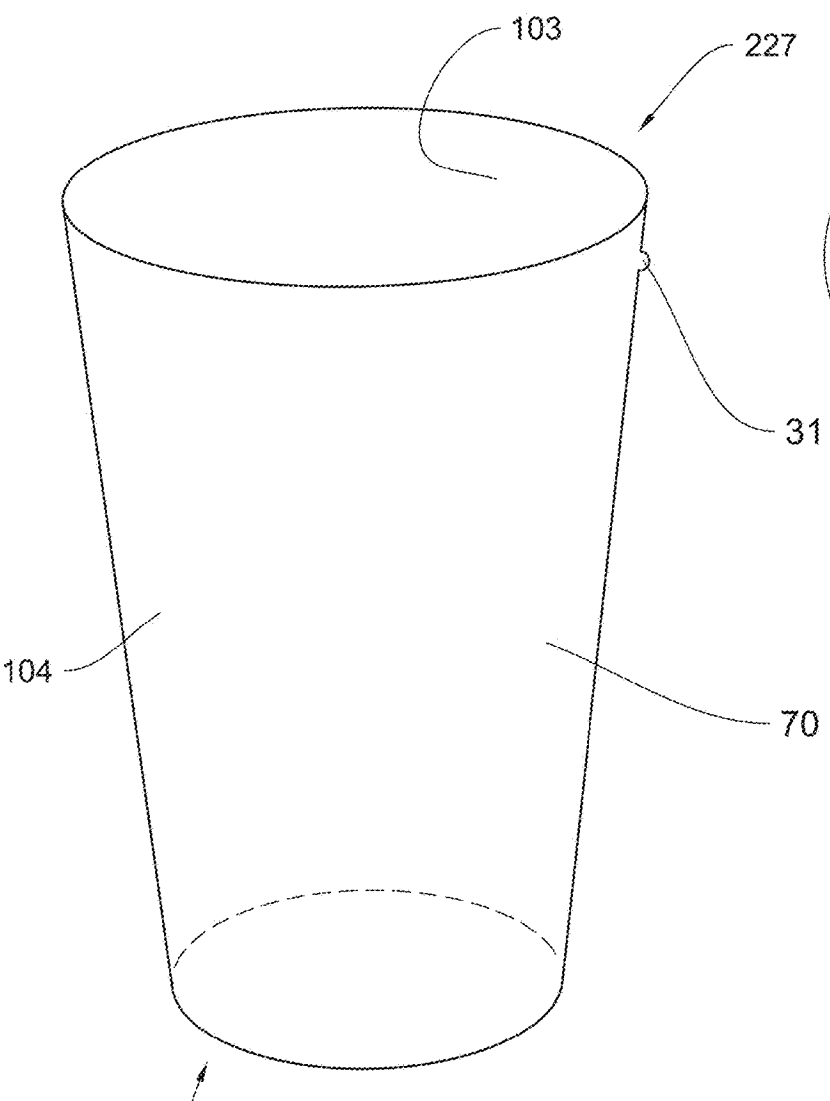
FIG. 27 is a perspective view of a paper cone element outfitted with an indentation formation according to the processes otherwise illustrated/depicted in FIGS. 24-26A.

The compressive nature of the packaging assemblies according to the present invention may provide a dual dynamic packaging body arrangement, each of which may optionally include a body-to-body locking mechanism or feature as primarily provided by the resilient portion may be incorporated into dual dynamic packaging bodies attachable to one another as generally depicted in FIGS. 20E and 21E, and the dynamic packaging body may preferably comprise at least one, but alternatively multiple resilient portions for enabling multiple compressive states, stages, stories or levels.

The reader is first directed to comparatively reference FIG. 20A versus FIG. 21A. The reader will there consider package assembly 300 as having a relatively greater or maximized internal package assembly volume as depicted in FIG. 20A when the dynamic package body as exemplified by lid construction 210' is in an unlocked, relaxed configuration. This relatively greater or maximized internal package body volume 156 is compared to a relatively lesser or minimized internal package body volume 157 depicted in FIG. 21A when the dynamic package body exemplified by lid construction 210' is in a locked, actuated configuration.

Comparatively referencing FIGS. 20C and 21C, the reader will there consider the locked, actuated configuration of the package assembly 300 that provides a compressed package assembly height as at 151, which compressed package assembly height 151 is lesser than the relaxed package assembly height as at 150 with an assembly height difference 152 being depicted in FIG. 21C extending between a relaxed assembly plane 116 and an actuated or compressed assembly plane 128 as measured from a static plane 117 extending through the bottom of the static package body or package box 120. When in the unlocked, relaxed configuration, the dynamic package body exemplified by lid construction 210' provides the maximized internal body volume or lid volume as at 156. When in the locked, actuated configuration, the dynamic package body exemplified by lid construction 210 provides the minimized internal body volume or lid volume as at 157.

The present invention thus contemplates a packaging assembly as at 300 comprising a static package body as at packaging box 120, which static package body defines a static internal body volume as at 155 and comprises a package body rim as at 101'. An actuable package lid or actuable, dynamic second package body exemplified by lid construction 210' provides a dynamic internal lid volume as maximized at internal body volume 156 and as minimized at internal body volume 157.

The actuable lid or dynamic package body exemplified by lid construction 210' comprises attachment means for attaching the dynamic package body to the second (static) package body; a lid or body wall as at 2; and at least one wall-to-groove, locking mechanism as exemplified by resilient portion 201. The attachment means are preferably exemplified by rim-receiving groove as at 12 and living hinge mechanism 127.

The attachment means exemplified by the rim-receiving groove 12 removably attach the dynamic package body to the static package body. The rim-receiving groove 12 receives the package body rim 101' thereby removably attaching the dynamic package body to the static package body for defining a dynamic internal package assembly volume within the ensemble. The resilient portion as at 201 of the dynamic package body exemplified by lid construction 210' extends intermediate the lid wall 2 and the rim-receiving groove 12 and is resiliently actuable (by way of downwardly directed forces as at 115) intermediate (a) an unlocked, relaxed configuration for defining a maximum internal package assembly volume (internal volume 155+ internal volume 156) when in a closed configuration with the package body or box 120 and (b) a locked, actuated configuration defining a minimum internal package assembly volume (internal volume 155+internal volume 157) when in the closed configuration with the package body or box 120.

Referencing FIGS. 20E and 21E, the reader will there consider a first alternative packaging assembly 301' according to the present invention incorporating upper (first) and lower (second) dynamic package bodies as at 210'. As prefaced above, the compressive nature of the packaging assemblies according to the present invention may be achieved by the provision of first and second or upper and lower or side by side dynamic package bodies as exemplified by construction 210'. The dual dynamic packaging bodies exemplified by constructions 210' may preferably further comprise a body-to-body locking mechanism or feature as primarily provided by the resilient portion 201 as incorporated into the dual dynamic packaging bodies attachable to one another to form packaging assembly 301'.

In a preferred iteration, the actuable body portions 210' as preferably integrally formed with and pivotally attached to one another via hinge mechanism 127 provides an adjustable/collapsible packaging assembly 301 'whereby the (internal) package assembly volume of the ensemble can be adjusted as necessary by the user by actuating the first (or upper) dynamic package body and/or the second (or lower) dynamic package body each exemplified by construction 210'. Portions of the dynamic bodies opposite the hinge mechanism comprise matable structures in the form of rim 101' and rim-receiving groove 12. The resilient portions 201 remain as previously described although the reader will again here note that the body-to-body locking mechanism provided by the resilient portion(s) 201 is optional.

As an optional feature, the resilient portion 201 may further comprise at least one wall-engaging portion exemplified by indentation-engaging portion(s) 9 and the static package body or box 120 comprises a package wall as at 119, which package wall 119 is resiliently actuable at a body-to-body contact portion 118. As noted hereinabove, the resilient portion may be provided without a wall-engaging portion so that the collapsible or compressible nature of the dynamic packaging body is the primary functional aspect or feature. When implemented, however, the wall-engaging portion, exemplified by indentation-engaging portion(s) 9, resiliently actuates the package wall 119 at the body-to-body contact portion 118 when the package lid or dynamic package body exemplified by lid construction 210' is in the locked, actuated configuration for cooperatively maximizing lid-to-package retention or body-to-body attachment.

It will be recalled that the resilient portion 201 is preferably L-shaped. The L-shaped resilient portion 201 is connected to an inner groove wall 203 of the rim-receiving groove 12 at a first pivot point 5 and comprises a base portion as at 204 and an upright portion as at 205 as more particularly illustrated in FIGS. 4 and 5. The base portion 204 extends inwardly from the inner groove wall 203 and the upright portion 205 extends substantially parallel to the inner groove wall 203 when in the unlocked, relaxed configuration. When in the locked, actuated configuration, the base portion 204 is coplanar with the inner groove wall 203 and the upright portion 205 extends inwardly relative to the inner groove wall 203.

It will thus be seen the package assembly 300 essentially comprises the dynamic package body exemplified by lid construction 210' for enabling the user to adjust internal package assembly volume as needed when in the closed configuration with the static package body as exemplified by package box 120. The dynamic package body according to the present invention essentially comprises a body wall as at wall 2, at least one resilient portion as at 201, and certain attachment means for attaching the dynamic package body to a static package body as described above.

The dynamic package body essentially enables a user to define a dynamic internal package assembly volume with the static package body when attached thereto. The resilient portion 201 extends intermediate the body wall 2 and the attachment means and is resiliently actuable intermediate (a) an unlocked, relaxed configuration for defining a maximum internal package assembly volume when in the closed configuration with the static package body and (b) a locked, actuated configuration defining a minimum internal package assembly volume when in the closed configuration with the static package body.

Figure 60:
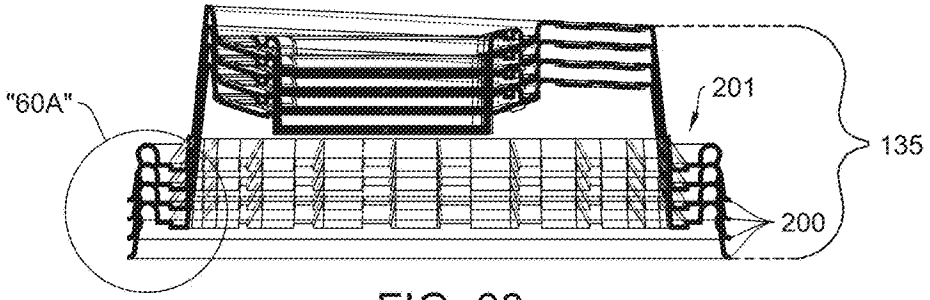
FIG. 60 is a second longitudinal cross-sectional view of a series of stacked container lids according to the present invention, which container lids are each individually configured into an unlocked configuration for reduction in stacking height.
Figure 60A:
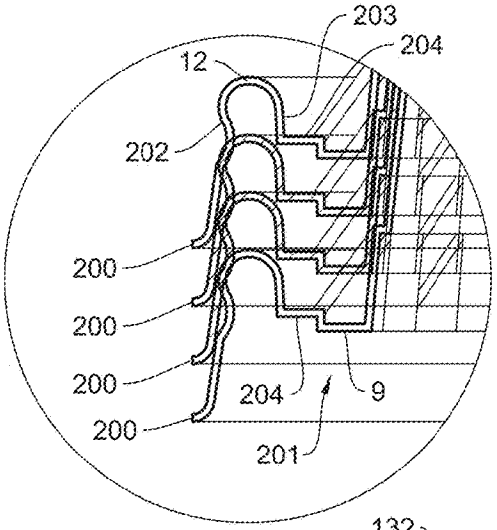
FIG. 60A is an enlarged, fragmentary sectional view as enlarged and sectioned from FIG. 60 to show in greater clarity the unlocked locking mechanisms according to the container lids there shown, the unlocked configurations for reducing stack height of the series of stacked container lids.

The dynamic package body may be further exemplified by lid constructions 200 or 210 and in such case is preferably stackable with a series of identical dynamic package bodies as generally illustrated in FIGS. 58-61A. The series of identical dynamic package bodies have a relatively reduced stacked height when in the unlocked, relaxed configuration as generally depicted in FIGS. 60 and 60A and referenced at stacked lid height 135. Comparatively referencing FIGS. 61 and 61A versus FIGS. 60 and 60A, it will be see that the stack of identical dynamic package bodies 200 (or 210) is lesser in height as compared to the stacked lid height 134 depicting the identical dynamic package bodies in the locked, actuated configuration.

In this regard, it will be seen that the resilient portion(s) 201 is/are configured to (a) decrease the stacked body height when in the unlocked, relaxed configuration and (b) increase the stacked body height when in the locked, actuated configuration. The resilient portion(s) 201 each preferably comprises at least one wall-engaging portion as exemplified by indentation-engaging portion(s) 9. The wall-engaging portion(s) support each dynamic package body atop the attachment means exemplified by rim-receiving groove structures 12 of underlying dynamic package bodies when in the locked, actuated configuration thereby increasing stacked body height as generally depicted in FIG. 61A. Alternatively, the attachment means exemplified by groove 12 nest with identical attachment means of successively stacked dynamic package bodies when in the unlocked, relaxed configuration for decreasing stacked body height as generally depicted in FIG. 60A.

Comparatively referencing FIG. 20 versus FIG. 21, and FIGS. 58 through 61A, the reader will note that the wall-to-groove locking mechanism or resilient portion 201 enables the user to either pre-engage or engage said mechanism at the time of packaging. The locking mechanism or wall-to-groove resilient portion 201 according to the present invention may be reversibly placed into the engaged or locked configuration (closed container) by pushing down on the lid construction 200 or unengaged/unlocked position (open container) by pulling up on upper portions of the lid construction 200. The locked and unlocked configurations are reversible and can be repeated multiple times. When stacked lid constructions 200 are all placed into the locked configuration before being stacked, the indentation-engaging portion(s) 9 minimize contact surface area between nested lids thereby reducing the tendency for nested lids to adhere to one another.

Figure 58:
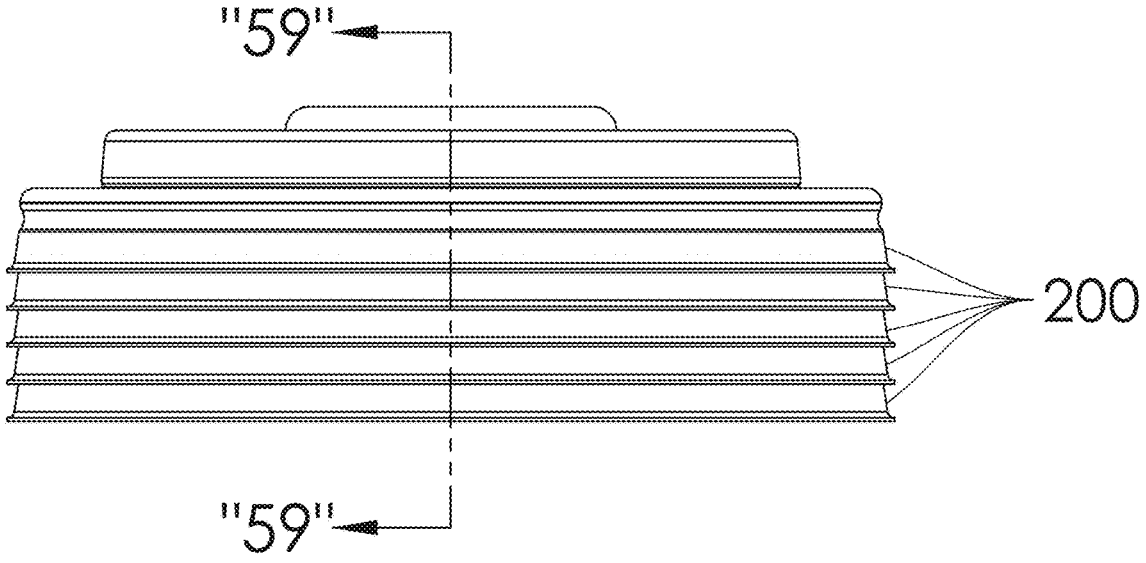
FIG. 58 is a side elevational view of a series of stacked container lids according to the present invention, which container lids are each individually configured into an unlocked configuration for reduction in stacking height.
Figure 61:
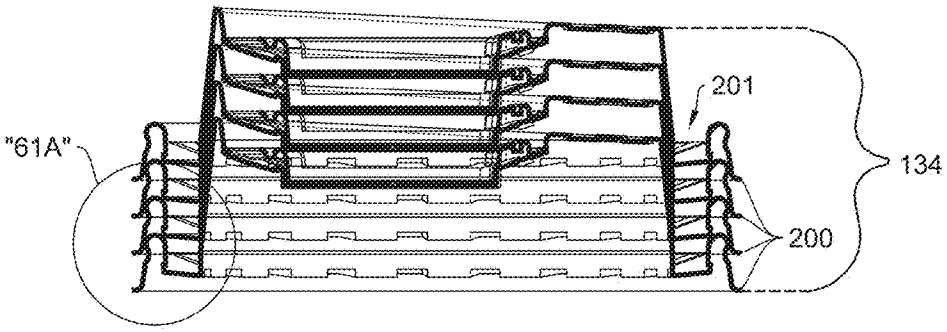
FIG. 61 is a longitudinal cross-sectional view of a series of stacked container lids according to the present invention, which container lids are each individually configured into a locked configuration for minimizing nested lid contact surface area thereby minimizing lid-to-lid adhesion for enabling ease with which successive container lids may be removed from the lid stack.
Figure 61A:
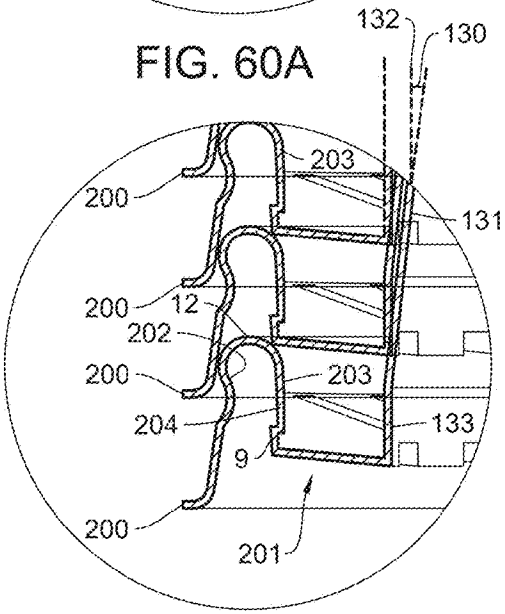
FIG. 61A is an enlarged, fragmentary sectional view as enlarged and sectioned from FIG. 61 to show in greater clarity the locked locking mechanisms according to the container lids there shown, the locked configurations for reducing lid-to-lid contact surface area and lid-to-lid adhesion.

The primary concept to be considered with reference to FIGS. 58 through 6A is the provision of a mechanism to prevent lid-to-lid adhesion or the sticking together of lids when packaged by placing the container lids into a locked or actuated configuration generally depicted in FIGS. 61 and 61A. When in the engaged configuration, the stacked lids will more easily dislodge or separate from one another. The engaged or locked configuration prevents the lids from mating to each other tightly, thus preventing sticking when packaged. The stacked lid height 134 when lids are stacked in the locked configuration as generally depicted in FIG. 61 is slightly greater than the stacked lid height 135 when lids 200 are stacked in the unlocked configuration as generally depicted in FIG. 60. The latter is preferred when reduction in stacked volume is of greater concern, and the former is preferred when ease of lid removal from the stacked arrangement is of greater concern.

In this regard, the reader will note that indentation-engaging portions 9 rest atop the rim-receiving groove 12 in superior adjacency to the inner groove wall 203 while simultaneously shifting pivot point 6 of an underlying container lid 200 upwardly to relatively higher portions 131 of the lid wall 2 which higher portions 131 extend in an angle 130 oblique to the plane 132 of relatively lower portions 133 of lid wall 2. This structural arrangement provides for reduced lid-to-lid contact surface area thereby reducing lid-to-lid adhesion for enabling greater ease when removing container lids 200 or 210 from the lid stack for deployment upon a liquid container as at 100 or 110.

Noting the unique structure of the containers 100 and 110, the present invention further contemplates a method of manufacturing the same. The manufacturing method according to the present invention is believed to preferably comprise the initial step of providing a cup fan as at 220. The cup fan 220 has a top edge 221, a bottom edge 222, opposed side edges as at 223, a first coated side as at 224, and a second non-coated side as at 225. The coated side 224 preferably comprises a hydrophobic material layer for preventing liquid permeation. A container sidewall or paper cone element 70 may then be formed from the cup fan 220 such that the container sidewall 70 has an open top end 227, an open bottom end 228, an inner cup surface 103, an outer cup surface 104, and a longitudinal seam 30 extending from the open top end 227 to the open bottom end 228 at an overlap site 229 of the opposed side edges 223.

A heated first press element 72 may then be positioned adjacent the outer cup surface 104. The first press element 72 has a non-planar first press surface as exemplified by a female indentation as at 73. A second press element 71 or cone mold is further positioned adjacent the inner cup surface 103, which second press element 71 also has a non-planar second press surface as exemplified by a male protuberance as at 74. The first and second press surfaces are thus matable. The outer and inner cup surfaces 104 and 103 are thus pressed between the first and second press elements 72 and 71 such that the first and second press surfaces 73 and 74 form at least one non-planar singular formation exemplified by primary indentation 31 at the inner surface 103 with a corresponding raised ridge or protuberance formation 105 at the outer cup surface 104 collectively referred to as the primary indentation formation 31.

The second side 225 may preferably be processed before forming the container sidewall or paper cone element 70 so as to remove material therefrom adjacent a first of the opposed side edges 223 thereby forming at least one material-removed edge section as at 33. The material-removed edge section 33 preferably extends obliquely relative to the planar first side 224 for reducing a seam thickness at the inner cup surface 103 as generally and comparatively depicted in FIG. 36A versus FIG. 37A. Comparatively referencing FIG. 30 versus FIG. 29, it will be seen that the material-removed edge section 33 may be located adjacent the top edge 221 or may extend an entire length of the first of the opposed side edges 223 intermediate the top edge 221 and bottom edge 222.

Noting that the first press element 72 preferably comprises a female indentation 73 and the second press element 71 preferably comprises a male protuberance 74, the male protuberance 74 is matable with the female indentation 73 via the material construction of the cup fan 220 for forming an outwardly extending indentation 31 at the inner cup surface 103 with corresponding protuberance 105 at the outer cup surface 104. The method may be further defined by positioning the first and second press elements 72 and 71 such that the first and second press elements 72 and 71 are positioned adjacent the seam 30 for forming the non-planar formation exemplified by the primary indentation 31 at or in traversal relative to the seam 30. In other words, the non-planar formation is preferably formed in such a way as to orthogonally traverse the seam 30 with equal portions of the indentation 31 extending across the seam 30 at the inner cup surface 103 and further being of a sufficient length to traverse the seam 30 at the outer cup surface 104.

Figure 15:
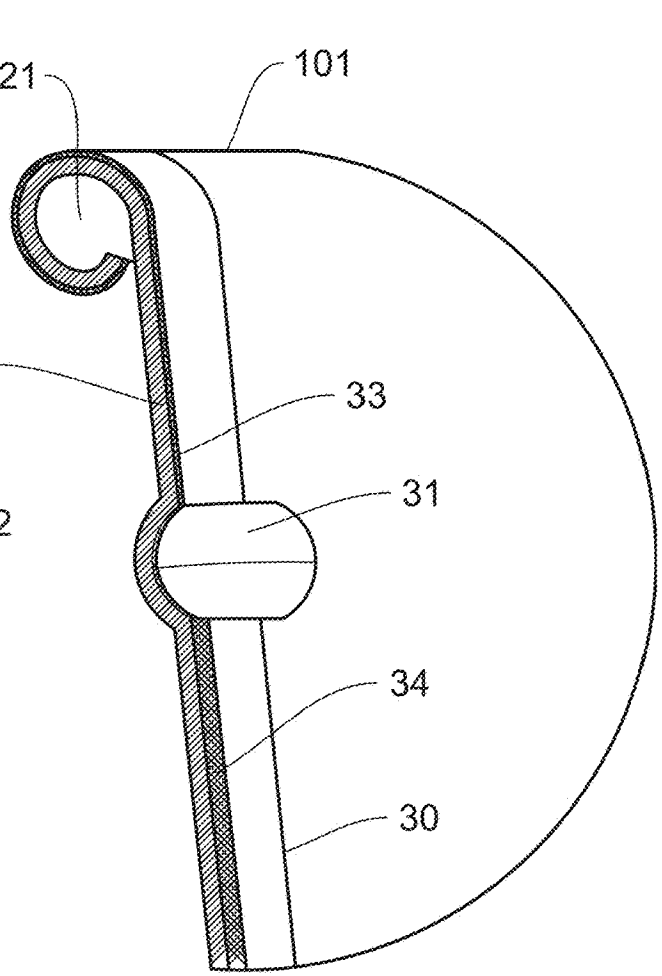
FIG. 15 is an enlarged, fragmentary section view as sectioned from FIG. 14 to show in greater detail the structures associated with the seam and indentation formation sites.
Figure 14:
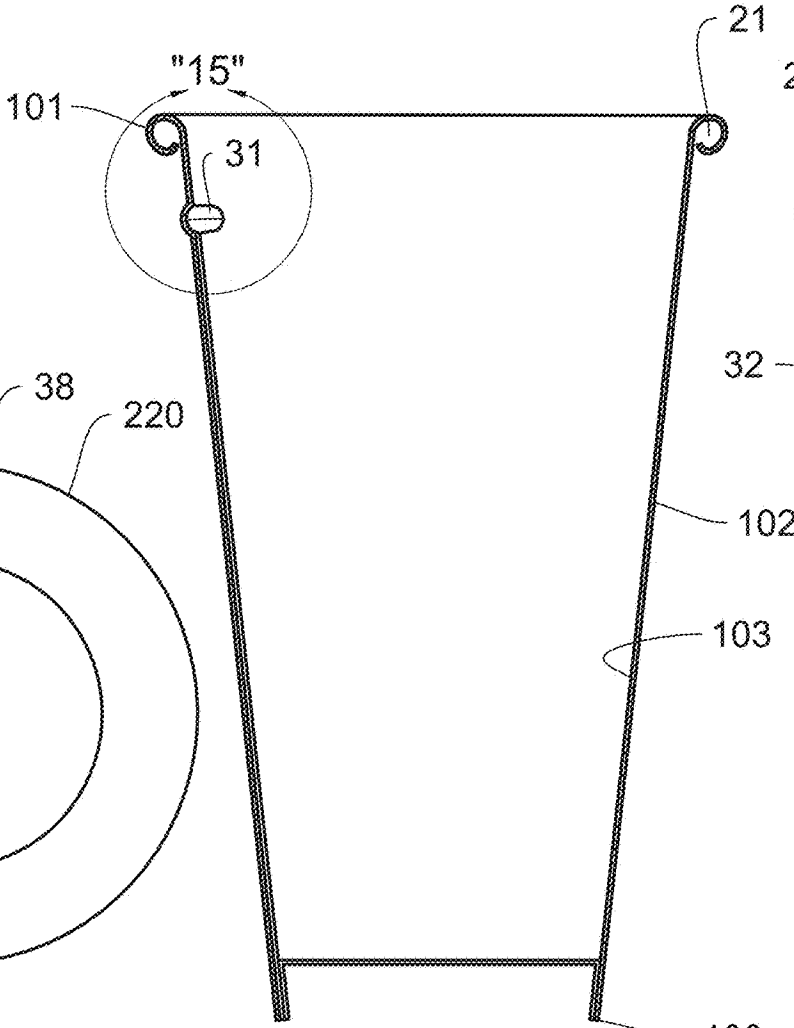
FIG. 14 is a longitudinal cross-sectional view of a seamed paper cup container through the seam site to show a partial indentation formation site across the seam site.
Figure 28:
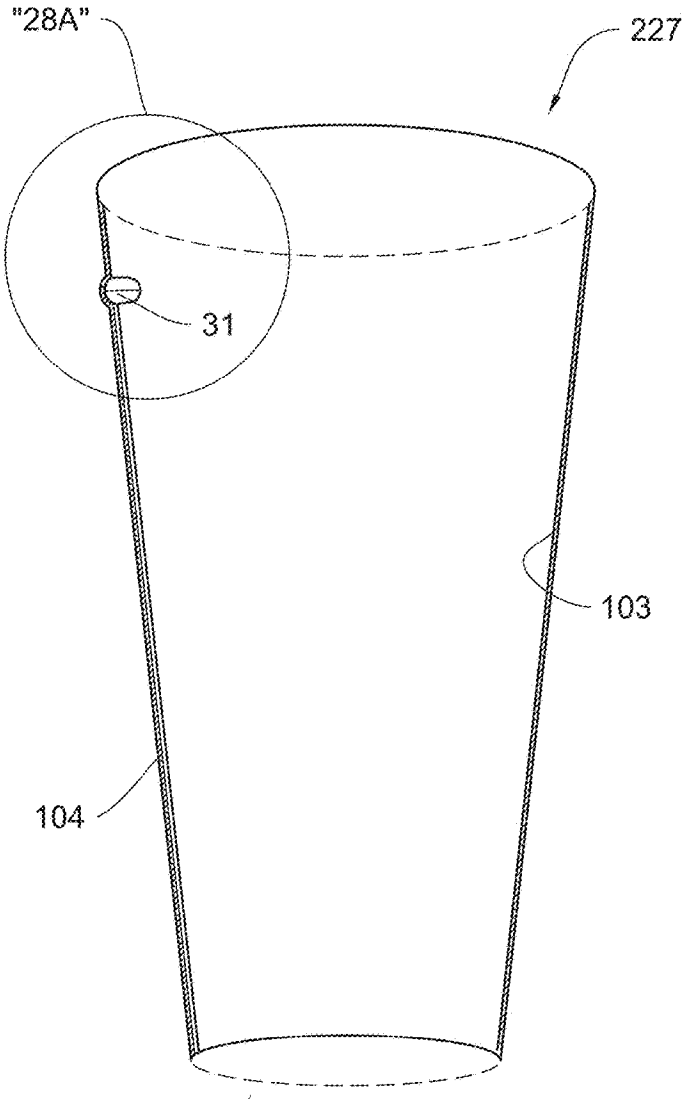
FIG. 28 is a cross-sectional perspective depiction of the seamed container sidewall outfitted with an indentation formation; the cross-section being sectioned through the seam junction.
Figure 28A:
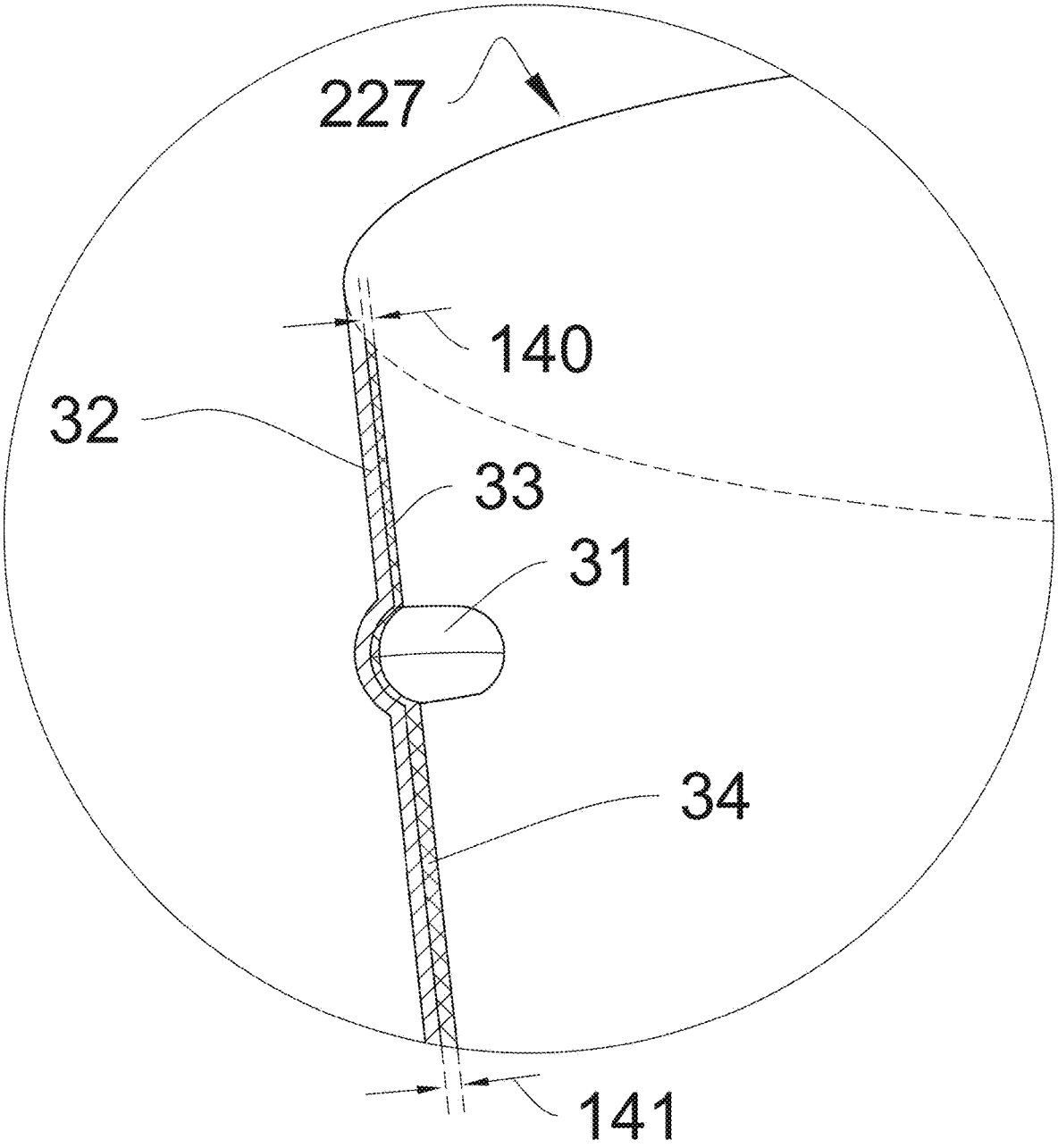
FIG. 28A is an enlarged, fragmentary sectional view as sectioned from FIG. 28 to show in greater detail the structures associated therewith, the material thickness above the indentation formation being lesser than the material thickness below the indentation formation.

Comparatively referencing FIGS. 24-37, and FIG. 26A in particular, it will be seen that level or plane 75 is parallel and higher than level or plane 76 on the metal cone-mold 71 to exert additional pressure at the point where the edge of the paper is shaved/sanded/pressed as depicted in FIGS. 30 and 32 at reference numeral 33 or as further depicted in FIG. 28A and FIG. 15. This method could also be used to press this paper edge under high pressure to "squeeze" it to minimal thickness as at 33. This type of pressing could require significant increase in power of the press for the heating element, but thinning the edge by this method does provide excellent results.

As a result of edge modification, the desired result of minimizing the "step" thickness at the paper seam joint 30 at the inner container surface 103 as shown in FIGS. 15 and 28A may be achieved in different ways. An additional benefit of thinning the back or non-coated edge of the cup fan 220 is that the material removal also makes it easier to curl the top edge of the container sidewall 70 in later steps and further creates smoother roll to more tightly accommodate the rim-receiving groove 12 of the container lid 200.

While the above descriptions contain much specificity, this specificity should not be construed as limitations on the scope of the invention, but rather as an exemplification of the invention. In the preferred embodiment according to the present specifications, the invention provides a package assembly as at 300 for adjusting (internal) package volume. The package assembly 300 according to the present invention essentially comprises a first or static package body as at package box 120, which package box or first static package body defines a static internal body volume as at 155 and comprises a container or first body rim as at 101'. The packaging assembly may optionally be provided with a static upper body or static lower body or side body with complementary dynamic packaging body attachable thereto, or both packaging bodies may be optionally dynamic.

The package assembly 300 further essentially comprises a second or dynamic package body, which second, dynamic package body is actuable for providing a dynamic internal body volume and comprises attachment means exemplified by a rim-receiving groove as at 12, a second body wall as at 2, and at least one resilient portion as at 201. The rim-receiving groove receives the body rim 101' of the static package body defining a dynamic internal package assembly volume with the dynamic package body when the rim-receiving groove receives the body rim 101'. The at least one resilient portion extends intermediate the body wall 2 and the rim-receiving groove 12 and is resiliently actuable intermediate (a) an unlocked, relaxed configuration for defining a maximum internal package assembly volume when assembled with the static package body and (b) a locked, actuated configuration defining a minimum internal package assembly volume when assembled with the static package body.

It will thus be seen the package assembly 300 essentially comprises the dynamic package body exemplified by lid construction 210 for enabling the user to adjust internal package assembly volume as needed when attached to static package body as exemplified by package box 120. The dynamic package body according to the present invention essentially comprises a body wall as at wall 2, at least one resilient portion as at 201, and certain attachment means for attaching the dynamic package body to a static package body.

The dynamic package body essentially enables a user to define a dynamic internal package assembly volume with the static package body when attached thereto. The resilient portion extends intermediate the body wall and the attachment means and is resiliently actuable intermediate (a) a relaxed configuration for defining a maximum internal package assembly volume when assembled with the static package body and (b) an actuated configuration defining a minimum internal package assembly volume when assembled with the static package body.

As prefaced above, the packaging assembly may optionally be provided with a static upper body or static lower body or side body with complementary dynamic packaging body attachable thereto, or alternatively both packaging bodies may be optionally dynamic as in packaging assembly 301'. In this regard, the present invention contemplates the provision of a package assembly for adjusting package assembly volume having a first package body with a body rim as at 101', and a second package body with a rim-receiving groove as at 12.

A select package body, as selected from the group consisting of the first and second package bodies, is actuable for providing a dynamic body volume and further comprises a body wall and at least one resilient portion. The rim-receiving groove receives the body rim, and the select package body thereby defines a dynamic package assembly volume when the rim-receiving groove receives the body rim. The at least one resilient portion extends intermediate the body wall and the rim-receiving groove and is resiliently actuable intermediate (a) a relaxed configuration for defining a maximum package assembly volume when in a closed configuration and (b) an actuated configuration defining a minimum package assembly volume when in the closed configuration.

The dynamic package body as exemplified by lid constructions 200 or 210 is preferably stackable with a series of identical dynamic package bodies as generally illustrated in FIGS. 58-61A. The series of identical dynamic package bodies have a relatively reduced stacked height when in the unlocked, relaxed configuration as generally depicted in FIGS. 60 and 60A and referenced at stacked lid height 135. Comparatively referencing FIGS. 61 and 61A versus FIGS. 60 and 60A, it will be see that the stack of identical dynamic package bodes 200 (or 210) is lesser in height as compared to the stacked lid height 134 depicting the identical dynamic package bodies in the locked, actuated configuration.

In this regard, it will be seen that the resilient portion(s) 201 is/are configured to (a) decrease the stacked body height when in the unlocked, relaxed configuration and (b) increase the stacked body height when in the locked, actuated configuration. The resilient portion(s) 201 each preferably comprises at least one wall-engaging portion as exemplified by indentation-engaging portion(s) 9. The wall-engaging portion(s) support each dynamic package body atop the attachment means exemplified by rim-receiving groove structures 12 of underlying dynamic package bodies when in the locked, actuated configuration thereby increasing stacked body height as generally depicted in FIG. 61A. Alternatively, the attachment means nest with attachment means of successively stacked dynamic package bodies when in the unlocked, relaxed configuration for decreasing stacked body height as generally depicted in FIG. 60A.

The dynamic package body thus provides a locking/collapsing structure having at least one resilient portion as variously illustrated. However, it is contemplated that the dynamic package body may be outfitted with additional resilient portions for enabling the user to collapse sections of the dynamic package body for selectively increasing or decreasing the internal volume of the dynamic package body as needed. Further, the dynamic package body could be attached to a static package body from opposite sides of the body in which case the static packaging body necessarily comprises more than one attachment rim 101'.

In addition to the preferred target application of food packaging, the dynamic package body is particularly useful if used in combination with cartons or other box-like packaging bodies. The packager is enabled to utilize fewer, adjustable size package assemblies since it allows the user to adjusting the internal volumetric space of the package assembly to fit parts with less empty space. Additionally, the dynamic package body makes package assemblies more durable and stackable, and decreases the necessity of using space fillers such as bubble-wrap or any other fillers used by packaging companies, and reduces occupied space during transportation.

In certain alternative embodiments, the basic invention may be said to essentially teach or disclose a container lid for maximizing lid-to-container retention or for preventing inadvertent removal of the container lid from a liquid container. The container lids according to the present invention may be said to essentially comprise or include a rim-receiving groove, a lid wall, and a resilient portion extending intermediate the rim-receiving groove and the lid wall.

The resilient portion is resiliently actuable intermediate an unlocked configuration and a locked configuration, and further preferably comprises at least one indentation-engaging portion. The rim-receiving groove receives the upper container rim, and the at least one indentation-engaging portion engages the at least one indentation when in the locked configuration. Together, the rim-receiving groove and the at least one indentation-engaging portion lock the container lid to the upper container rim of a liquid container when in the locked configuration for maximizing lid-to-container retention.

Referencing FIGS. 58-61A, the reader will recall the container lids according to the present invention are stackable in a series of identical container lids. The series of identical container lids have a relatively reduced stacked height when in the unlocked configuration as compared to the locked configuration and further have a reduced lid-to-lid contact surface area when in the locked configuration for reducing lid-to-lid adhesion. The user may thus select either the unlocked or locked configurations when packaging container lids according to the present invention depending on the requirements of the user. The stackable container lid thereby provides users with packaging options.

The container lids according to the present invention are further usable in combination with a particularly manufactured liquid container according to the present invention. The liquid container preferably comprises or includes an upper container rim and a container wall extending downwardly from the upper container rim. The container wall comprises a seam and at least one indentation at the inner container surface. The seam extends orthogonally relative to the container rim, and the at least one indentation extends outwardly at the inner container surface of the container wall.

Figure 13:
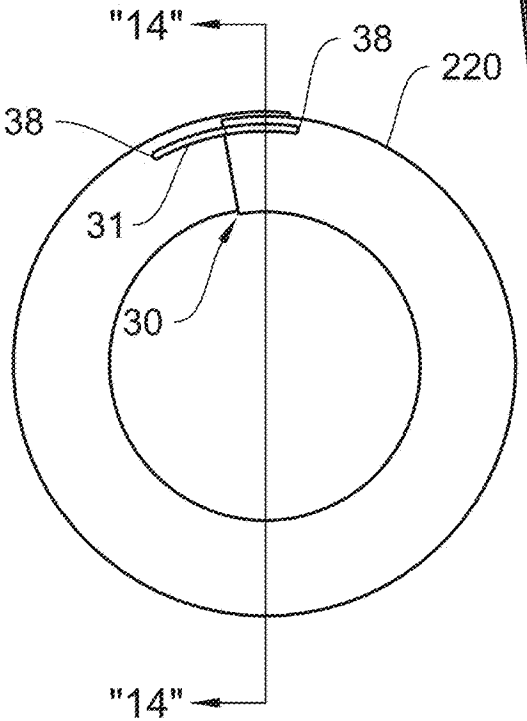
FIG. 13 is a top plan type diagrammatic depiction of a seamed paper cup container depicting a relatively enlarged indentation formation traversing the seam such that the indentation formation is bisected at its middle point at the inner container surface, the indentation formation being of sufficient length to also traverse the seam at the outer container surface.
Figure 17:
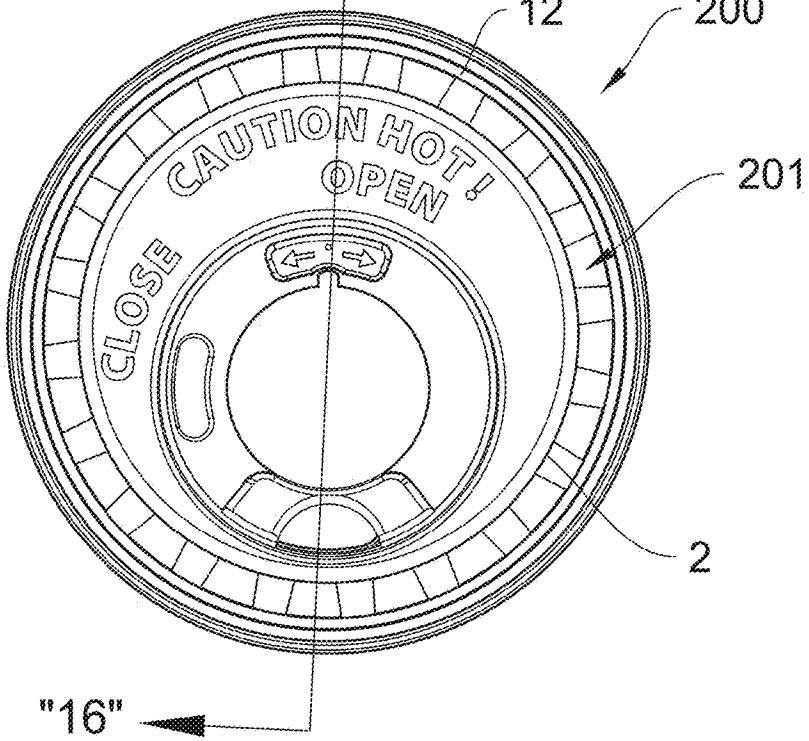
FIG. 17 is a top plan view of the lid construction otherwise depicted in FIG. 16 as outfitted upon the seamed paper cup container.
Figure 16:
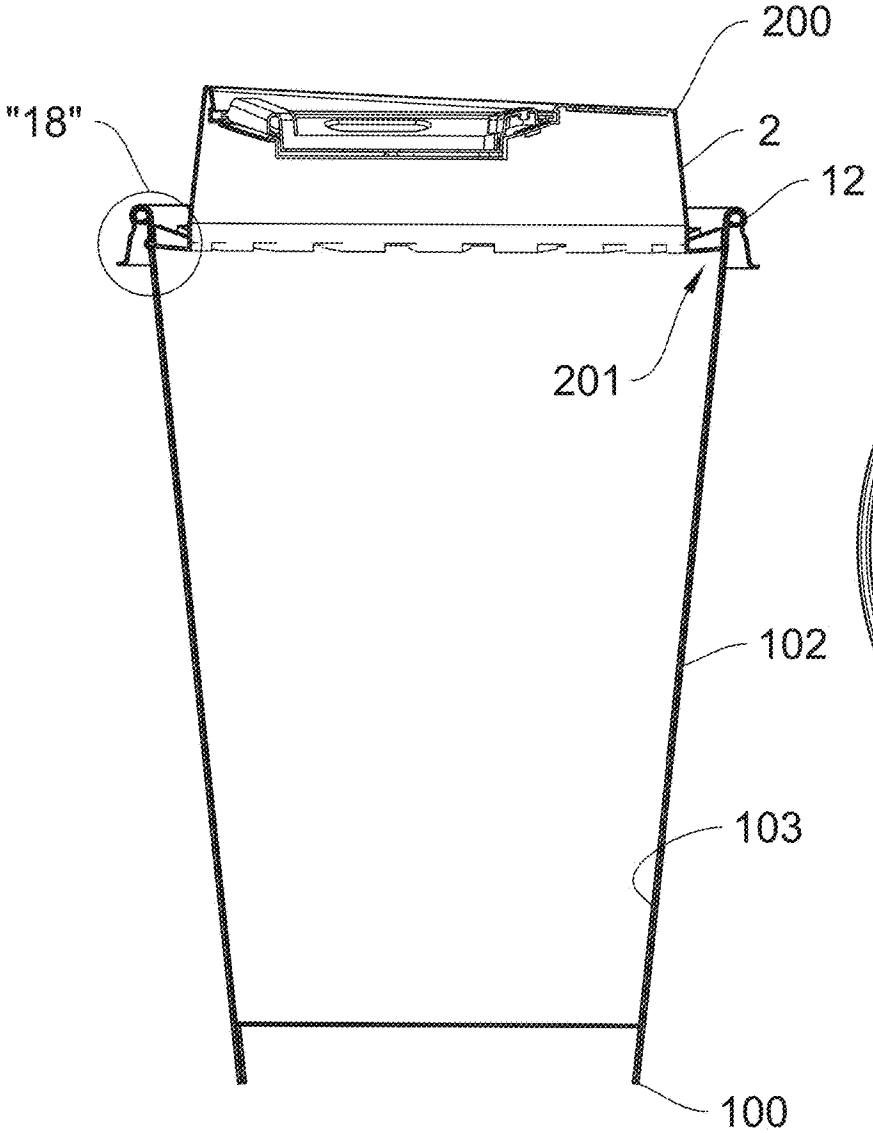
FIG. 16 is a longitudinal cross-sectional view of seamed paper cup container outfitted with a lid construction according to the present invention as sectioned through the seam site.

The at least one indentation comprises a primary indentation, the primary indentation preferably traverses the seam in parallel relation to the container rim. The primary indentation traverses the seam at the inner container surface such that the seam at the inner container surface bisects the primary indentation in substantially equal half portions 38 as generally depicted in FIG. 13. The container wall may further preferably comprise a series of secondary indentations that extend outwardly in inferior adjacency to the upper container rim at the inner surface of the container wall in parallel relation to the container rim and in coplanar relation with the primary indentation. This feature is basically seen in liquid container 110.

The rim-receiving groove of the container lids preferably comprises an outer groove wall and an inner groove wall. The wall-to-groove resilient portion as at 201 is preferably L-shaped and connected to the inner groove wall at a first pivot point. The L-shaped resilient portion comprises a base portion and an upright portion that pivot between the unlocked and locked positions. The base portion extends inwardly from the inner groove wall and the upright portion extends substantially parallel to the inner groove wall when in the unlocked configuration. When in the locked configuration, the base portion is coplanar with the inner groove wall and the upright portion extends inwardly relative to the inner groove wall.

The lid wall may preferably comprise a lid indentation as at feature 4. The lid indentation extends inwardly in superior adjacency to the wall-to-groove resilient portion. The lid indentation is connected to the upright portion at a second pivot point, and provides a resilient structural relief for enhancing movement between the locked and unlocked configuration. The outer groove wall of the rim-receiving groove preferably comprises a groove wall indentation. The groove wall indentation extends inwardly in inferior adjacency to the upper container rim for enhancing fitted engagement therewith.

The container lid is preferably provided as an ensemble comprising a lower lid construction and an upper lid construction. The upper lid construction is seatable atop the lower lid construction and is movable relative thereto. The lower lid construction comprises a lower lid outlet and the upper lid construction comprises an outlet-covering indentation and an upper lid outlet. The outlet-covering indentation is positionable over the lower lid outlet for selectively preventing liquid egress therefrom.

The lower lid outlet is formed in a lower lid indentation and surrounded in spaced relation by a raised ridge. The outlet-covering indentation is smaller in dimension than the lower lid indentation such that an air pocket extends between the lower lid indentation and the outlet-covering indentation when the outlet-covering indentation covers the lower lid outlet. The air pocket further prevents liquid egress from the lower lid outlet.

The upper lid construction comprises an edge-located step-down formation received in an edge-receiving groove formed in the lower lid construction. The step-down formation enhances seated engagement between the upper and lower lid constructions. The upper lid construction is peripherally sized so as to form an air space radially and outwardly adjacent the step-down formation when received in the edge-receiving groove. The air space reduces friction between the upper and lower lid constructions.

The present invention further contemplates a method of manufacturing a liquid container comprising the steps of providing a cup fan, the cup fan having a top edge, a bottom edge, and opposed side edges, and forming a container sidewall from the cup fan. The container sidewall has an open top end, an open bottom end, an inner cup surface, and outer cup surface, and a longitudinal seam extending from the open top end to the open bottom end at an overlap site of the opposed side edges.

First and second press elements are positioned adjacent the outer and inner cup surfaces, preferably at the seam site. Each of the first and second press elements have a non-planar press surface, which surfaces are matable. The outer and inner cup surfaces are pressed via or between the first and second press elements for forming at least one non-planar singular formation at the inner and outer cup surfaces traversing the seam site. The first press element may preferably comprises a female indentation and the second press element may preferably comprise a male protuberance. The male protuberance is matable with the female indentation for forming an outwardly extending indentation at the inner cup surface.

The cup fan preferably comprises a first side and a second side. The second side may preferably be processed before forming the container sidewall to remove material therefrom adjacent a first of the opposed side edges thereby forming at least one material-removed edge section. The material-removed edge section preferably extends obliquely relative to the first side for reducing a seam thickness at the inner cup surface. The material-removed edge section may extend an entire length of the first of the opposed side edges or may be formed adjacent the top edge.

Accordingly, although the primary packaging assemblies and secondary lid-container combinations according to the present invention have been described by reference to a number of different embodiments, it is not intended that the novel combinations or assemblies be limited thereby, but that modifications thereof are intended to be included as falling within the broad scope and spirit of the foregoing disclosure, the appended drawings, and perhaps most importantly, the following claims.

What is claimed is:

1. A package assembly for adjusting package assembly volume, the package assembly comprising:

a static package body, the static package body defining a static body volume and comprising a peripheral body rim; and a dynamic package body, the dynamic package body being actuable for providing a dynamic body volume and comprising a peripheral rim-receiving groove, a dynamic body wall, and at least one resilient portion at a junction intermediate the peripheral rim-receiving groove and the dynamic body wall, the peripheral rim-receiving groove comprising an outer groove wall and an inner groove wall, the at least one resilient portion being pivotally connected to the inner groove wall at a first pivot point, the peripheral rim-receiving groove for receiving the body rim, the dynamic package body defining a dynamic package assembly volume with the static package body when the peripheral rim-receiving groove receives the peripheral body rim;

the at least one resilient portion comprising an inner upright portion, a lower base portion, an outer upright extension section, and an outer span portion, the outer span portion being pivotally attached to the inner groove wall at the first pivot point, the outer upright extension section orthogonally connecting the outer span section to the lower base portion, the lower base portion orthogonally connecting the outer upright extension section to the inner upright portion;

the outer span portion and the lower base portion extending inwardly from the inner groove wall, and the outer extension section and the inner upright portion extending substantially parallel to the inner groove wall when the dynamic package body is in a relaxed configuration;

the outer span portion becoming coplanar with the inner groove wall, the lower base portion becoming substantially parallel with the inner groove wall, the outer extension section and the inner upright portion extending inwardly relative to the inner groove wall when the dynamic package body is pivoted to an actuated configuration;

the at least one resilient portion extending intermediate the dynamic body wall and the peripheral rim-receiving groove, being resiliently actuable intermediate (a) the relaxed configuration for defining a maximum package assembly volume when in an assembled configuration with the static package body and (b) the actuated configuration defining a minimum package assembly volume when in the assembled configuration with the static package body.

2. The package assembly of claim 1 wherein the at least one resilient portion further comprises at least one wall-engaging portion, the at least one wall-engaging portion comprising the lower base portion as structurally positioned by the outer extension section and inner upright portion, the lower base portion resiliently actuating a static body wall of the static package body when the dynamic package body is in the actuated configuration thereby providing a body-to-body locking mechanism for cooperatively maximizing body-to-body attachment.

3. The package assembly of claim 2 wherein the dynamic package body is pivotally attached to the static package body by way of a living hinge mechanism at the first pivot point.

4. A package assembly for adjusting package assembly volume, the package assembly comprising:

a first package body, the first package body comprising a peripheral body rim, and a second package body, the second package body comprising a peripheral rim-receiving groove and a second body wall;

the second package body being actuable for providing a dynamic body volume and further comprising a resilient portion intermediate the peripheral rim-receiving groove and the second body wall, the peripheral rim-receiving groove comprising an outer groove wall and an inner groove wall, the peripheral rim-receiving groove for receiving the body rim, the second package body defining a dynamic package assembly volume when the peripheral rim-receiving groove receives the peripheral body rim;

the resilient portion comprising an inner upright portion, a lower base portion, an outer upright extension section, and an outer span portion, the outer span portion being pivotally attached to the inner groove wall, the outer upright extension section connecting the outer span section to the lower base portion, the lower base portion connecting the outer upright extension section to the inner upright portion;

the outer span portion and the lower base portion extending inwardly from the inner groove wall, and the outer extension section and the inner upright portion extending substantially parallel to the inner groove wall when the second package body is in a relaxed configuration;

the outer span portion becoming coplanar with the inner groove wall, the lower base portion becoming substantially parallel with the inner groove wall, the outer extension section and the inner upright portion extending inwardly relative to the inner groove wall when the second package body is pivoted to an actuated configuration;

the resilient portion being resiliently actuable intermediate (a) the relaxed configuration for defining a maximum package assembly volume when the first package body and the second package body are in a closed configuration and (b) the actuated configuration defining a minimum package assembly volume when the first package body and the second package body are in the closed configuration.

5. The package assembly of claim 4 wherein the first package body is a static package body and the second package body is a dynamic package body, the resilient portion further comprising at least one wall-engaging portion, the at least one wall-engaging portion resiliently actuating a static body wall of the static package body when the dynamic package body is in the actuated configuration thereby providing a body-to-body locking mechanism for cooperatively maximizing body-to-body attachment.

6. The package assembly of claim 5 wherein the dynamic package body is pivotally attached to the static package body by way of a living hinge mechanism at a first pivot point intermediate the inner groove wall and the outer span portion.

7. A dynamic package body for adjusting body volume, the dynamic package body comprising:

a body wall, a resilient portion, and a peripheral rim-receiving groove for attaching the dynamic package body to a peripheral rim of a select second package body, the peripheral rim-receiving groove comprising an outer groove wall and an inner groove wall, the dynamic package body defining a dynamic package assembly volume with the select second package body when attached thereto;

the resilient portion comprising an inner upright portion, a lower base portion, an outer upright extension section, and an outer span portion, the outer span portion being pivotally attached to the inner groove wall, the outer upright extension section connecting the outer span section to the lower base portion, the lower base portion connecting the outer upright extension section to the inner upright portion;

the outer span portion and the lower base portion extending inwardly from the inner groove wall, and the outer extension section and the inner upright portion extending substantially parallel to the inner groove wall when the second package body is in a relaxed configuration;

the outer span portion becoming coplanar with the inner groove wall, the lower base portion becoming substantially parallel with the inner groove wall, the outer extension section and the inner upright portion extending inwardly relative to the inner groove wall when the second package body is pivoted to an actuated configuration;

the resilient portion, extending intermediate the body wall and the peripheral rim-receiving groove, being resiliently actuable intermediate (a) the relaxed configuration for defining a maximum package assembly volume when the dynamic package body is attached to the select second package body and (b) the actuated configuration for defining a minimum package assembly volume when the dynamic package body is attached to the select second package body.

8. The dynamic package body of claim 7 in combination with the select second package body, the select second package body being selected from the group consisting of a second dynamic package body and a static package body.

9. The dynamic package body combination of claim 8 wherein the select second package body is the static package body comprising a static body wall, the static body wall being resiliently actuable, the resilient portion further comprising at least one wall-engaging portion, the at least one wall-engaging portion resiliently actuating the static body wall when the dynamic package body is in the actuated configuration thereby providing a body-to-body locking mechanism for cooperatively maximizing body-to-body attachment.

10. The dynamic package body of claim 7 being stackable with a series of identical dynamic package bodies, the series of identical package bodies having a relatively reduced stacked body height when in the relaxed configuration as compared to a relatively increased stacked body height when in the actuated configuration.

11. The dynamic package body of claim 10 wherein the resilient portion is configured to (a) decrease stacked body height when in the relaxed configuration and (b) increase stacked body height when in the actuated configuration.

12. The dynamic package body of claim 11 wherein the resilient portion comprises at least one wall-engaging portion, the at least one wall-engaging portion for supporting the dynamic package body atop an underlying peripheral rim-receiving groove of an underlying dynamic package body when in the actuated configuration thereby increasing stacked body height, the peripheral rim-receiving groove nesting with underlying peripheral rim-receiving grooves of successively stacked dynamic package bodies when in the relaxed configuration thereby decreasing stacked body height.

13. The package assembly of claim 8 wherein the dynamic package body is pivotally attached to the select second package body by way of a living hinge mechanism at a first pivot point intermediate the inner groove wall and the outer span portion.

14. The package assembly of claim 2 wherein the outer span portion, the outer extension section, the lower base portion, and the inner upright portion pivot 90 degrees about the first pivot point when the dynamic package body is actuated from the relaxed configuration to the actuated configuration.

15. The package assembly of claim 2 wherein the static package body comprises a static body wall, the static body wall comprising at least one indentation, the resilient portion comprising at least one wall-engaging portion, the at least one wall-engaging portion being receivable in the at least one indentation when the dynamic package body is actuated from the relaxed configuration to the actuated configuration for enhancing the body-to-body locking mechanism for cooperatively maximizing body-to-body attachment.

16. The package assembly of claim 6 wherein the outer span portion, the outer extension section, the lower base portion, and the inner upright portion pivot 90 degrees about the first pivot point when the second package body is actuated from the relaxed configuration to the actuated configuration.

17. The package assembly of claim 4 wherein the first package body comprises a first body wall, the first body wall comprising at least one indentation, the resilient portion comprising at least one wall-engaging portion, the at least one wall-engaging portion being receivable in the at least one indentation when the second package body is actuated from the relaxed configuration to the actuated configuration for providing a body-to-body locking mechanism for cooperatively maximizing body-to-body attachment.

18. The dynamic package body of claim 13 wherein the outer span portion, the outer extension section, the lower base portion, and the inner upright portion pivot 90 degrees about the first pivot point when the dynamic package body is actuated from the relaxed configuration to the actuated configuration.

19. The dynamic package body of claim 8 wherein the first package body comprises a first body wall, the first body wall comprising at least one indentation, the resilient portion comprising at least one wall-engaging portion, the at least one wall-engaging portion being receivable in the at least one indentation when the second package body is actuated from the relaxed configuration to the actuated configuration for providing a body-to-body locking mechanism for cooperatively maximizing body-to-body attachment.

* * * * *